US007997674B2

(12) United States Patent
Sugahara

(10) Patent No.: US 7,997,674 B2
(45) Date of Patent: Aug. 16, 2011

(54) LIQUID DROP EJECTION APPARATUS

(75) Inventor: Hiroto Sugahara, Aichi-ken (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 985 days.

(21) Appl. No.: 11/861,601

(22) Filed: Sep. 26, 2007

(65) Prior Publication Data

US 2008/0186343 A1 Aug. 7, 2008

(30) Foreign Application Priority Data

Sep. 28, 2006 (JP) ..... 2006-265333

(51) Int. Cl.
*B41J 29/38* (2006.01)

(52) U.S. Cl. ..... 347/14; 347/19

(58) Field of Classification Search ..... 347/14, 347/19

See application file for complete search history.

(56) References Cited

U.S. PATENT DOCUMENTS 5,627,571 A * 5/1997 Anderson et al. ..... 347/19
6,481,820 B1 11/2002 Tamura et al.
6,641,246 B2 * 11/2003 Endo et al. ..... 347/19
6,918,644 B2 * 7/2005 Aruga ..... 347/9
7,145,589 B2 * 12/2006 Amada et al. ..... 347/241
7,440,099 B2 * 10/2008 Wong ..... 356/335
7,505,060 B2 * 3/2009 Amada et al. ..... 347/241
2002/0018090 A1 * 2/2002 Takazawa et al. ..... 347/19

FOREIGN PATENT DOCUMENTS

JP 11334047 A 12/1999
JP 2003276171 A 9/2003
JP 2006110964 A 4/2006

* cited by examiner

*Primary Examiner* — Charlie Peng
(74) *Attorney, Agent, or Firm* — Banner & Witcoff, Ltd

(57) ABSTRACT

A light detection device includes laser sources arranged at both ends in the scanning direction and at one end in the paper feed direction for emitting laser beams intersecting with each other, and light receiving elements arranged at both ends in the scanning direction and at the other end in the paper feed direction for receiving the laser beams emitted from the laser sources. An ink-jet head is adapted to be capable of reciprocating in the scanning direction, and a plurality of nozzle ejection ports are formed between the laser sources and the light-receiving elements in terms of paper feed direction. When ink drops ejected from a nozzle are overlapped with the laser beams, the laser beams are interrupted by the ink drops, and hence the light-receiving elements do not receive the laser beams any longer. The detection of these light beams may be used to determine an amount of deviation in liquid drops ejected from the nozzles, and corrective measures may be taken.

24 Claims, 34 Drawing Sheets

Fig. 26A
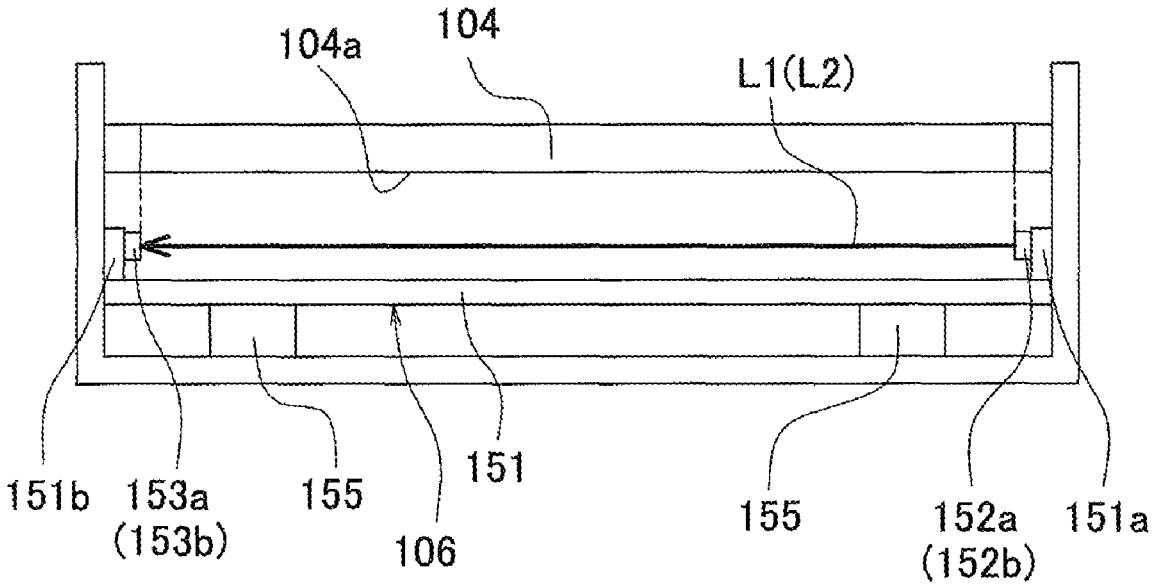
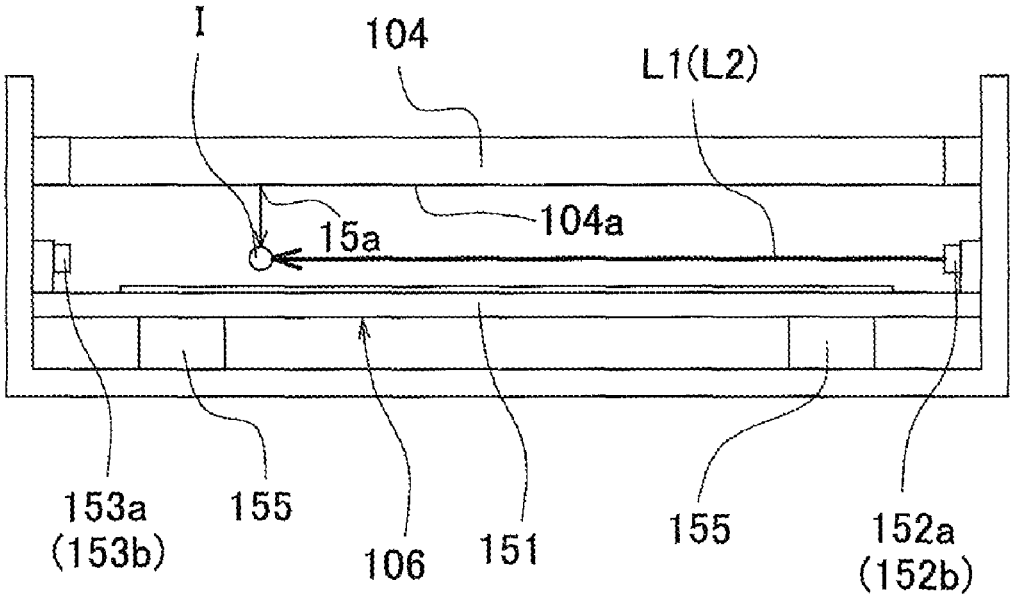
Fig. 26B

LIQUID DROP EJECTION APPARATUS

CROSS REFERENCE TO RELATED APPLICATION

The present application claims priority from Japanese Patent Application No. 2006-265333, filed on Sep. 28, 2006, the disclosure of which is incorporated herein by reference in its entirety.

BACKGROUND OF THE DISCLOSURE

1. Field of the Disclosure

The present application relates to a liquid drop ejection apparatus for ejecting liquid drops from nozzles.

2. Description of the Related Art

There is a known liquid drop ejection apparatus for ejecting liquid drops from nozzles that is configured to detect when liquid drops are not ejected from nozzles, and the fact that the direction of ejected liquid drop is deviated. For example, an ink-jet printer (liquid drop ejection apparatus) may be provided with a laser nozzle check device including a laser source for emitting a laser beam (light beam) and a light receiving element for receiving the laser beam below a line head. In this ink-jet printer, ink drops are ejected from a plurality of nozzles on the line head one by one in sequence. A laser beam is emitted from the laser source, and if the laser beam is not interrupted by an ink drop ejected from a certain nozzle, the laser beam will reach the light receiving element, and non-ejection of ink, or deviation of an ink landing position (deviation in the direction of ejection), in the nozzle is detected.

However, in such an ink-jet printer, the laser beam is interrupted by the ink drops, and the laser beam is not received, even when the direction of ink ejected from the nozzle is deviated in a direction parallel to the direction of the laser beam emission. Therefore, in such a case, the deviation in the direction in ink ejection is not detected.

SUMMARY OF THE DISCLOSURE

Accordingly, it is an object herein to provide a liquid drop ejection apparatus that is able to detect deviation of direction of ejection irrespective of the direction of deviation of the ejection of liquid drops.

A liquid drop ejection apparatus described herein may include a liquid drop ejection head having a plurality of nozzles for ejecting light-reflecting liquid drops and a liquid drop ejection surface on which ejection ports of the plurality of nozzles are arranged; a light detection unit having two light-emitting units arranged on one plane offset from the liquid drop ejection surface in a predetermined first direction when viewed in plan view, and emitting light beams intersecting each other along the one plane, and two light-receiving units arranged on the one plane opposite the two light-emitting units and offset from the ejection ports of the plurality of nozzles in the first direction for receiving light beams emitted by the two light-emitting units respectively; a transfer unit for causing relative movement of the light detection unit and the liquid drop ejection head in a scanning direction orthogonal to the first direction, and a control unit for controlling the liquid drop ejection head and the transfer unit. The control unit may control the liquid drop ejection head to cause the plurality of nozzles to eject liquid drops, and may simultaneously control the transfer unit to cause the light detection unit and the liquid drop ejection head to move relative to each other in the scanning direction.

In this configuration, since the two light-emitting units emit light beams intersect along the one plane, deviations in liquid drop ejection from a certain nozzle can be detected by the detection of light that, during normal operation, would have otherwise been reflected by the liquid drop. Further, the amount of deviation can be detected by moving the light detection unit and the liquid drop ejection head with respect to each other in the scanning direction while causing the nozzle to eject liquid drops, and having two light beams instead of one allows detection of deviation irrespective of the direction of deviation of liquid drop ejection from the nozzle in the one plane.

When the light detection unit and the liquid drop ejection head are moved relative to each other in the scanning direction, the light beams emitted from the two light-emitting units pass through the area opposing (or adjacent to) the ejection ports of the plurality of nozzles. The light detection unit can be positioned such that the light beams intersect where a drop of liquid, such as an ink drops, is normally ejected, and the two light-receiving units do not receive the light beams. In contrast, when the liquid drop is not ejected from the nozzle in question (e.g., a clog in the nozzle), the two light-receiving units will receive light. Therefore, the fact that the liquid drop is not ejected from the nozzle is also detected by moving the light detection unit and the liquid drop ejection head with respect to each other in the scanning direction while causing the nozzles to eject liquid drops.

The control performed by the control unit for controlling the liquid drop ejection head to cause the plurality of nozzles to eject liquid drops and simultaneously controlling the transfer unit for causing the light detection unit and the liquid drop ejection head to move with respect to each other in the scanning direction may include both the control for causing the ejection of the liquid drops from the plurality of nozzles and the relative movement of the light detection unit and the liquid drop ejection head in the scanning direction simultaneously, but also the control for causing the ejection and the relative movement to be performed alternately and repetitively.

The liquid drop ejection apparatus may further include a position detection unit for detecting a position of the light detection unit with respect to the liquid drop ejection head in the scanning direction, and a deviation amount calculating unit for calculating the amounts of deviation in the direction of liquid drop ejection from the plurality of nozzles. The control unit may control the liquid drop ejection head to cause a certain nozzle to eject liquid drops and may simultaneously control the transfer unit to cause the light detection unit and the liquid drop ejection head to move with respect to each other in the scanning direction. The position detection unit may detect the position of the light detection unit with respect to the liquid drop ejection head when the two light-receiving units do not receive their respective light beams any longer, and the deviation amount calculating unit may calculate the amount of deviation in the direction of liquid drop ejection at the nozzle. This may be done by comparing positions of ink drop detection (e.g., positions where light is not received) during current operation with positions observed during normal operation.

In this configuration, the amount of deviation of a certain nozzle can be detected accurately from the amount of deviation between the positions of the light detection unit during normal operation and the positions at which liquid drops are currently detected.

The control performed by the control unit for controlling the liquid drop ejection head for causing a certain nozzle to eject liquid drops and simultaneously controlling the transfer unit for causing the light detection unit and the liquid drop ejection head to move with respect to each other in the scanning direction may include both the control for causing the ejection of the ink drops from a certain nozzle and the relative movement of the light detection unit and the liquid drop ejection head in the scanning direction to be performed simultaneously, but also the control for causing the ejection and the relative movement to be performed alternately and repetitively.

The liquid drop ejection apparatus may further include a deviation determination unit for determining whether deviation occurs in the direction of liquid drops ejected from the plurality of nozzles. The control unit may control the liquid drop ejection head to cause a certain nozzle to eject liquid drops when the light detection unit is positioned such that the light beams intersect at a point through which a liquid drop from the certain nozzle would pass under normal conditions (thereby reflecting both beams), and the deviation determination unit determines that the direction of liquid drop ejection from a certain nozzle is deviated when the two light receiving units receive light beams respectively when the light detection unit is placed at that position during use. When there is deviation, the deviation amount calculating unit may calculate the amount of deviation just for the nozzle determined to be deviated in the direction of liquid drop ejection by the deviation determination unit.

In this configuration, since liquid drop ejection direction deviation can be determined easily by the deviation determination unit, the amount of deviation in the direction of liquid drop ejection from the nozzle is calculated in a short time by determining whether or not there are any nozzles whose direction of the liquid drop ejection is deviated and then detecting the amount of deviation only for the nozzles determined to be deviated in the direction of liquid drop ejection.

The two light-emitting units and the two light-receiving units may be arranged in such a manner that light beams emitted by the two light-emitting units only ever intersect one nozzle at a time as the light detection unit is moved relative to the ejection head, when viewed in the direction orthogonal to the plane of the nozzles.

Allowing a light beam to intersect two drops during normal operation would make it difficult to isolate the deviation. If the light beam emitted from the light-emitting unit only intersects one nozzle at a time (as described above), deviation detection for all the nozzles can be done in a short time by moving the light detection unit and the liquid drop ejection head relative to each other only once in the scanning direction while causing all the nozzles to eject liquid drops, or by moving the light detection unit and the liquid drop ejection head relative to each other in the scanning direction only once and causing the corresponding nozzles to eject liquid drops in sequence with this movement.

The liquid drop ejection apparatus may also include an abnormal determination unit for determining whether or not an abnormality in liquid drop ejection exists for the plurality of nozzles, and a reference amount storage unit for storing a predetermined reference amount, where the abnormal determination unit determines that abnormality in liquid drop ejection exists at a certain nozzle when the amount of deviation in the direction of liquid drop ejection from that nozzle exceeds the reference amount.

In this configuration, the abnormal determination unit determines that abnormality in liquid drop ejection occurs at a nozzle only when the amount of deviation in the direction of liquid drop ejection exceeds the reference amount. Therefore, by setting the reference amount as needed, the abnormality in liquid drop ejection is detected only when the amount of deviation in the direction of liquid drop ejection is increased as much as the deviation in the direction of liquid drop ejection causes a problem. The predetermined reference amount may be set to a maximum permissible amount of deviation in the direction of liquid drop ejection.

The reference amount storage unit may store the reference amounts for two orthogonal directions on the one plane, and the abnormal determination unit can determine that the abnormality in liquid drop ejection exists at a certain nozzle when the amount of deviation in the direction of liquid drop ejected from the nozzle in at least one of the two directions calculated by the deviation amount calculating unit exceeds the reference amount in that corresponding direction. In this configuration, abnormality in liquid drop ejection at the nozzle is determined with high degree of accuracy.

The liquid drop ejection apparatus may further include an ejected medium carrier unit for carrying an ejected medium (e.g., paper) that is to receive liquid drops ejected by the liquid drop ejection head to a position opposite a liquid drop ejection surface in a direction parallel to the liquid drop ejection surface. As the medium reaches its position, the liquid drop ejection head ejects liquid drops while moving in a direction parallel to the liquid drop ejection surface and orthogonal to the direction in which the medium carrier unit moves the medium. The reference amount storage unit may store the reference amount in terms of these two orthogonal directions.

In this configuration, the liquid drop ejection head can be moved in a direction that is orthogonal to the direction that the medium (e.g., paper) is carried, and deviation can be detected as this movement occurs.

In some embodiments, the reference amount in the direction in which the medium carrier unit carries the medium can be set smaller than the reference amount in the scanning direction.

In some embodiments, deviation in one direction has a greater adverse effect than deviation in the other direction. For example, deviation in the direction that the medium is carried may cause a blank streak across the medium, significantly affecting readability. Deviation in the orthogonal direction, or the direction of scanning, might not cause a blank streak, and might not have as great an effect on readability. Therefore, by setting the reference amount for one direction (e.g., the direction in which the medium is carried) to a value smaller than the reference amount in an orthogonal direction (e.g., the scanning direction), the maintenance operation is performed only when a significant risk to the image quality is detected, and the maintenance operation can be performed efficiently.

In the discussion above, the liquid ejection head and light detection unit move in parallel directions. In this configuration, the liquid drop ejection apparatus can be downsized.

The liquid drop ejection apparatus according to an alternative embodiment includes an ejected medium carrier unit for carrying an ejected medium to be ejected with liquid drops by the liquid drop ejection head to a position opposed to a liquid drop ejection surface in a direction parallel to the liquid drop ejection surface, and the liquid drop ejection head ejects liquid drops to the ejected medium while the head is in a resting state. For example, the ejection head may be a stationary line head. The reference amount storage unit may store the reference amount in terms of the medium carrying direction and an orthogonal direction (e.g., the lateral direction of the ejection head).

In this configuration, deviation in the direction of liquid drop ejection is detected with the liquid drop ejection apparatus of a type in which the liquid drop is ejected in the state of resting the liquid drop ejection head.

In this configuration, the reference amount in the lateral direction may be smaller than the reference amount in the direction in which the medium is carried.

In this configuration, in which the liquid drop ejection head ejects liquid while it is in the resting state, when the direction of liquid drop ejection from the nozzle is deviated in the lateral direction, a blank streak may extend continuously on the medium in the direction in which it was carried by the medium carrier unit, which deteriorates the image quality. On the other hand, when the direction of liquid drop ejection from the nozzle is deviated in the medium carrying direction, the streak of area is not formed, and hence adverse effects on the image quality are small. Therefore, different amounts of deviation are tolerated in different directions, depending on the effect of the deviation on overall image quality. In the instant example, more deviation may be allowed in the medium carrying direction than in the lateral direction.

BRIEF DESCRIPTION OF THE DRAWINGS

FIG. 26A is a cross-sectional view taken along the line E-E in FIG. 25;

FIG. 26B is a drawing showing a state in which a laser beam is interrupted by an ink drop in FIG. 26A;

DETAILED DESCRIPTION

First Embodiment

A first embodiment of the invention will be described below. The first embodiment is an example applied to an ink-jet printer that ejects ink drops from nozzles.

Figure 1A:
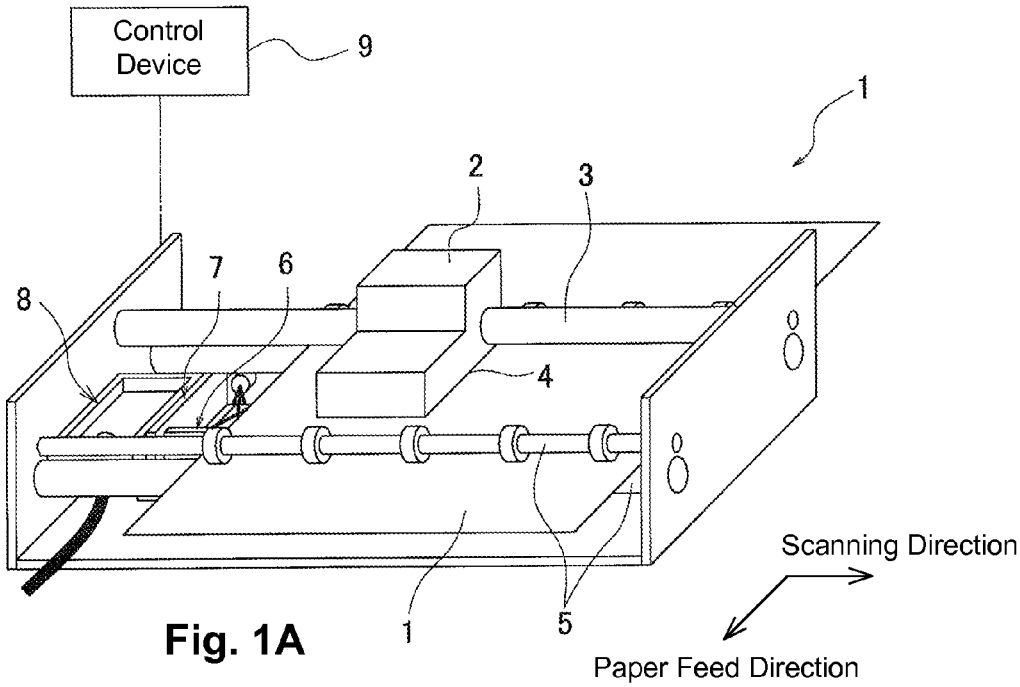
FIG. 1A is a schematic perspective view of an ink-jet printer according to a first embodiment.
Figure 1B:
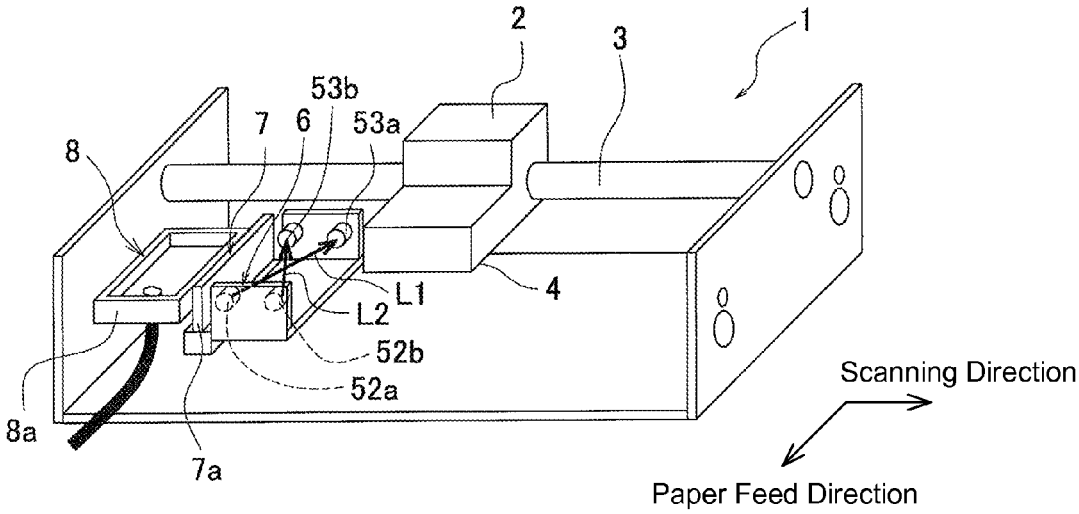
FIG. 1B is a drawing corresponding to FIG. 1A in a state in which some members are removed.
Figure 2:
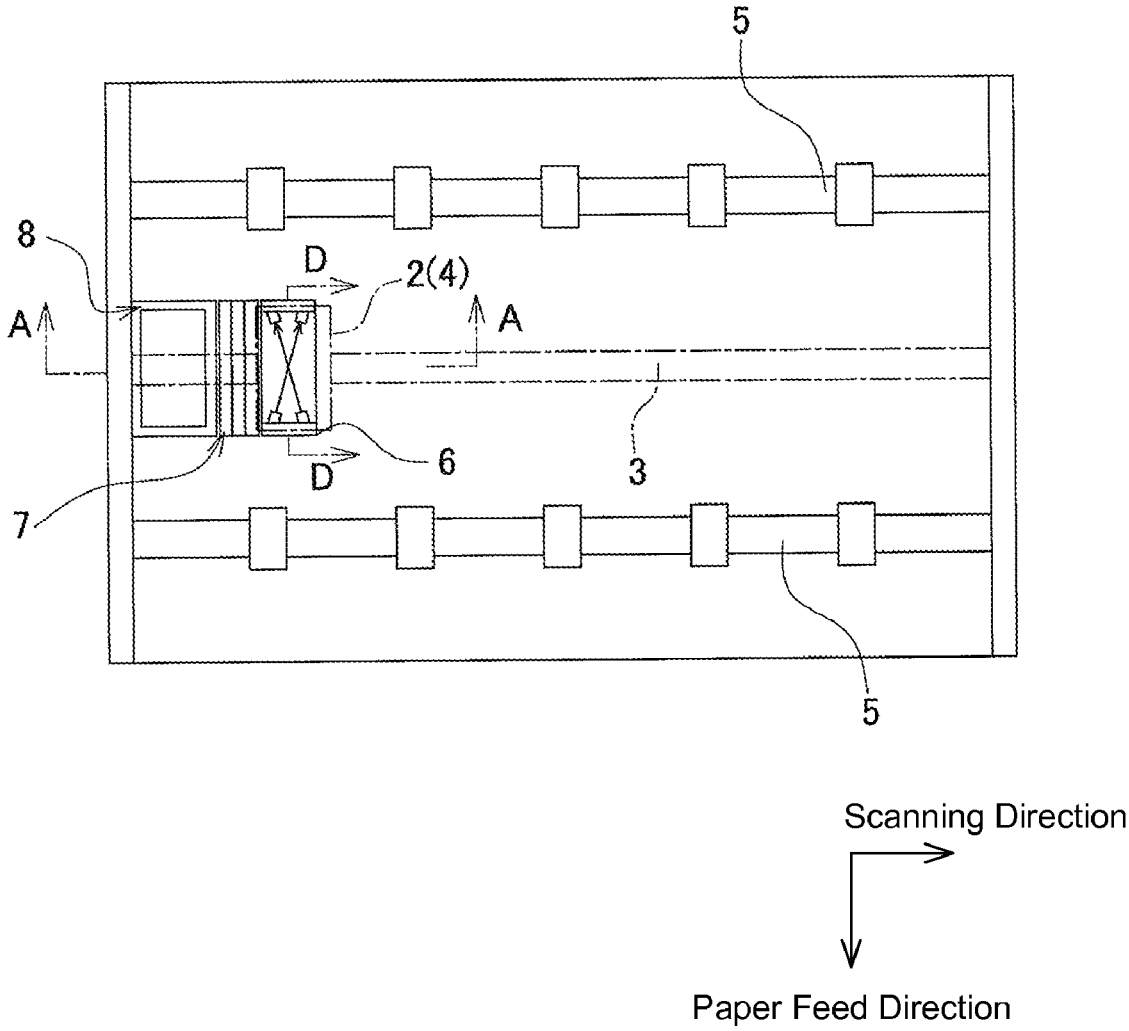
FIG. 2 is a plan view of FIG. 1.
Figure 3:
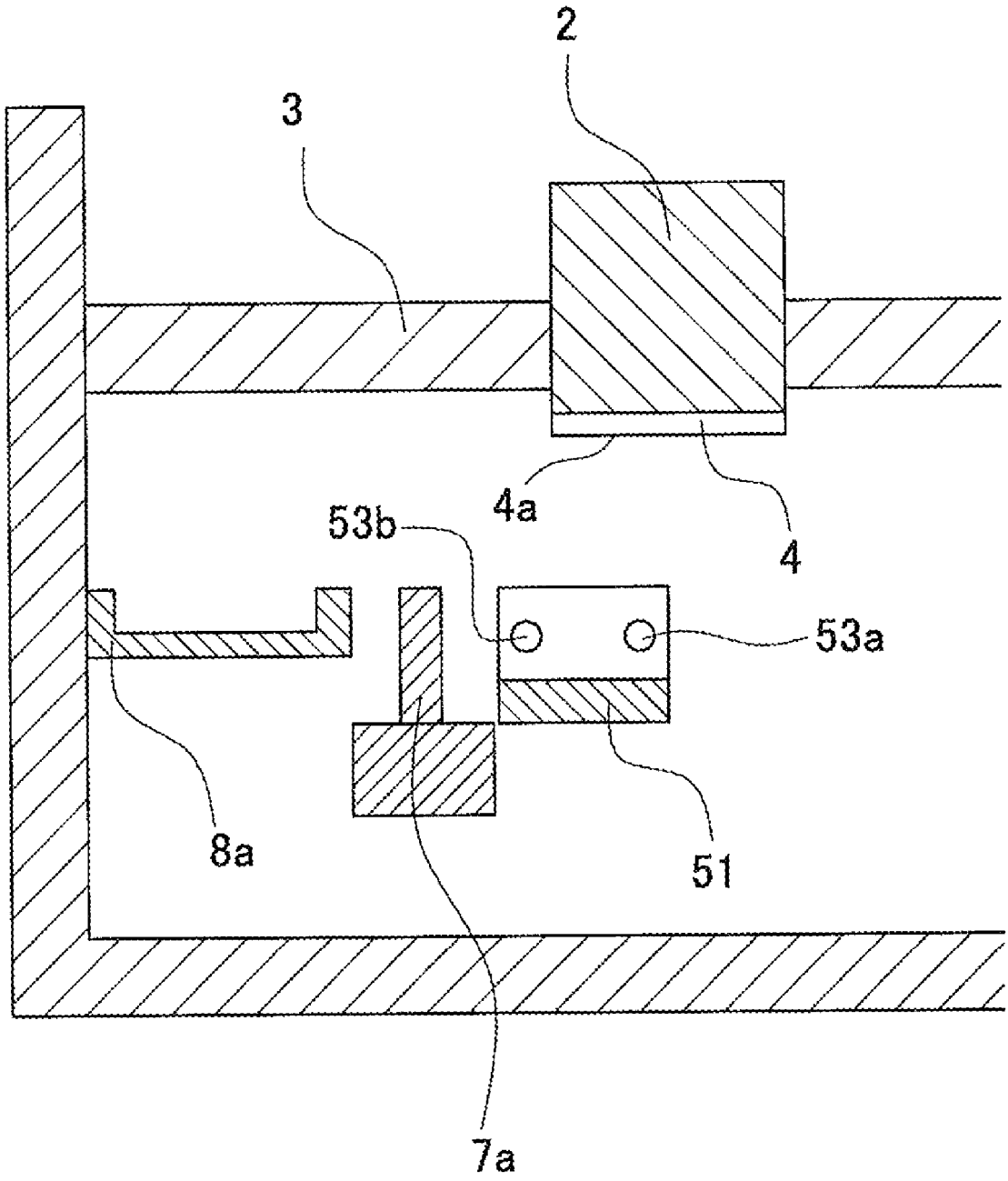
FIG. 3 is a cross-sectional view taken along the line A-A in FIG. 2.

FIG. 1A is a schematic perspective view of an ink-jet printer 1 according to the first embodiment, and FIG. 1B is a drawing corresponding to FIG. 1A in a state in which a recording paper P, a carrier roller 5 and a control device 9 are removed. FIG. 2 is a plan view of FIG. 1. FIG. 3 is a cross-sectional view taken along the line A-A in FIG. 2. As shown in FIG. 1 to FIG. 3, the ink-jet printer 1 may include a carriage 2 (transfer unit), a guide shaft 3, an ink-jet head 4 (liquid drop ejection head), the carrier roller 5 (ejected medium carrier unit), a light detection device 6, a wiping unit 7, a purge unit 8, and the control device 9.

The carriage 2 may be fixed to the guide shaft 3 extending in the lateral direction in FIG. 1 (also referred to below as the scanning direction) so as to be capable of moving freely along the shaft. The ink-jet head 4 may be a serial head provided on the lower surface of the carriage 2, and may be adapted to eject light-reflecting ink drops (liquid drops) downward from ejection ports 15*a* (see FIG. 6) of nozzles 15 (see FIG. 4) provided on an ink ejection surface 4*a* (liquid drop ejection surface, see FIG. 6) which corresponds to the lower surface of the carriage 2. The carrier roller 5 carries the recording paper P (ejected medium) in the direction toward the near side in FIG. 1 (referred to below as the paper feed direction) at a position opposing the ink ejection surface 4*a*. In the ink-jet printer 1, the ink-jet head 4 is reciprocated in the scanning direction by moving the carriage 2 along the guide shaft 3, while the ink drops are ejected from the nozzles 15, so that printing on the recording paper P carried in the paper feed direction by the carrier roller 5 is achieved.

The light detection device 6 may be arranged at a position opposing the ink ejection surface 4*a* near the left end portion of the ink-jet printer 1, as shown in FIG. 1. When the ink-jet head 4 is moved in the scanning direction together with the carriage 2, the ink-jet head 4 and the light detection device 6 may also move in the scanning direction relative to each other. The light detection device 6 will be described in detail later.

The wiping unit 7, illustrated on the left of the light detection device 6, is configured to move in the vertical direction, and brings the distal end of a wiper 7*a* arranged on the upper portion thereof into abutment with the ink ejection surface 4*a* (see FIG. 6) of the ink-jet head 4 which moves in the scanning direction, so that the ink attached to the ink ejection surface 4*a* is removed. The purge unit 8 is illustrated on the left of the wiping unit 7, and has a purge cap 8*a* configured to move in the vertical direction. The purge unit 8 performs purge to suck ink from a plurality of the nozzles 15 by bringing the purge cap 8*a* into abutment with the ink ejection surface 4*a* so as to cover the ejection port 15*a* of all the nozzles 15, and depressurizing a space surrounded by the ink ejection surface 4*a* and the purge cap 8*a* by a pump or the like (not shown).

Figure 4:
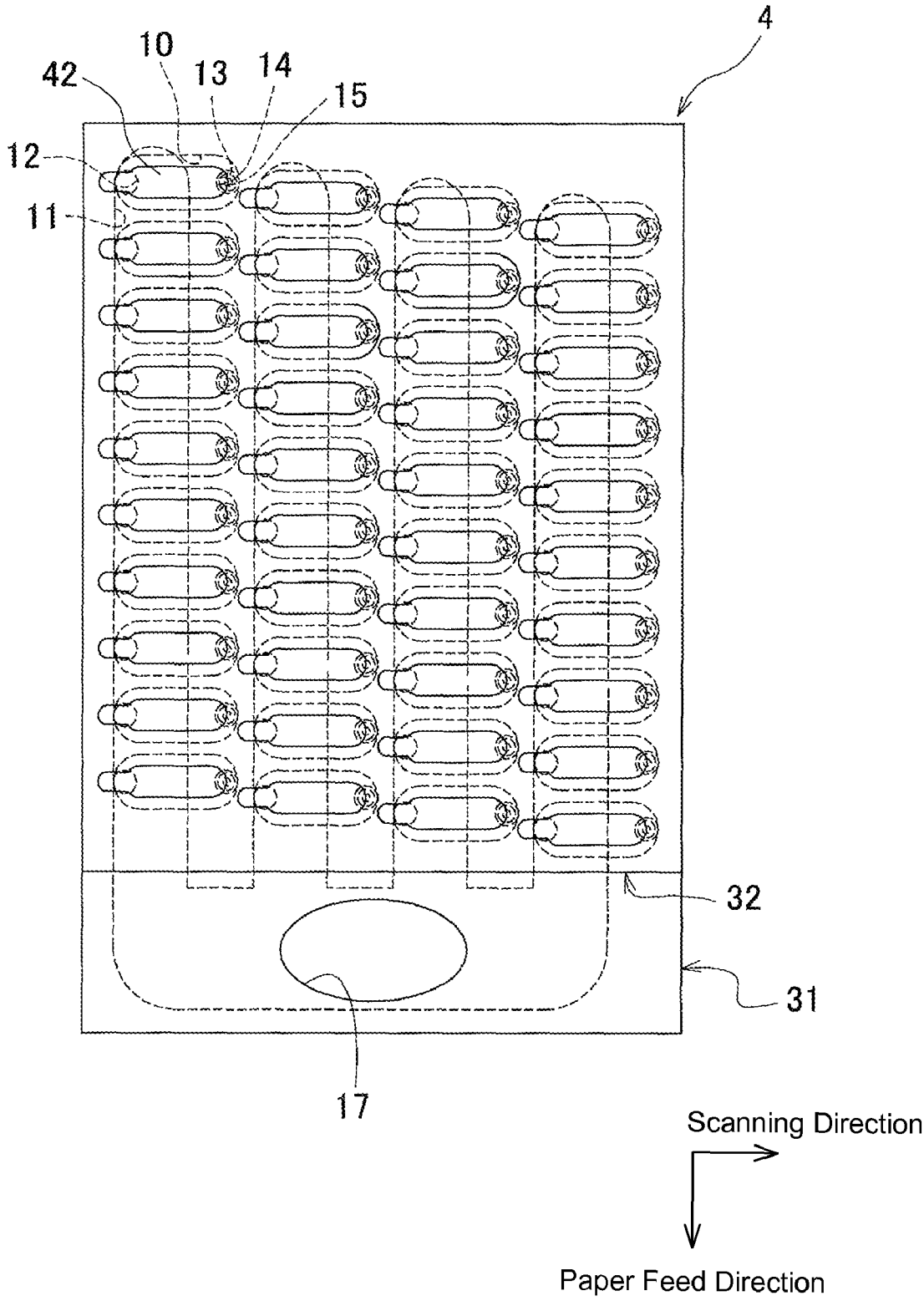
FIG. 4 is a plan view of an ink-jet head shown in FIG. 1 to FIG. 3.
Figure 5:
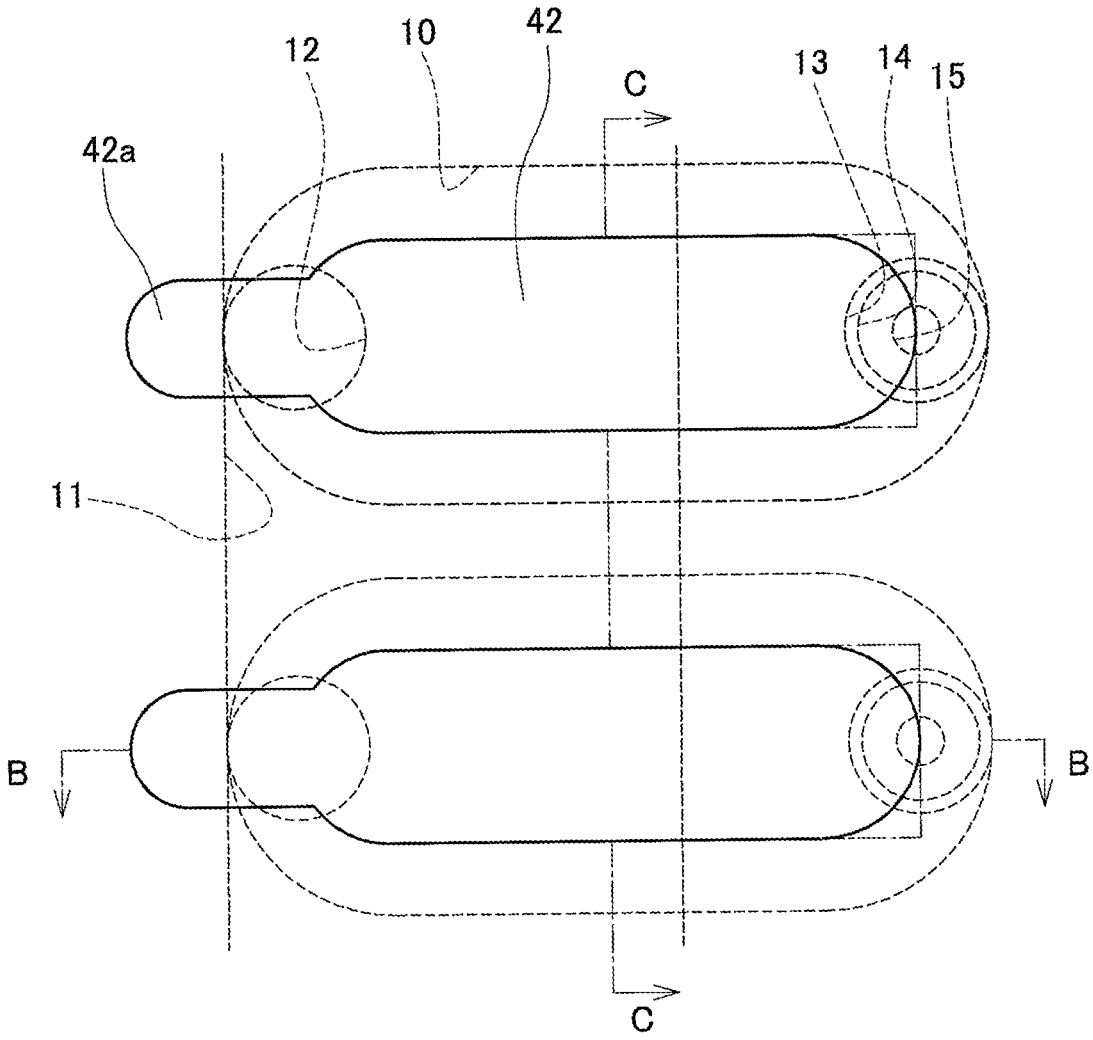
FIG. 5 is a partially enlarged view of FIG. 4.
Figure 6:
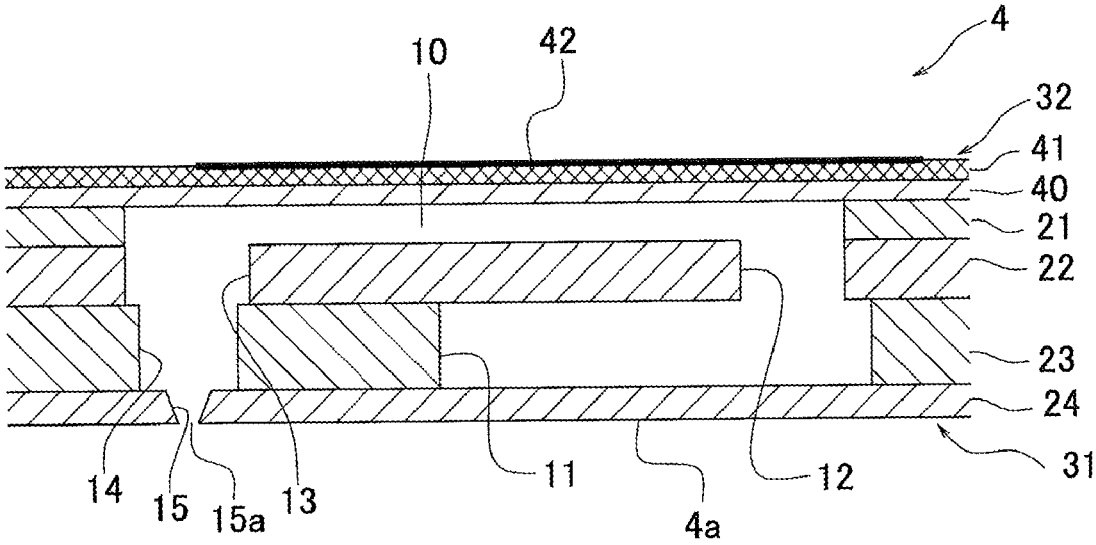
FIG. 6 is a cross-sectional view taken along the line B-B in FIG. 5.
Figure 7:
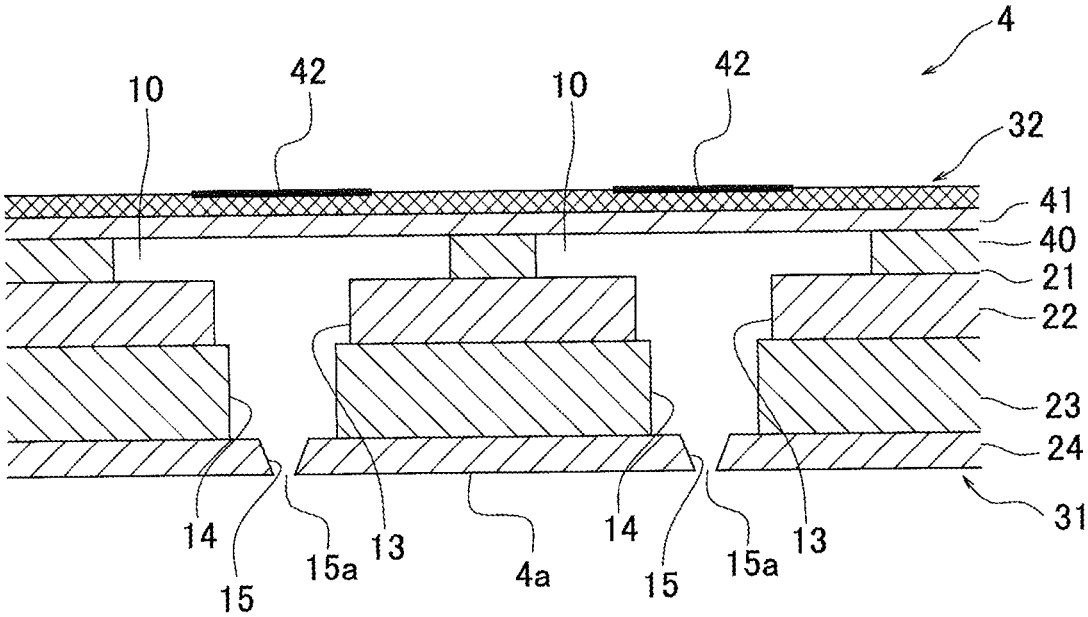
FIG. 7 is a cross-sectional view taken along the line C-C in FIG. 5.

Referring now to FIG. 4 to FIG. 7, the ink-jet head 4 will be described. FIG. 4 is a plan view of the ink-jet head 4 shown in FIG. 1 to FIG. 3. FIG. 5 is a partially enlarged view of FIG. 4. FIG. 6 is a cross-sectional view taken along the line B-B in FIG. 5. FIG. 7 is a cross-sectional view taken along the line C-C in FIG. 5. As shown in FIG. 4 to FIG. 7, the ink-jet head 4 includes a flow channel unit 31 having ink channels such as pressure chambers 10, a manifold flow channel 11, and a piezoelectric actuator 32 arranged on its upper surface.

The flow channel unit 31 may be configured with four laminated plates: a cavity plate 21, a base plate 22, a manifold plate 23, and a nozzle plate 24. The three plates 21 to 23 may be formed of metal material such as stainless steel, and the nozzle plate 24 may be formed of a synthetic resin material such as polyimide. The nozzle plate 24 may also be formed of metal material like the other three plates 21 to 23.

The cavity plate 21 may be formed with a plurality of the pressure chambers 10. The illustrated plurality of pressure chambers 10 each have substantially an oval shape in plan view elongated in the scanning direction (lateral direction in FIG. 4), and are arranged in four rows in the scanning direction, ten each in the paper feed direction (vertical direction in FIG. 4).

The base plate 22 may be formed with a plurality of through holes 12 at positions overlapped with one longitudinal end (left side in FIG. 4) of the plurality of pressure chambers 10 when viewed in plan view. The base plate 22 may also be formed with a plurality of through holes 13 at positions overlapped with the other longitudinal end (right side in FIG. 4) of the plurality of pressure chambers 10 when viewed in plan view.

The manifold plate 23 may be formed with the manifold flow channel 11 extending over the ten pressure chambers 10 arranged in the paper feed direction corresponding to the plurality of pressure chambers 10 arranged in four rows. The manifold flow channel 11 is illustrated overlapped with substantially the left halves of the pressure chambers 10 in FIG. 4 when viewed in plan view, and is connected with the pressure chambers 10 via the through holes 12. The manifold flow channel 11 receives a supply of ink from an ink supply channel 17 formed on a diaphragm 40, described later. The manifold plate 23 may be formed with a plurality of through holes 14 at positions overlapped with the through holes 13 when viewed in plan view of FIG. 4, and as illustrated in FIG. 6.

The nozzle plate 24 may be formed with the plurality of nozzles 15 at positions overlapped with the plurality of through holes 14 when viewed in plan view of FIG. 4, and the lower surface of the nozzle plate 24 corresponds to the ink ejection surface 4*a* having the ejection ports 15*a* of the nozzles 15. In the flow channel unit 31, the manifold channel 11 communicates with the pressure chambers 10 via the though holes 12, and the pressure chambers 10 communicate with the nozzles 15 through the through holes 13 and 14. In this manner, the flow channel unit 31 is formed with a plurality of individual ink flow channels extending from the exits of the manifold flow channel 11 through the pressure chamber 10 to the nozzles 15.

The piezoelectric actuator 32 may include the diaphragm 40, a piezoelectric layer 41, and individual electrodes 42. The diaphragm 40 may be formed of metallic material, arranged so as to cover the plurality of pressure chambers 10 on the upper surface of the flow channel unit 31, and joined to the upper surface of the cavity plate 21. The diaphragm 40 may be formed of metal material having conductivity and maintained at a ground potential.

The piezoelectric layer 41 may be a solid solution including titanic acid and zirconic acid, and may be formed of a piezoelectric material containing lead zirconium titanate (PZT) having ferroelectricity as a main component. The piezoelectric layer 41 may be formed on the upper surface of the diaphragm 40 continuously across the portions which are overlapped with the plurality of pressure chambers 10 when viewed in plan view. The piezoelectric layer 41 may be polarized in the direction of thickness thereof in advance.

The individual electrodes 42, being formed of conductive material such as metal, may have a substantially oval shape that is elongated in the scanning direction and slightly smaller than the pressure chambers 10 when viewed in plan view, and may overlap substantially the center portions of the pressure chambers 10 when viewed in plan view. One end (left side in FIG. 4) of the individual electrode 42 extends leftward to a portion which does not oppose the pressure chamber 10 in plan view, and this extended portion corresponds to a contact point 42*a*. The contact point 42*a* may be connected to a driver IC 50 (see FIG. 11) via a flexible printed board (FPC), not shown, and a plurality of the individual electrodes 42 may be provided with driving potentials individually from the driver IC 50.

The operation of the piezoelectric actuator 32 will now be described. In the piezoelectric actuator 32, the individual electrodes 42 are held in a ground potential in advance. When the driving potential is provided to the individual electrodes 42 from the driver IC 50, the difference in potential is generated between the individual electrodes 42 provided with the driving potential and the diaphragm 40 maintained at the ground potential, and an electric field in the direction of thickness is generated in portions of the piezoelectric layer 41 interposed between the individual electrodes 42 and the diaphragm 40. The direction of this electric field is parallel to the direction of polarization of the piezoelectric layer 41, and hence these portions of the piezoelectric layer 41 shrink in the horizontal direction, which is orthogonal to the direction of the thickness. In association with this, portions of the diaphragm 40 opposing the corresponding pressure chambers 10 may be deformed to project into the pressure chambers 10. Accordingly, the volume of the pressure chambers 10 is reduced, the pressure applied to ink in the corresponding pressure chambers 10 increases, and ink drops are ejected from the nozzles 15 that communicate with these pressure chambers 10.

Figure 8:
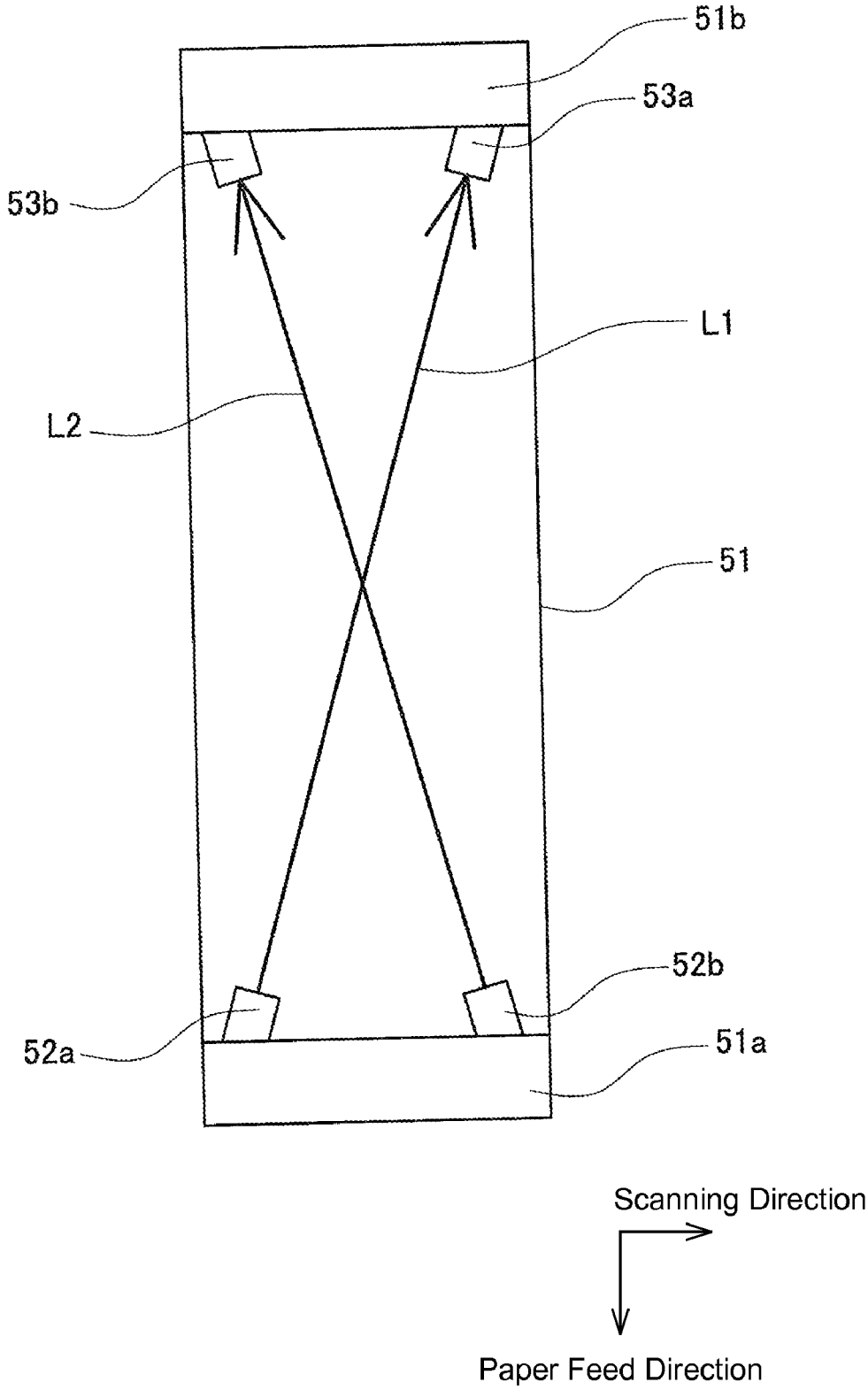
FIG. 8 is a plan view of a light detection device.
Figure 9B:
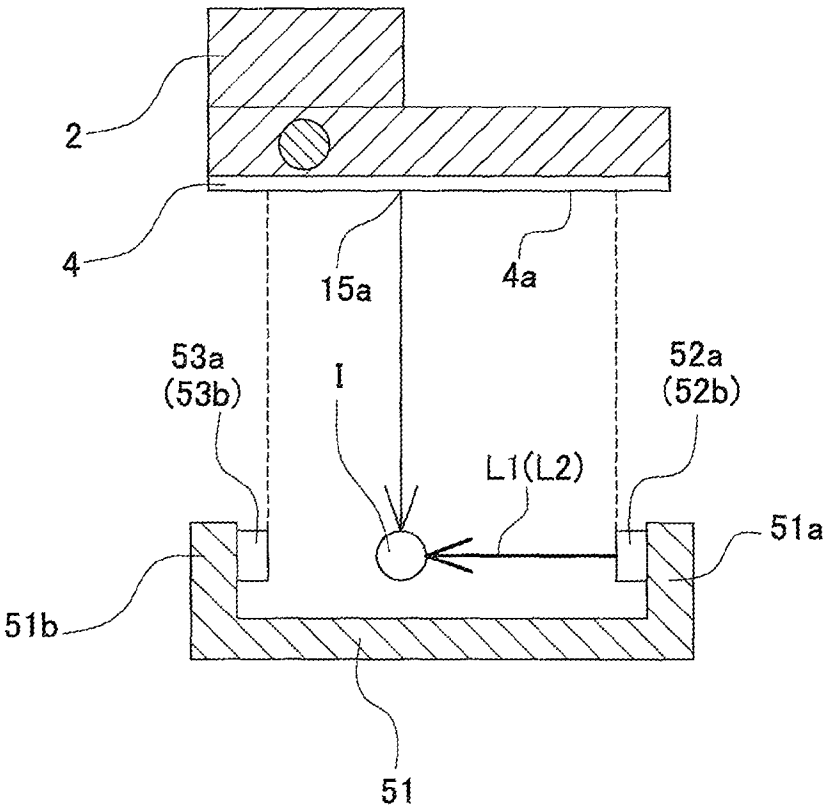
FIG. 9B illustrates a state in which laser beams are interrupted by ink drops in FIG. 9A.
Figure 9A:
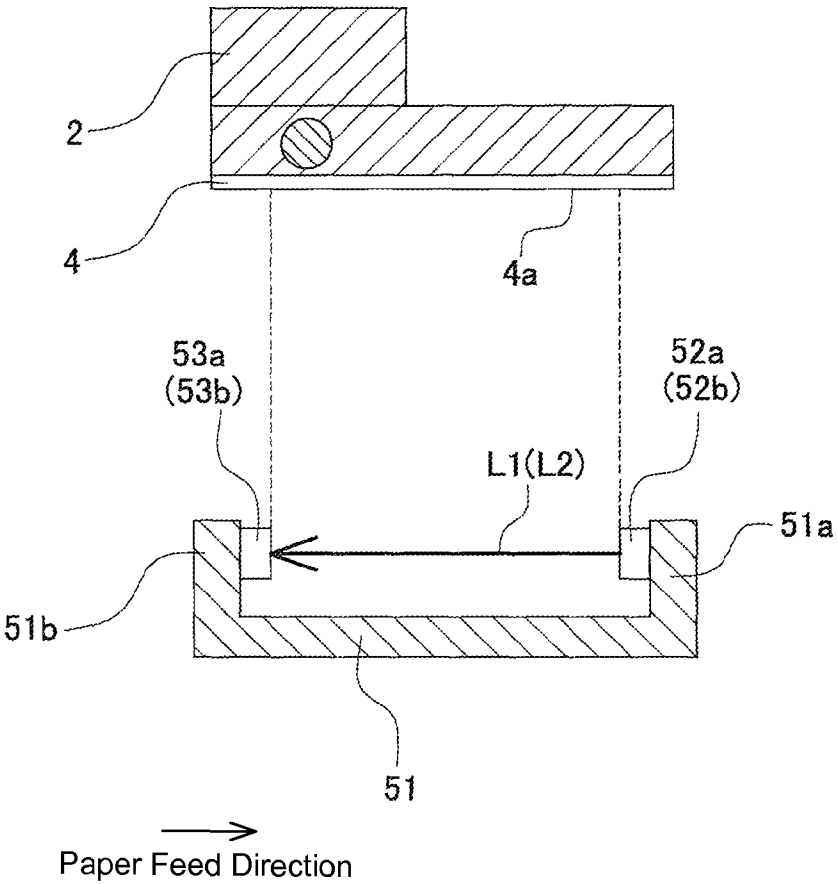
FIG. 9A is a cross-sectional view taken along the line D-D in FIG. 2.
Figure 10:
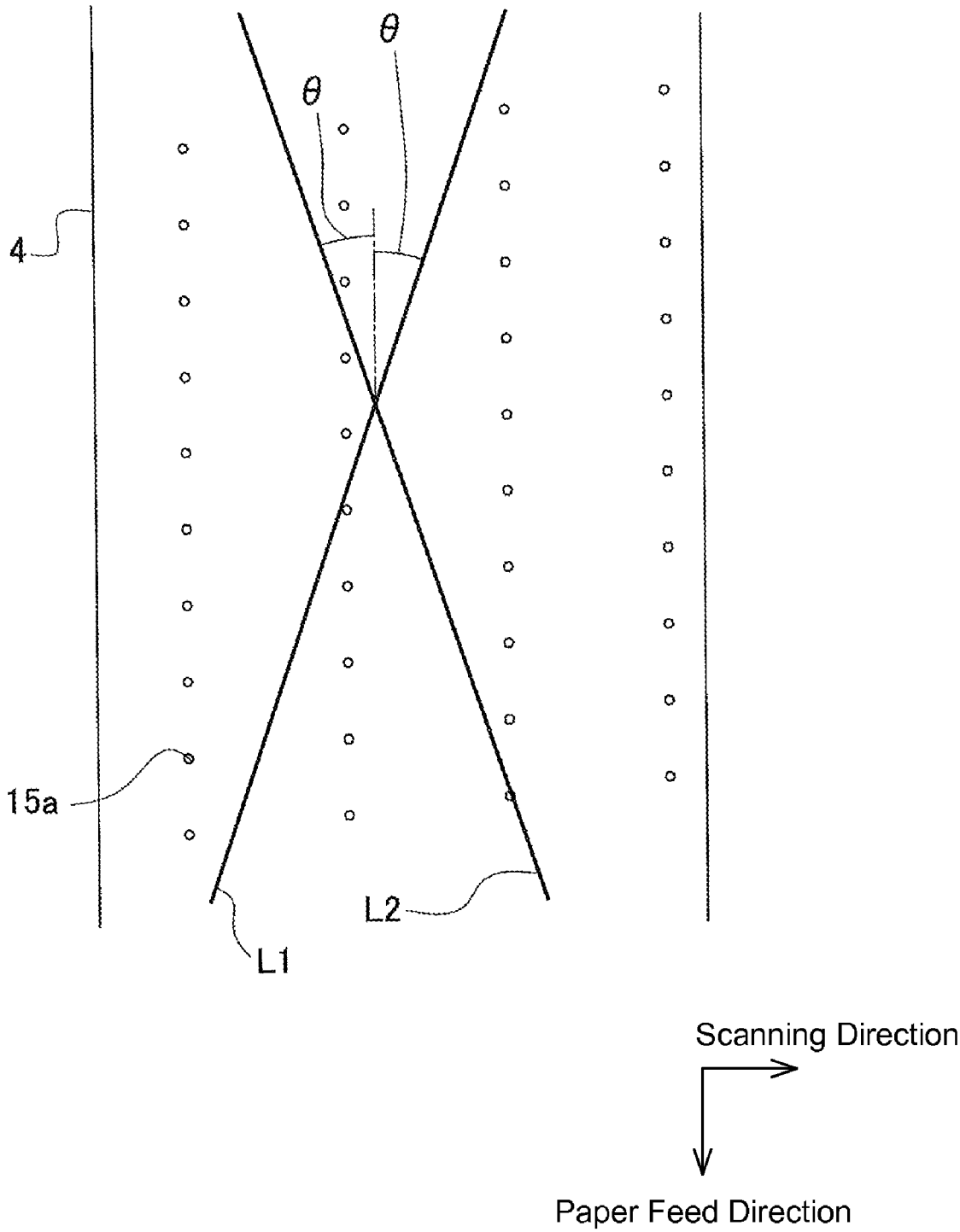
FIG. 10 illustrates the positional relationship between the laser beams emitted from the laser sources of the light detection device and the ejection ports of the nozzles.

Referring now to FIG. 8 to FIG. 10, the light detection device 6 will be described. FIG. 8 is a plan view of the light detection device 6 shown in FIG. 1 to FIG. 3. FIG. 9A is a cross-sectional view taken along the line D-D in FIG. 2, and FIG. 9B illustrates a state in which laser beams L1 and L2 are interrupted by the ink drops in FIG. 9A. FIG. 10 illustrates the positional relationship between a plurality of the ejection ports 15*a* and the laser beams L1 and L2 emitted from laser sources 52*a* and 52*b*.

As shown in FIG. 8 and FIG. 9, the light detection device 6 includes a base member 51, the two laser sources 52*a* and 52*b*, and the two light receiving elements 53*a* and 53*b*. The base member 51 may be formed substantially into a rectangular shape elongated in the paper feed direction (the vertical direction in FIG. 8) when viewed in plan view, and formed with projections 51*a* and 51*b* projecting upward in FIG. 9 at the upper end and the lower end in the paper feed direction.

The two laser sources 52*a* and 52*b* may be fixed to the inner side surface of the projection 51*a* near the left end and the right end in FIG. 8 respectively, and the two light receiving elements 53*a* and 53*b* may be fixed to the inner side surface of the projection 51*b* near the right end and the left end in FIG. 8 respectively. All the ejection ports 15*a* may be positioned between the two laser sources 52*a* and 52*b* and the two light receiving elements 53*a* and 53*b* (between the two dotted lines in FIG. 9) in the paper feed direction. In other words, the laser sources 52*a* and 52*b* may be placed to the right of the rightmost nozzle 15, and light receiving elements 53*a* and 53*b* may be placed to the left of the leftmost nozzle 15, when viewed as in FIG. 9A.

The laser source 52*a* emits the laser beam L1 toward the light receiving element 53*a*, and the laser source 52*b* emits the laser beam L2 toward the light receiving element 53*b* (they emit the laser beams L1 and L2 along the one plane). As shown in FIG. 9A, when an ink drop is not positioned between the laser source 52*a* and the light receiving element 53*b*, the laser beam emitted from the laser source 52*a* reaches the light receiving element 53*a*, and when the ink drop is not positioned between the laser source 52*a* and the light receiving element 53*b*, the laser beam emitted from the laser source 52*b* reaches the light receiving element 53*b*. On the other hand, as shown in FIG. 9B, when an ink drop I is positioned between the laser sources 52*a* and the light receiving element 53*a*, the light beam emitted from the laser source 52*a* is interrupted by this ink drop and hence does not reach the light receiving element 53*a*, and when the ink drop I is positioned between the laser source 52*b* and the light receiving element 53*b*, the light beam emitted from the laser source 52*b* is interrupted by the ink drop and does not reach the light receiving element 53*b*.

The two laser beams L1 and L2 are emitted at an angle θ with respect to the paper feed direction as shown in FIG. 10, and intersect with each other. The angle θ in this case is any angle that allows each of laser beams L1 and L2 to only overlap one ejection port 15*a* at a time as the ink-jet head 4 moves in the scanning direction with the carriage 2.

Figure 11:
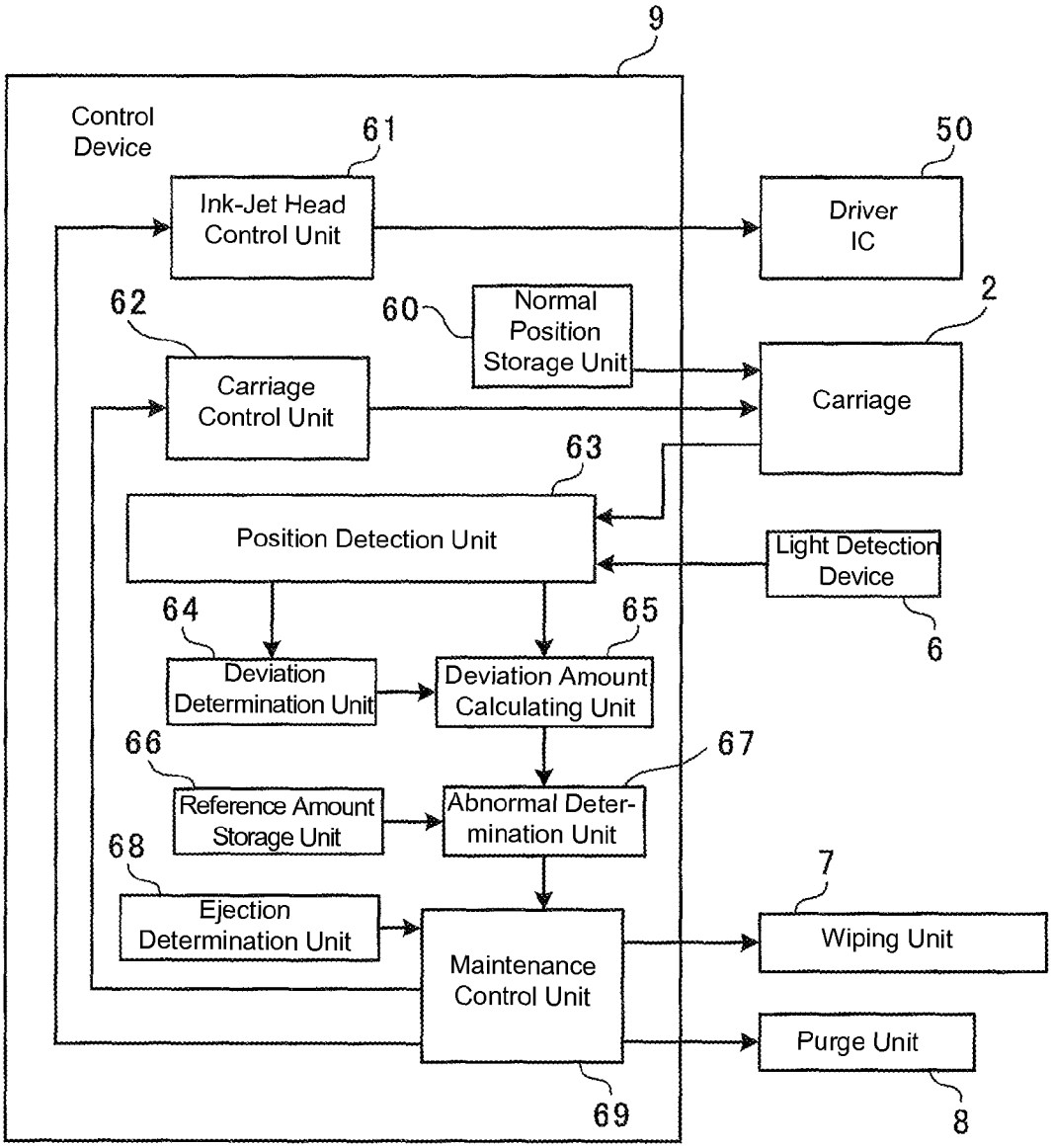
FIG. 11 is a block diagram of a control device in FIG. 1.

Referring now to FIG. 11, the control device 9 for controlling the operation of the ink-jet printer 1 will be described. FIG. 11 is a functional block diagram of the control device 9 in FIG. 1. The control device 9 may include a CPU (Central Processing Unit), a ROM (Read Only Memory), a RAM (Random Access Memory) and these members act as the respective parts shown in FIG. 11.

As shown in FIG. 11, the control device 9 may include a normal position storage unit 60, an ink-jet head control unit 61, a carriage control unit 62, a position detection unit 63, a deviation determination unit 64, a deviation amount calculating unit 65, a reference amount storage unit 66, an abnormal determination unit 67, an ejection determination unit 68, and a maintenance control unit 69.

The normal position storage unit 60 stores the positions of the carriage 2 at which laser beams L1 and L2 intersect ink from a certain nozzle 15 during normal operation. The ink-jet head control unit 61 controls the operation of the ink-jet head 4 by controlling the driver IC 50. The carriage control unit 62 controls the operation of the carriage 2. The position detection unit 63 detects the position of the carriage 2 in the scanning direction (and the direction of the light detection device 6 with respect to the ink-jet head 4 in the scanning direction).

The deviation determination unit 64 determines whether deviation in the direction of ink drop ejection from the nozzles 15 has occurred in the ink-jet head 4. The deviation amount calculating unit 65 calculates the amount of deviation, in the scanning direction and the paper feed direction, from the position of the carriage 2 obtained by the position detection unit 63. The reference amount storage unit 66 stores reference amounts that are the maximum permissible amounts of deviation in the direction of ink ejection in terms of the scanning direction and the paper feed direction individually.

Figure 12A:
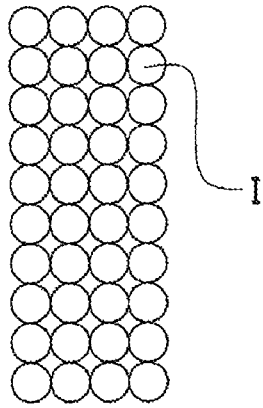
FIG. 12A illustrates landing positions of ink drops when the ink drops are normally ejected.
Figure 12B:
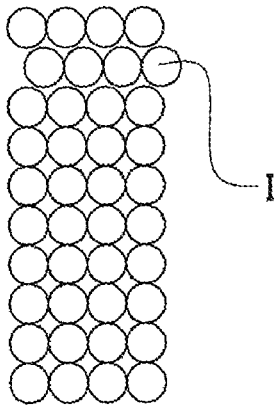
FIG. 12B illustrates landing positions of the ink drops when the direction of ink drop ejection is deviated in the scanning direction.
Figure 12C:
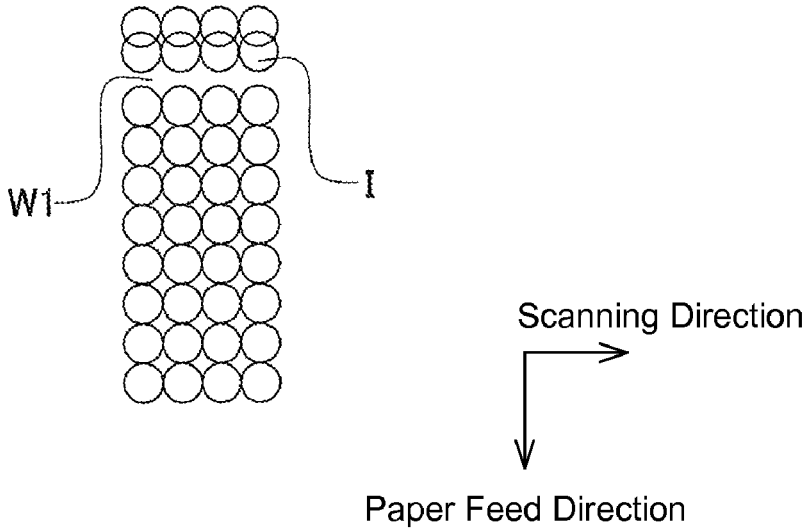
FIG. 12C illustrates landing positions of the ink drops when the direction of ink drop ejection is deviated in the paper feed direction.

FIG. 12A illustrates landing positions of the ink drops I on the recording paper P when the ink drops are normally ejected from the ten nozzles 15 that belong to one row of the four rows of nozzles 15 in FIG. 2. FIG. 12B illustrates landing positions of the ink drops I on the recording paper P when the direction of ink drop ejection from the nozzle 15 at the second from the top in FIG. 2 is deviated in the scanning direction (rightward in FIGS. 12A to 12C). FIG. 12C illustrates landing positions of the ink drops I on the recording paper P when the direction of ink drop ejection from the nozzle 15 at the second from the top in FIG. 2 is deviated in the paper feed direction (upward in FIG. 12). As shown in FIG. 12B, when the direction of ejection of ink drops I is deviated in the scanning direction, lowering of the print quality may be relatively small as long as the amount of deviation is small. However, as shown in FIG. 12C, when the direction of ejection of ink drops I is deviated in the paper feed direction, the extent of lowering of the print quality is significant since a streak of area W1 to which no ink is ejected extends continuously in the scanning direction even though the amount of deviation is small. Therefore, in order to prevent the print quality from lowering, the reference amount in the paper feed direction stored in the reference amount storage unit 66 may be smaller than the reference amount in the scanning direction. In other words, greater deviation may be permitted in one direction as compared to the other.

Referring back to FIG. 11, the abnormal determination unit 67 determines whether abnormality in direction of ink drop ejection exists at the nozzles 15. More specifically, it is determined that abnormality exists when at least one of the amounts of deviation in terms of the scanning direction and the paper feed direction calculated in the deviation amount calculating unit 65 is larger than the reference amounts in terms of the respective directions stored in the reference amount storage unit 66.

The ejection determination unit 68 determines whether the ink drops are ejected from the nozzles 15. The maintenance control unit 69 controls the vertical movement of the wiping unit 7, the vertical movement of the purge cap 8*a*, and the pump, not shown, connected to the purge cap 8*a*.

Figure 13:
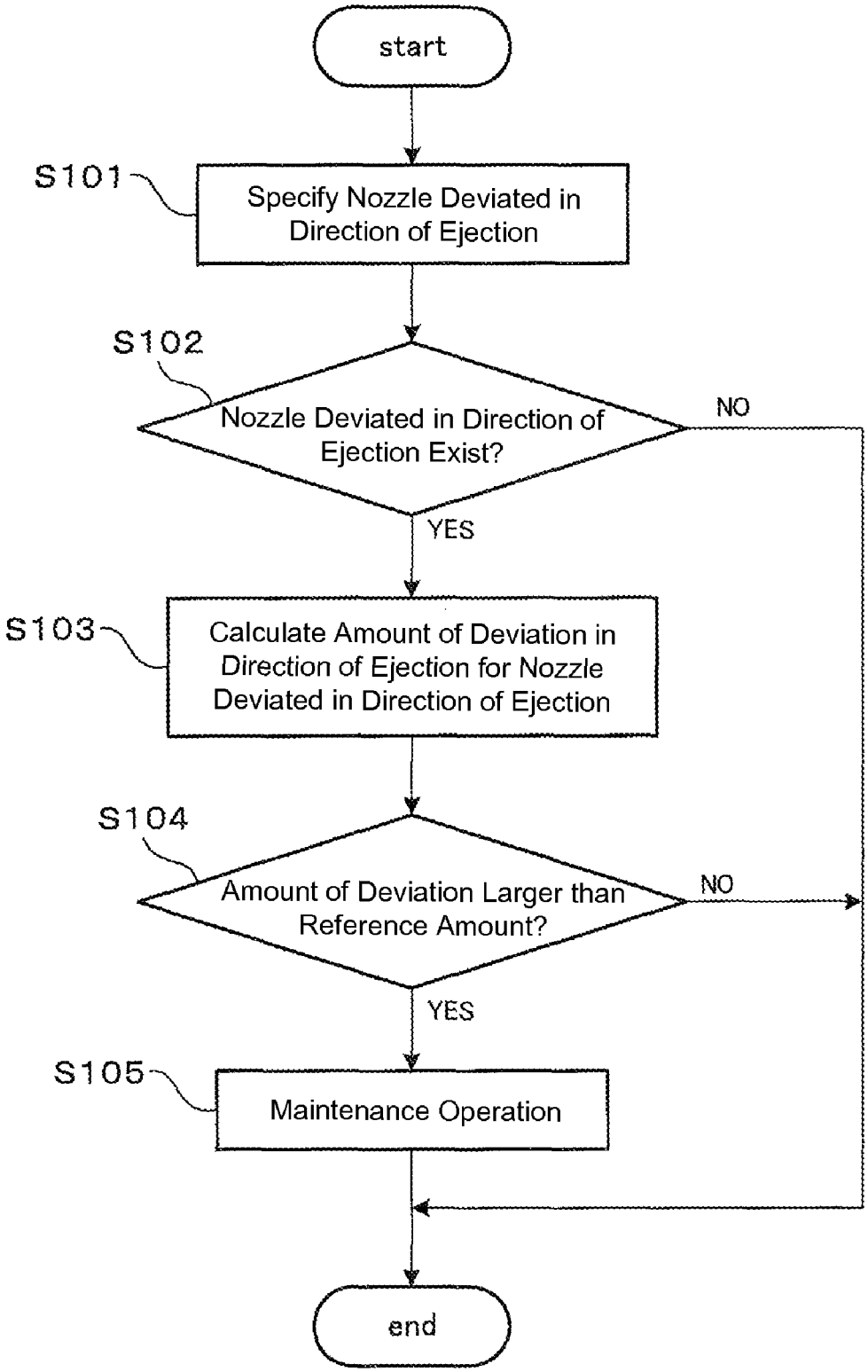
FIG. 13 is a flowchart showing a process of specifying a nozzle deviated in the direction of ink drop ejection and performing the maintenance operation.

Subsequently, a process for correcting the deviation in the direction of ink drop ejection from the nozzles 15 will be described. FIG. 13 is a flowchart showing the entire process.

In order to correct the deviation, the nozzles 15 whose direction of ink drop ejection is deviated are specified from the plurality of nozzles 15 (Step S101, which is expressed simply as S101, hereinafter) as shown in FIG. 13. When there is no nozzle 15 whose direction of ink drop ejection is deviated (No in S102), the operation is terminated. When a nozzle 15 has deviated ink ejection (Yes in S102), the deviation amount calculation unit 65 may calculate (S103) the amount of deviation the scanning direction and the paper feed direction for the deviated nozzles 15.

If the amounts of deviation in the scanning direction and the paper feed direction are equal to or smaller than the reference amounts stored in the reference amount storage unit 66 (No in S104), the operation is terminated. If at least one of the calculated amounts of deviation exceeds the respective reference amounts (Yes in S104), a maintenance operation (S105, described later) will be performed before the operation is terminated.

Figure 14:
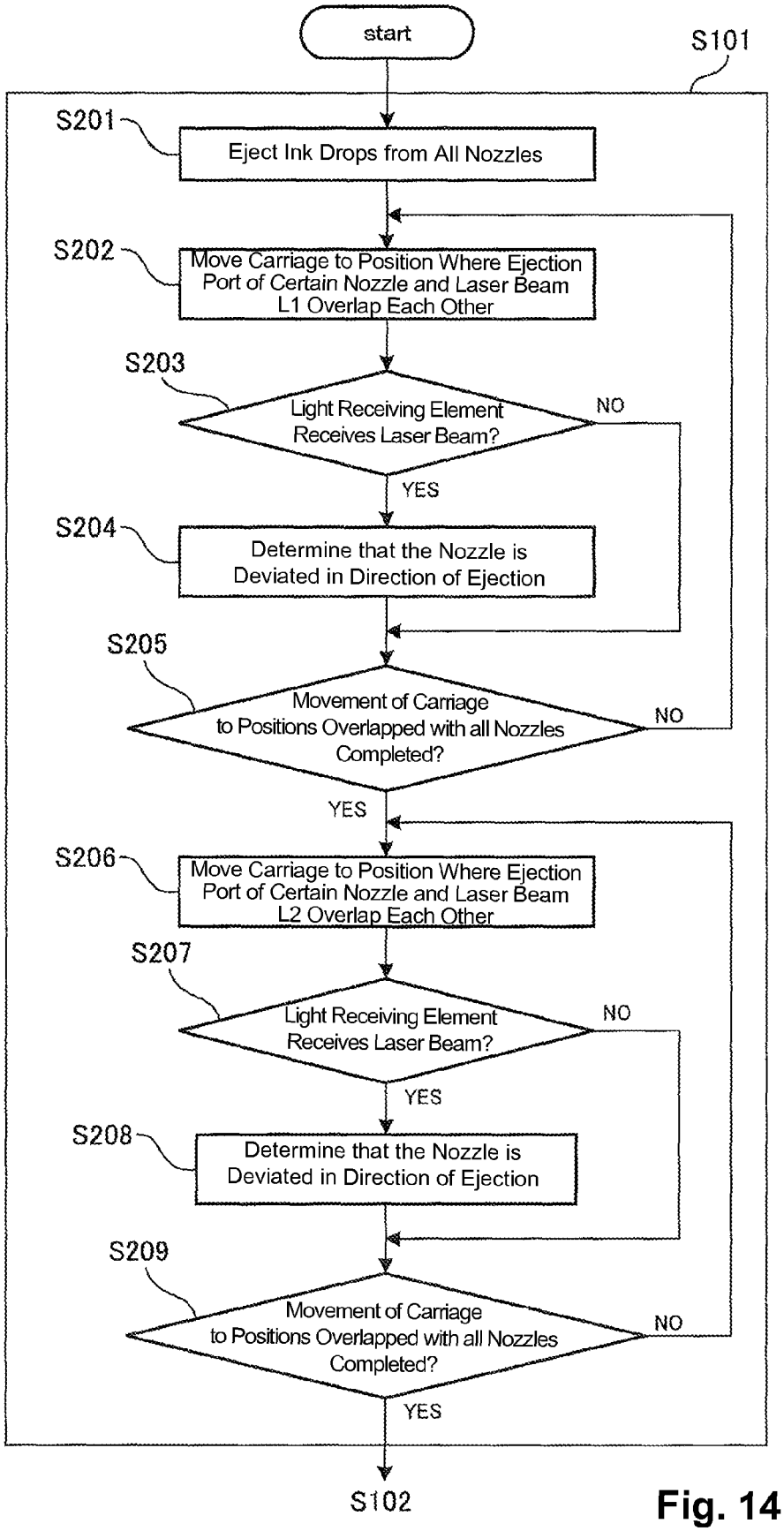
FIG. 14 is a flowchart showing a process for specifying the nozzle deviated in the direction of ink drop ejection.

Subsequently, a process of determining the nozzle whose direction of ejection is deviated shown in S101 in FIG. 13 will be described. FIG. 14 is a flowchart showing this process.

In order to specify the nozzle 15 whose direction of ink drop ejection is deviated, the carriage 2 (ink-jet head 4) is moved to a position where the ejection port 15*a* of the certain nozzle 15 and the laser beam L1 are overlapped with each other, which is stored in the normal position storage unit 60 (S202), and all the nozzles 15 are caused to eject ink drops (S201).

In this process, when the light receiving element 53*a* receives the laser beam (Yes in S203), the deviation determination unit 64 determines that the direction of ink ejection from the nozzle 15 in question is deviated (S204), and the procedure goes to S205 shown below. On the other hand, when the light receiving element 53*a* does not receive the laser beam (No in S203), the procedure goes directly to S205.

The steps from S202 to S204 are repeated until all the ejection ports 15*a* and the laser beam L1 are overlapped with each other (No in S205). When all the nozzles 15 and the laser beam L1 have overlapped with each other (Yes in S205), the carriage 2 is moved to a position where the ejection port 15*a* of the certain nozzle 15 and the laser beam L2 are overlapped with each other, which is stored in the normal position storage unit 60 (S206).

In this process, when the light receiving element 53*b* receives the laser beam (Yes in S207), the deviation determination unit 64 determines that the direction of ink ejection from the nozzle 15 in question is deviated (S208), and the procedure goes to S209 shown below. On the other hand, when the light receiving element 53*b* does not receive the laser beam, the procedure goes directly to S209.

The steps from S206 to S208 are repeated until all the ejection ports 15*a* and the laser beam L2 are overlapped with each other (No in S209). When all the nozzles 15 and the laser beam L2 have overlapped with each other (Yes in S209), the procedure goes to S102. With the process shown above, the direction of deviation in ink drop ejection may be determined for all the nozzles 15.

The reason why the carriage 2 is moved to the positions where all the ejection ports 15*a* are overlapped with the laser beams L1 and L2 respectively for determining whether or not the direction of ink drop ejection is deviated is as follows. If the carriage 2 only moves to the positions where the ejection ports 15*a* and one of the laser beams L1 an L2 are overlapping, the laser beams L1 and L2 are interrupted by the ink drops and hence the light receiving elements 53*a* and 53*b* do not receive the laser beams L1 and L2 when the direction of ink drop ejection is displaced in a direction parallel to the laser beams L1 or L2. Consequently, occurrence of deviation in the direction of ink drop ejection is not detected.

As described above, since the laser beams L1 and L2 do not overlap with two or more ejection ports 15*a* simultaneously, determining whether ink drop ejection is deviated can be done in a short time for all the nozzles 15 by moving the carriage 2 from a position adjacent to one end of the light detection device 6 on the outside thereof to a position adjacent to the other end of the light detection device 6 on the outside thereof once in the scanning direction while all of the nozzles 15 are ejecting ink drops.

In the process of specifying the nozzles whose direction of ink drop ejection is deviated in S101 described above, the movement of the carriage 2 may be continuous, or may be stopped intermittently at the positions where the ejection port 15*a* of a certain nozzle 15 and the laser beam L1 or L2 are overlapped with each other, so that ejection from the nozzle 15 and the movement of the carriage 2 are not performed simultaneously (ejection from the nozzle 15 and the movement of the carriage 2 are performed alternately).

Figure 15:
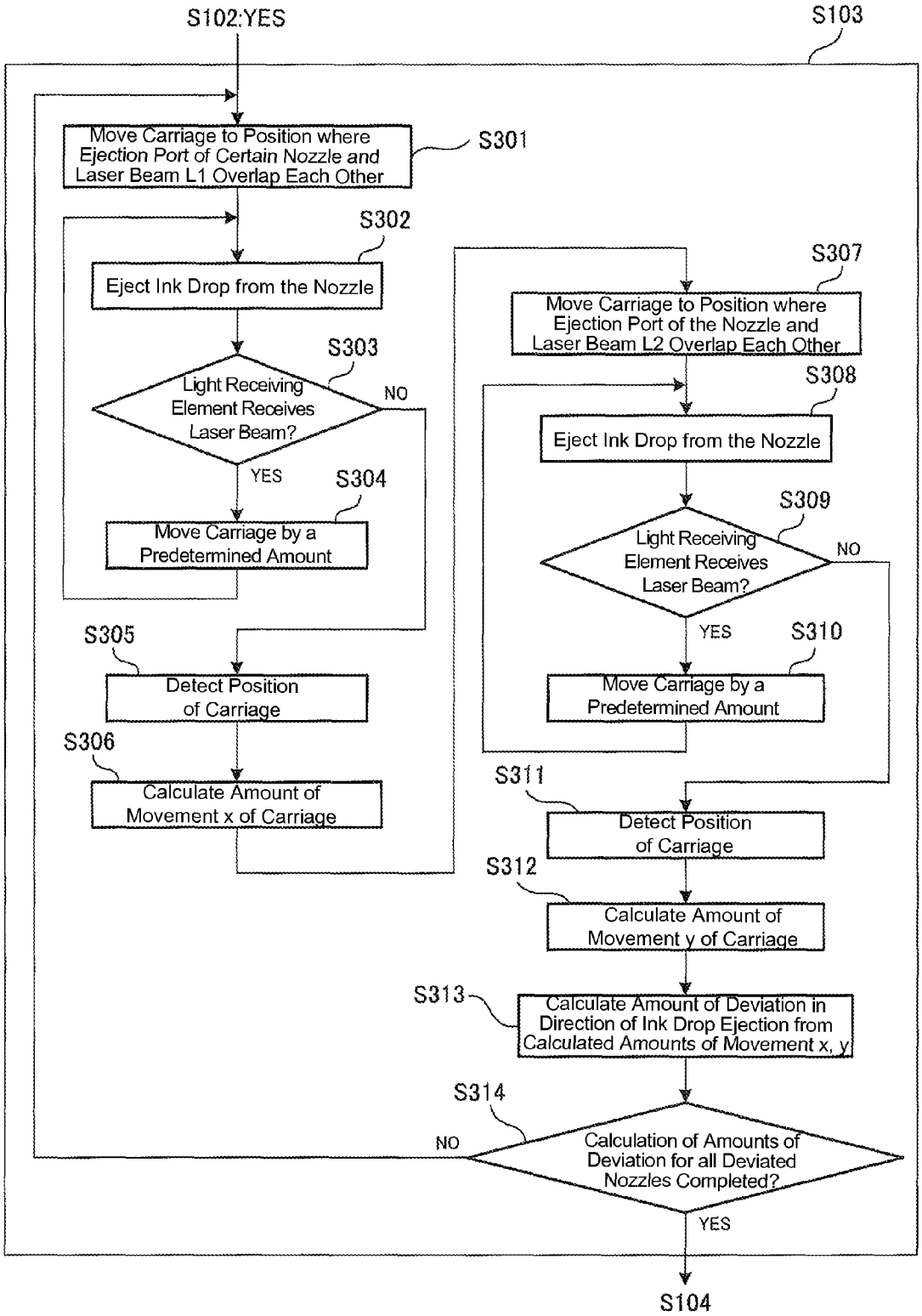
FIG. 15 is a flowchart showing a process of calculating the amount of deviation in the direction of ink drop ejection at the nozzle.

Subsequently, a process to calculate the amount of ink drop ejection deviation for a nozzle 15 that is determined to be deviated in the direction of ink drop ejection in Step 103 will be described. FIG. 15 is a flowchart showing the process. FIGS. 16A and 16B and FIGS. 17A and 17B are drawings showing the operation of the ink-jet printer 1 in this process. An ink drop that is normally ejected (the position of the ejection port 15*a*) is represented by a dotted line, and a deviated ink drop I2 actually injected is indicated by a solid line, in FIGS. 16A and 16B and FIGS. 17A and 17B.

Figure 16A:
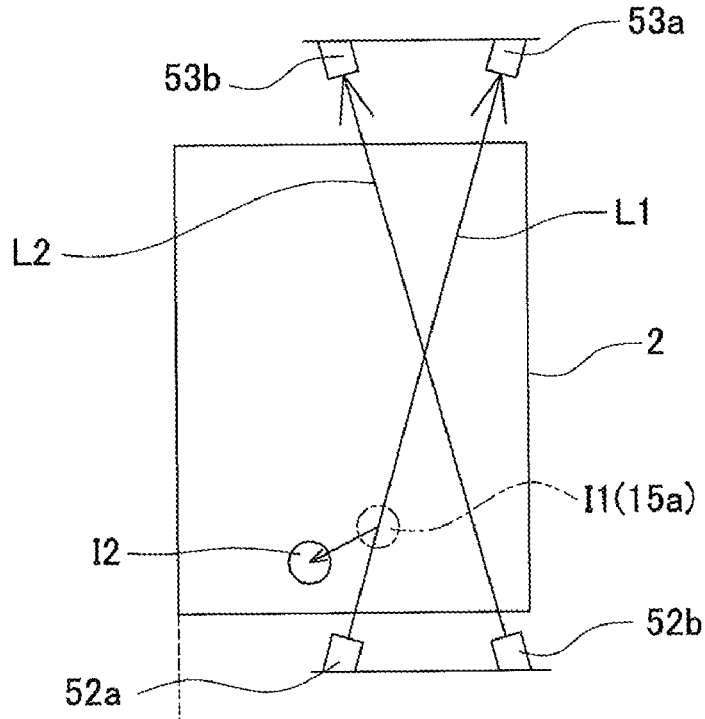
FIGS. 16A and 16B illustrate positions of the ink-jet head in an earlier part of the process in FIG. 15.

In order to calculate the amount of deviation in the direction of ink drop ejection at the nozzle 15, the carriage 2 (the ink-jet head 4) is moved to a position where the ejection port 15*a* of a certain nozzle 15 and the laser beam L1 are overlapped with each other stored in the normal position storage unit 60 (S301) as shown in FIG. 16A.

Figure 16B:
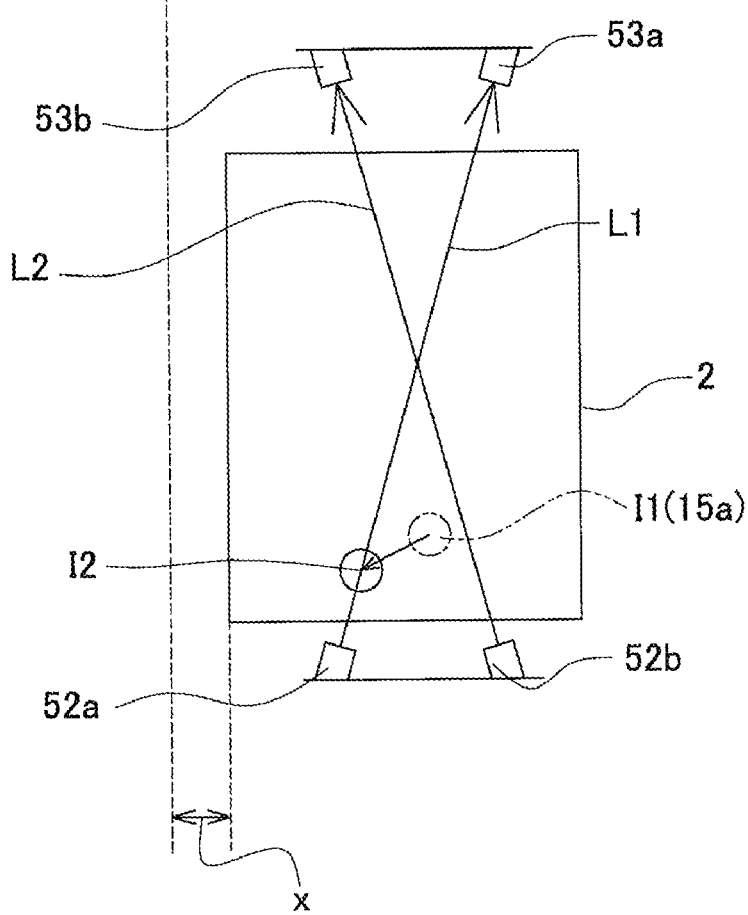

Subsequently, the ink drops are ejected from the nozzle 15 in question (S302). Then, if the light receiving element 53*a* receives the laser beam (Yes in S303), the carriage 2 is moved in the scanning direction by a predetermined amount (S304), and the procedure goes back to S302 described above. When the ink drop I2 ejected from the nozzle 15 in question is overlapped with the laser beam L1, and hence the light receiving element 53*a* does not receive the laser beam L1 any longer as shown in FIG. 16B (No in S303), the position of the carriage 2 at this moment is detected by the position detection unit 63 (S305). Subsequently, the amount of movement x of the carriage 2 in the scanning direction is calculated from the position of the carriage 2 in S301 stored in the normal position storage unit 60 and the position of the carriage 2 detected in S305 (S306). The predetermined amount is sufficiently shorter than the length of the ink-jet head 4 in the scanning direction.

Figure 17A:
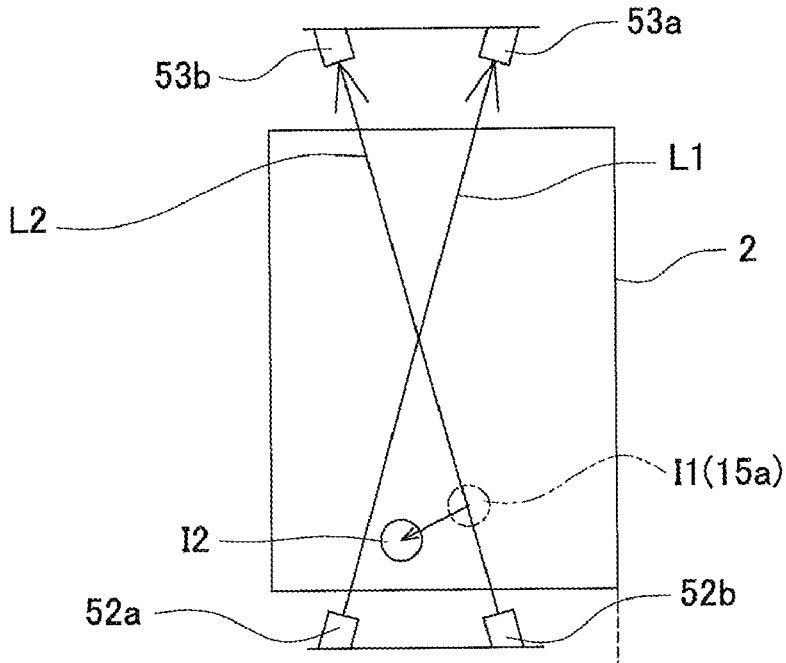
FIGS. 17A and 17B illustrate positions of the ink-jet head in a latter part of the process in FIG. 15.

Subsequently, as shown in FIG. 17A, the carriage 2 is moved to a position where the ejection port 15*a* of the nozzle 15 in question and the laser beam L2 are overlapped with each other stored in the normal position storage unit 60 (S307), and the nozzle 15 in question is caused to eject an ink drop (S308).

Figure 17B:
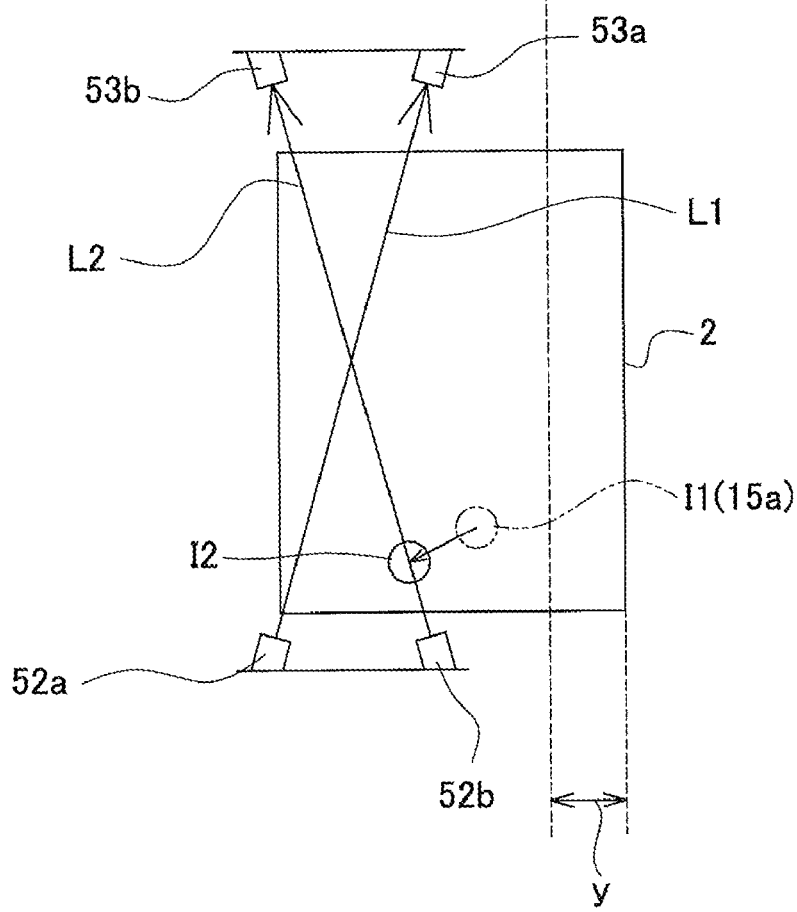

If the light receiving element 53*b* receives the laser beam continuously at this moment (Yes in S309), the carriage 2 is moved in the scanning direction by a predetermined amount (S310). Then, the procedure goes back to S308 and, when the ink drop I2 ejected from the nozzle 15 in question is overlapped with the laser beam L2, and hence the light receiving element 53*b* does no receive the laser beam L2 any longer as shown in FIG. 17B (No in S309), the position of the carriage 2 at this moment is detected by the position detection unit 63 (S311). Subsequently, the amount of movement y of the carriage 2 in the scanning direction is calculated from the position of the carriage 2 in S307 stored in the normal position storage unit 60 and the position of the carriage 2 detected in S311 (S312). Then, the amount of deviation in the direction of ink drop ejection in the scanning direction and the paper feed direction can be calculated from the calculated amount of movement x and the amount of movement y (S313). The steps from S301 to S313 can be repeated until the amounts of deviation of all the deviating nozzles 15 are completed (No in S314). When the calculation of the amounts of deviation is completed for all the nozzles 15 (Yes in S314), the procedure goes to S104.

Figure 18:
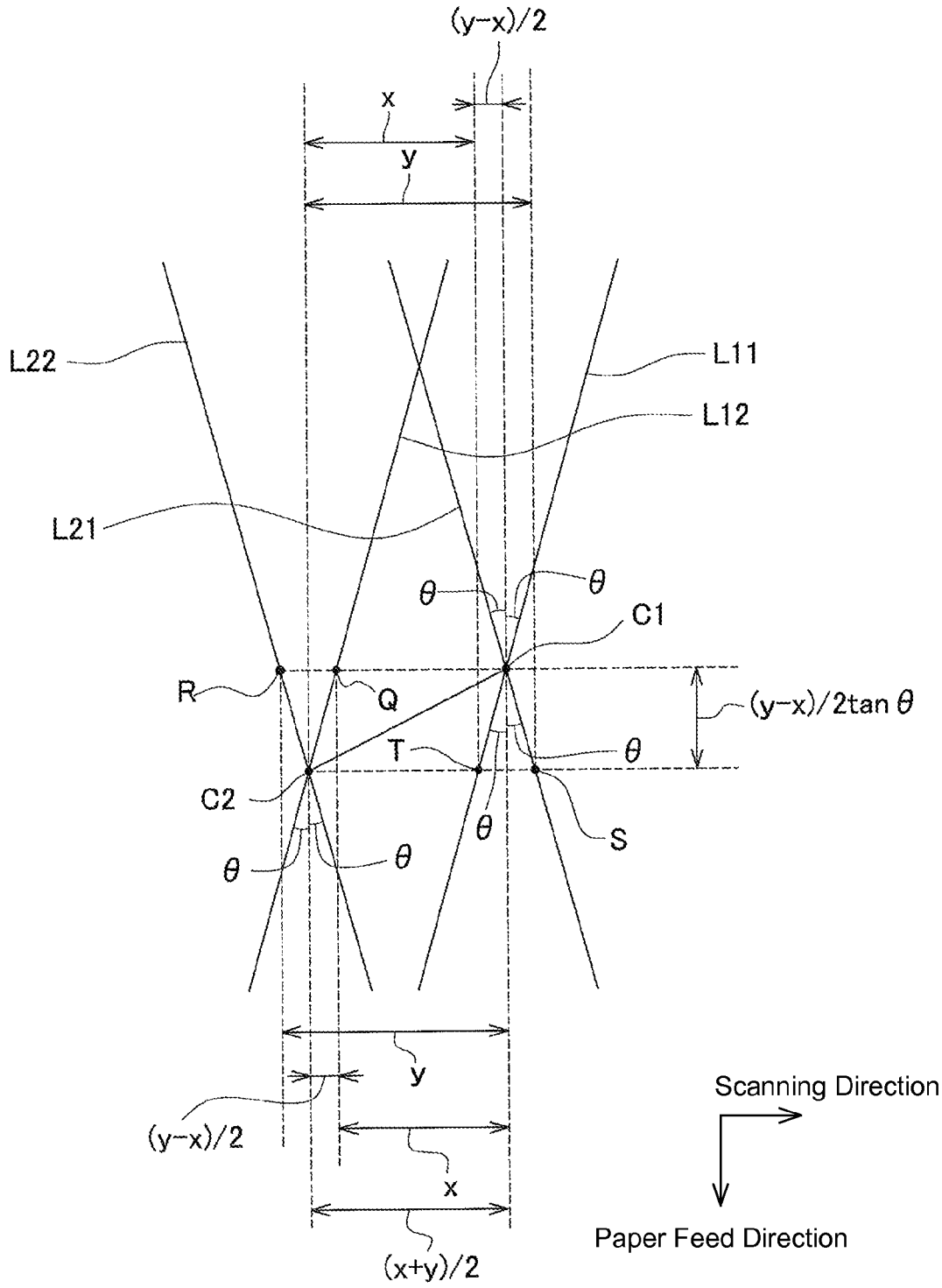
FIG. 18 is a schematic drawing in which the positional relationships in FIGS. 16A and 16B and FIGS. 17A and 17B are rewritten in reference with the ink landing position.

A method of calculating the amount of deviation in the direction of ink drop ejection will be described in detail. FIG. 18 contains pattern diagrams in which the positional relationship between the laser beam L1 in FIGS. 16A and 16B, the laser beam L2 in FIGS. 17A and 17B, and the ink drops I1 and I2 is rewritten with reference to the ink drops T1 and 12. In FIG. 18, the centers of the ink drops T1 and 12 in FIGS. 16A and 16B and FIGS. 17A and 17B correspond respectively to a point C1 and a point C2, and the laser beams L1 in FIGS. 16A and 16B correspond to straight lines L11 and L12, and the laser beams L2 in FIGS. 17A and 17B correspond to straight lines L21 and L22 respectively.

In FIG. 18, the amounts of movement x and y correspond to the distance between the straight line L11 and the straight line L12 and the distance between the straight line L21 and the straight line L22 respectively. Therefore, the distance between the point C1 and an intersection R between a straight line passing through the point C1 and extending in parallel to the scanning direction and the straight line L22 in the scanning direction corresponds to y, and the distance between the point C1 and an intersection Q between the straight line passing through the point C1 and extending in parallel to the scanning direction and the straight line L12 in the scanning direction corresponds to x. Therefore, the distance between the point R and the point Q in terms of the scanning direction is (y−x), and angles of L12 and L22 with respect to the paper feed direction are θ. Consequently, the distance between the landing point C2 of actually ejected ink drop and the point Q in the scanning direction is (y−x)/2. Therefore, the distance between the point C1 and the point C2 in the scanning direction, that is, the amount of deviation in the direction of ink drop ejection in terms of the scanning direction is calculated to be (x+y)/2.

The amounts of movement x and y correspond respectively to the distance between the straight line L11 and the straight line L12 and the distance between the straight line L21 and the straight line L22, and hence the distance between the point C2 and an intersection S between a straight line passing through the point C2 and extending in parallel to the scanning direction and the straight line L12 in the scanning direction is y and the distance between the point C2 and an intersection T between the straight line passing through the point C2 and extending in parallel to the scanning direction and the straight line L11 in the scanning direction is x. Therefore, the distance between the point T and the point S in terms of the scanning direction is y-x, and angles of the straight line L11 and the straight line L21 with respect to the paper feed direction are θ. Therefore, the distance between the point C1 and the point T in terms of the scanning direction is (y−x)/2. Since the angle of the straight line L11 with respect to the paper feed direction is θ, the distance between the point C1 and the point C2 in terms of the paper feed direction, that is, the amount of deviation of the ink drop in terms of the paper feed direction is calculated to be (y−x)/2 tan θ.

In S103, the amount of deviation in the direction of ink drop ejection can be calculated only for the nozzles 15 that are determined to be deviated in the direction of ink drop ejection in S101. Therefore, the amount of deviation in the direction of ink drop ejection can be calculated in a short time.

Figure 19:
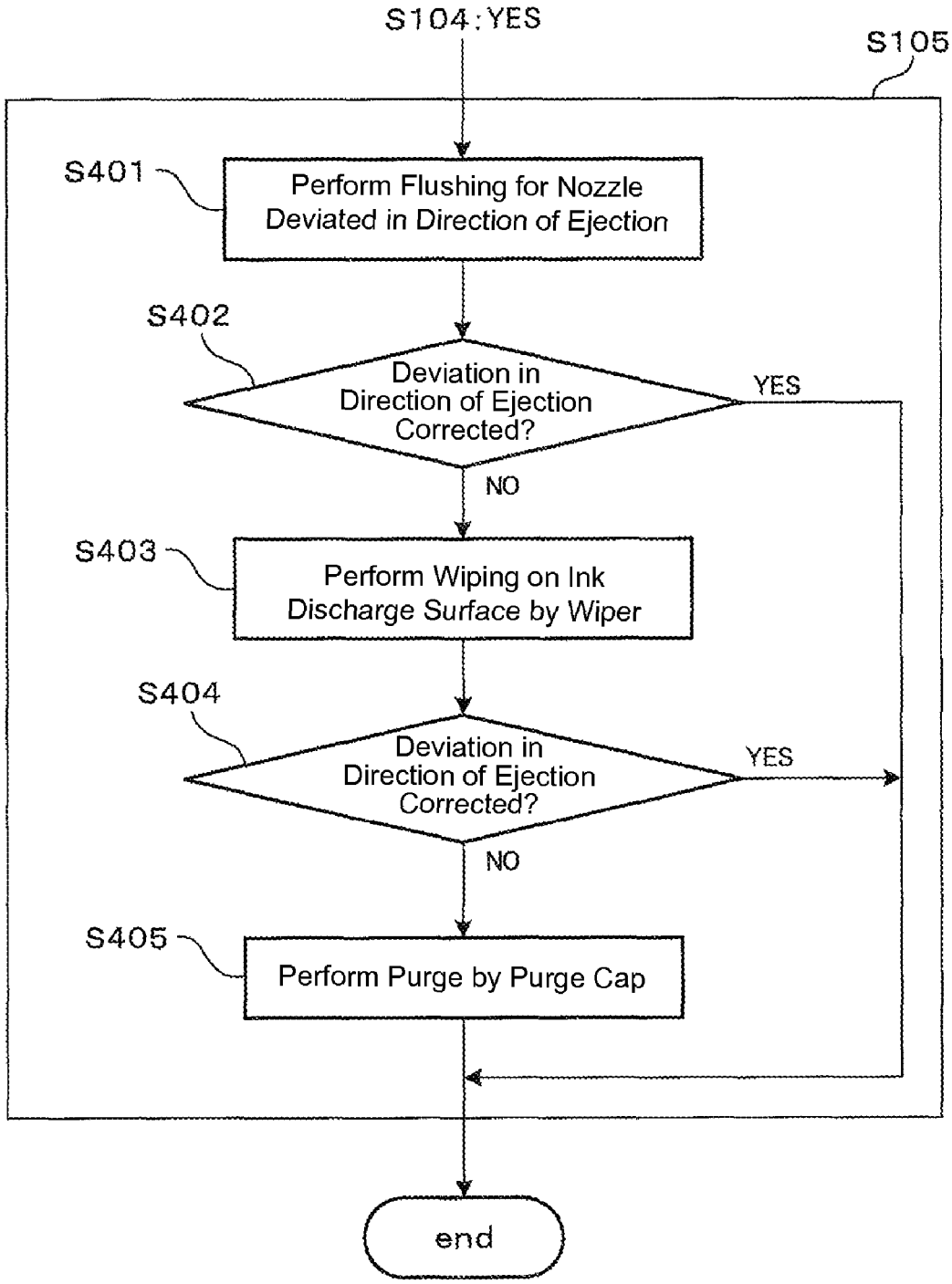
FIG. 19 is a flowchart showing the process of the maintenance operation in FIG. 13.

Subsequently, the process of maintenance operation in S105 shown in FIG. 13 will be described. FIG. 19 is a flowchart showing a process of maintenance operation. FIG. 20 is a cross-sectional view corresponding to FIG. 3, showing the operations of the ink-jet head 4, the wiping unit 7, and the purge cap 8*a* during the maintenance operation.

When it is determined that abnormality exists by the abnormal determination unit 67 (Yes in S104), the carriage 2 (ink-jet head 4) can be moved to a position opposing an ink absorbing member, not shown, for causing the nozzles 15 determined to be abnormal to eject ink drops (S401), thereby flushing them. In this operation, the potential to be applied to the individual electrodes 42 may be the same driving potential applied when causing ink drops to be ejected on the recording paper P, but may alternatively be a potential different from the driving potential. The potential may be applied to the individual electrodes 42 for the same period as the period of the ink drop ejection to the recording paper P, or it may be applied for a different period.

Figure 20A:
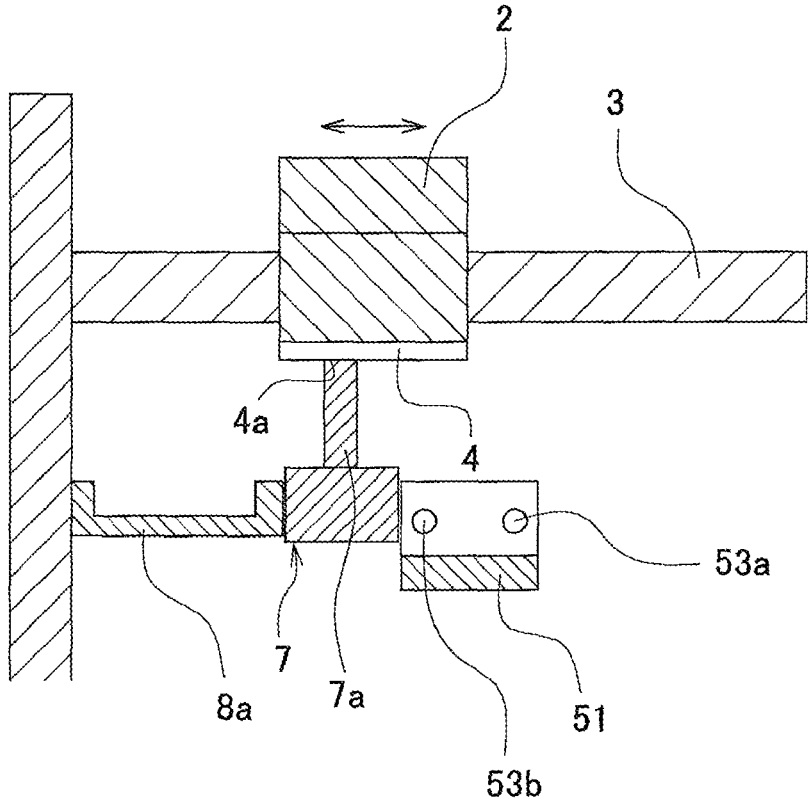
FIG. 20 is a cross-sectional view corresponding to FIG. 3 showing the operation of a wiper and a purge cap during the maintenance operation in FIG. 19.

Then, if the deviation in the direction of ink ejection is corrected by flushing (Yes in S402), the maintenance operation is terminated. However, if the deviation in the direction of the ink ejection is not corrected (No in S402), the wiping unit 7 may be moved upward and then the carriage 2 may be moved in the scanning direction as shown in FIG. 20A. Accordingly, the ink-jet head 4 may be moved in the scanning direction in a state in which the distal end of the wiper 7*a* abuts against the ink ejection surface 4*a*, the ink attached to the ink ejection surface 4*a* is removed (wiping is performed S403).

Figure 20B:
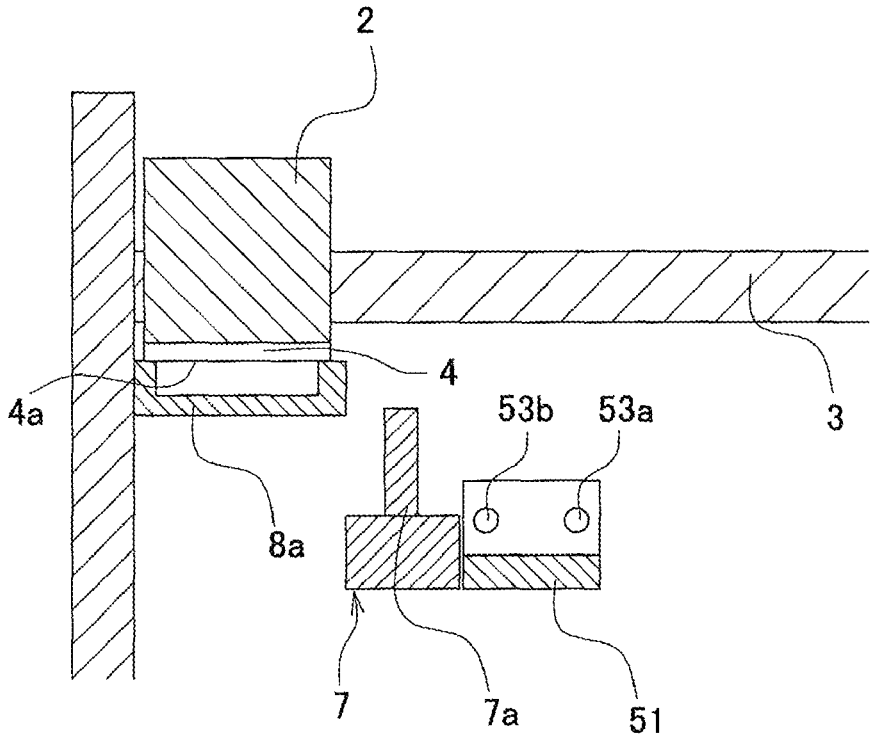

Then, if deviation in the direction of ink drop ejection is corrected by the wiping (Yes in S404), the maintenance operation is terminated. If the deviation in the direction of ink drop ejection is not corrected (No in S404), as shown in FIG. 20B, the carriage 2 may be moved to a position opposing the purge cap 8*a* and then the purge cap 8*a* is moved upward into abutment with the ink ejection surface 4*a*, and then purge can be performed for sucking ink from all the nozzles 15 by lowering the pressure in the space surrounded by the ink ejection surface 4*a* and the purge cap 8*a* by the pump or the like, not shown (S405) to terminate the maintenance operation.

The flushing may be performed by ejecting ink only from the nozzles 15 which are deviated in the direction of ink drop ejection. Therefore, the amount of ink to be consumed is relatively small, and the wiper 7 does not come into contact with the ink ejection surface 4*a* as in the case of performing the wiping. Since the wiping is an operation to remove the ink attached to the ink ejection surface 4*a* by the wiper 7, no ink is consumed. In the purge, the amount of ink to be consumed is large since ink is sucked from all the nozzles 15. Therefore, the wiping is performed only when the deviation in the direction of ink drop ejection cannot be corrected after having performed the flushing in the maintenance operation, and the purge is performed only when the deviation in the direction of ink drop ejection cannot be corrected by the wiping, so that the amount of ink to be consumed through the maintenance operation is reduced, and the life of the ink-jet head 4 is elongated.

In S402 and S404, in the same manner as in S103, the amounts of deviation in the direction of ink drop ejection at the nozzles 15 in the scanning direction and the paper feed direction are calculated, and when the both calculated amount of deviation are equal to or lower than the reference amounts for the respective directions stored in the reference amount storage unit 66, it is determined that the deviation in the direction of ejection is corrected.

Figure 21:
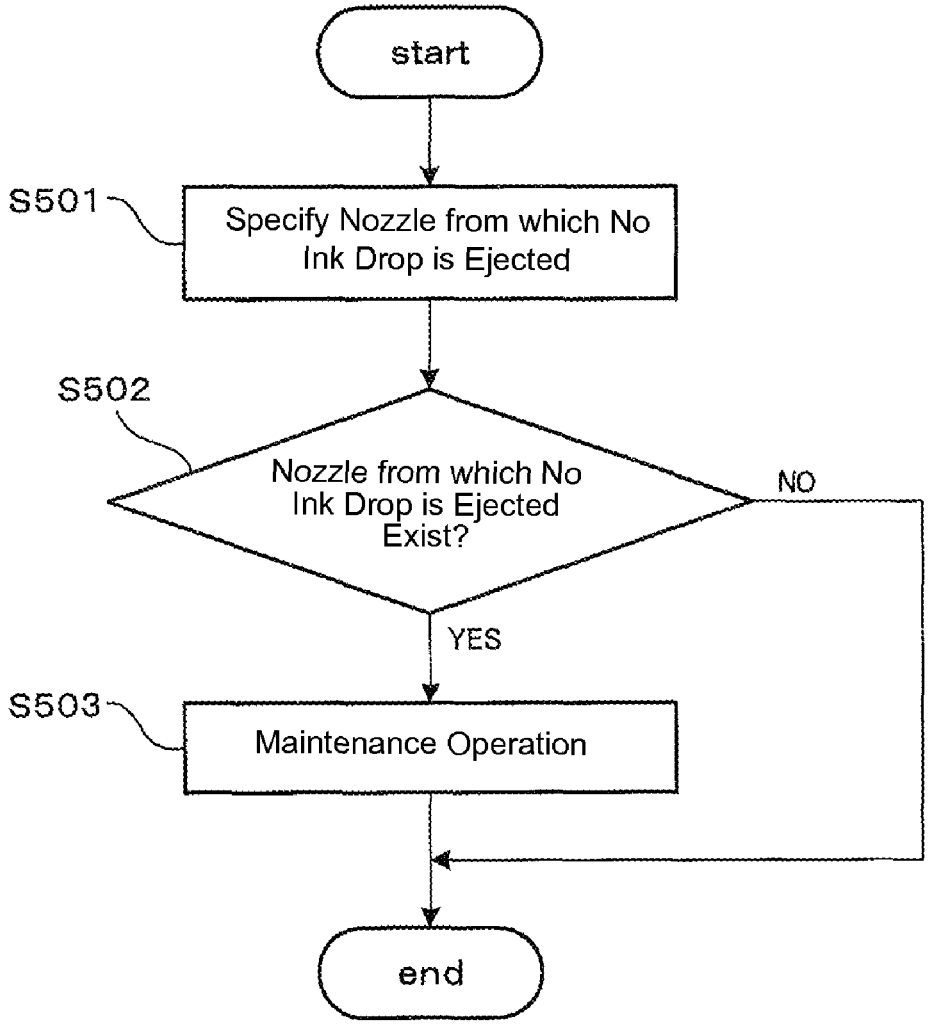
FIG. 21 is a flowchart showing a process of specifying a nozzle from which no ink drop is ejected and performing the maintenance operation.

A process of restoring the ejection of ink drops from the nozzle 15 from which the ink drops are not ejected (e.g., clogged) will be described. FIG. 21 is a flowchart showing this process.

In order to restore the ejection of ink drops from the nozzle 15 from which the ink drop is not ejected to a normal state, the nozzle 15 from which the ink drops are not ejected is specified in a first step as shown in FIG. 21 (S501). When the nozzle 15 from which the ink drops are not ejected does not exist (No in S502), the operation is terminated. When there exists the nozzle 15 from which the ink drops are not ejected (Yes in S502), the maintenance operation, described later, may be performed (S503) and the operation is terminated.

Figure 22:
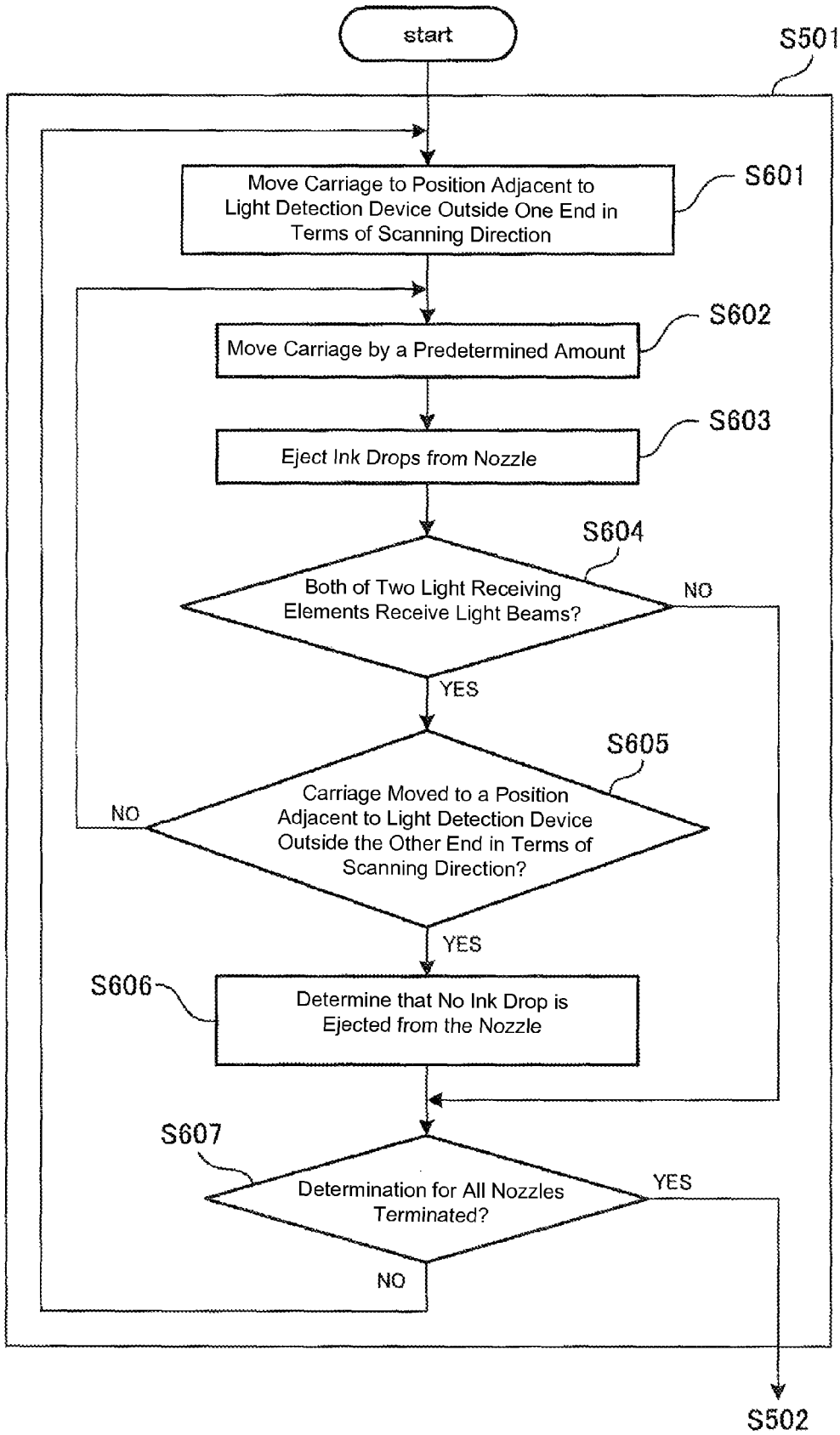
FIG. 22 is a flowchart showing a process of specifying the nozzle from which no ink drop is ejected in FIG. 21.

A process of S501 for specifying the nozzles 15 from which the ink drops are not ejected will be described. FIG. 22 is a flowchart showing this process. In order to specify the nozzles 15 from which the ink drops are not ejected, the carriage 2 (ink-jet head 4) is moved firstly to a position adjacent to the light detection device 6 outside of one end thereof in terms of the scanning direction as shown in FIG. 22 (S601).

Subsequently, the carriage 2 is moved toward the other end of the light detection device 6 by a predetermined amount in the scanning direction (S602), and causes a certain nozzle 15 to eject ink drops (S603). When one of the light receiving elements 53*a* and 53*b* does not receive the light beam (No in S604), the procedure goes to S607 shown below. When both the light receiving elements 53*a* and 53*b* receive light beams (Yes in S604), the procedure goes to S605. In S605, when the carriage 2 is moved to a position adjacent to the light detection device 6 outside the other end thereof in terms of the scanning direction (Yes in S605), it is determined that the ink drops are not ejected from the nozzle 15 in question (S606) and the procedure goes to S607. When the carriage 2 is not moved to the position adjacent to the light detection device 6 outside the other end thereof in terms of the scanning direction (No in S605), the procedure goes back to S602.

In S607, when the determination whether or not the ink drops are ejected is completed for all the nozzles 15 (Yes in S607), the procedure goes to S502. When determination of whether or not the ink drops are ejected for all the nozzles 15 is not completed (No in S607), the procedure goes back to S601.

Figure 23:
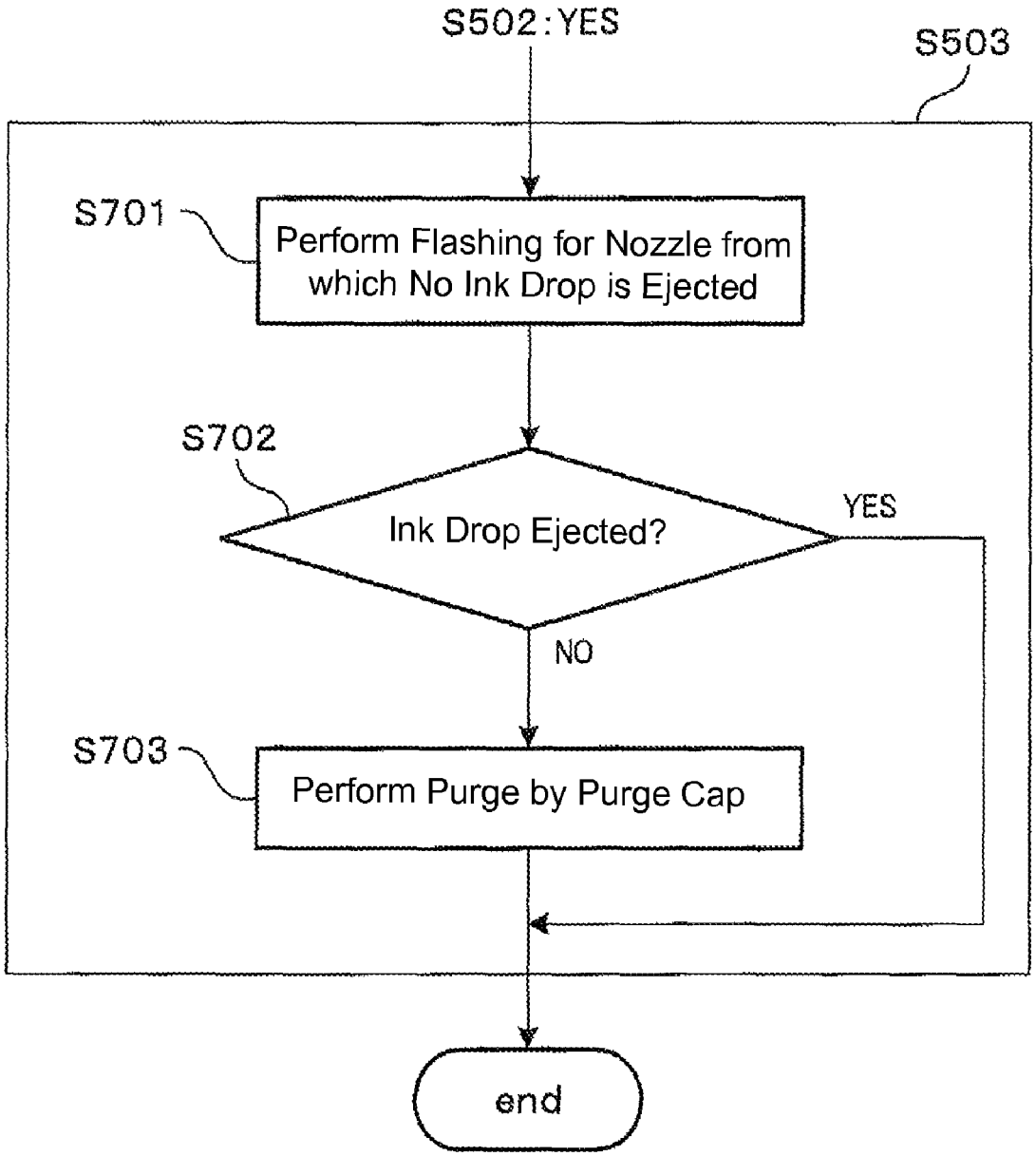
FIG. 23 is a flowchart showing a process of the maintenance operation in FIG. 21.

Subsequently, a process of the maintenance operation in S503 will be described. FIG. 23 is a flowchart showing this process.

In the maintenance operation, the carriage 2 is moved to a position opposing the ink absorbing member, not shown, and then the flushing for causing the nozzle 15 from which the ink drops are not ejected to eject ink drops is performed (S701). For example, in a case in which ink drops are not ejected from the nozzle 15 due to increase in viscosity of ink because ink in the nozzle 15 is dried, the ejection of ink drops is restored from the nozzle 15 by the flushing.

If the ejection of ink drops from the nozzles 15 in question is restored by the flushing (Yes in S702), the maintenance operation is terminated. If the ejection of ink drops from the nozzles 15 is not restored even though the flushing is performed (No in S702), the carriage 2 can be moved to the position opposing the purge cap 8*a*, and then the purge cap 8*a* can be moved upward into abutment with the ink ejection surface 4*a* as shown in FIG. 20B. Then, the purge to suck ink from all the nozzles 15 is performed by lowering the pressure in the space surrounded by the ink ejection surface 4*a* and the purge cap 8*a* by the pump or the like connected to the purge cap 8*a*, not shown (S703), and the maintenance operation is terminated. With the purge as described above, clogging of the nozzles 15 is reliably cleared, and hence the ink drops are ejected from the nozzles 15.

The amount of ink consumed by the flushing described above is relatively small since the ink drops are ejected only from the nozzles 15 from which the ink drops are not ejected. In contrast, the amount of ink consumed by the purge is large since ink is sucked from all the nozzles 15. Therefore, the purge may be performed after the flushing is unsuccessful, so that the amount of ink to be consumed through the maintenance operation is reduced.

Whether or not the ejection of ink drops from the nozzles 15 is restored in S702 is determined in the same manner as the case of specifying the nozzles 15 from which the ink drops are not ejected in S601.

As described above, since the fact that deviation in the direction of ink drop ejection occurs at the nozzles 15 and the fact that the ink drops are not ejected from the nozzles 15 are detected separately, the different maintenance operations may be performed for the case in which deviation in the direction of ink drop ejection occurs at the nozzles 15 and the case in which the ink drops are not ejected from the nozzles 15. In other words, in the case in which the ink drops are not ejected from the nozzle 15 (e.g., clogged), if the ejection of ink drops is not restored even though the flushing is performed, the purge is performed without performing wiping. Accordingly, shortening of the life of the ink-jet head 4 due to the contact of the wiper 7*a* to the ink ejection surface 4*a* through the useless wiping is prevented.

According to the first embodiment described above, the two laser sources 52*a* and 52*b* emit the laser beams L1 and L2 which intersect with respect to each other along the one plane. Therefore, when the direction of ink drops ejected from a certain nozzle 15 is deviated in any direction in the one plane, the position of the ink-jet head 4 at which at least one of the laser beams L1 and L2 emitted from the two laser sources 52*a* and 52*b* is interrupted by liquid drops ejected from the nozzle 15 in question is different from the position of the ink-jet head 4 at which the ink drop is ejected in the normal direction. Therefore, the deviation in any direction can be detected by moving the ink-jet head 4 in the scanning direction while ejecting ink drops from the nozzles 15.

When the ink-jet head 4 is moved in the scanning direction, the laser beams L1 and L2 emitted from the two laser sources 52*a* and 52*b* pass through the area opposing the ejection ports 15*a* of the plurality of nozzles 15. Therefore, when the ink drop is ejected from a certain nozzle 15, the two light receiving elements 53*a* and 53*b* do not receive the light beams any longer when the ink-jet head 4 reaches at a certain position. In contrast, when the ink drop is not ejected from the nozzle 15 in question, the two light receiving elements 53*a* and 53*b* do not fail to receive laser beams during this period. Therefore, the fact that the ink drop is not ejected from the nozzle 15 is detected by moving the ink-jet head 4 in the scanning direction while causing the nozzles 15 to eject ink drops.

Also, the amount of deviation in the direction of ink drop ejection at the nozzle 15 is accurately calculated by the deviation amount calculating unit 65 from the amount of deviation in the scanning direction between the position of the ink-jet head 4 when the laser beams L1 and L2 emitted respectively from the two laser sources 52*a* and 52*b* are interrupted by ink drops ejected from a certain nozzle 15, and the normal position of the ink-jet head 4 for the nozzle 15 in question.

Since deviation is determined easily by the deviation determination unit 64, the amount of deviation in the direction of ink drops ejected from the nozzles 15 is calculated in a short time by determining whether or not the direction of ejection of ink drops ejected from the nozzles 15 is deviated and calculating the amount of deviation in the direction of ink drop ejection only for the nozzles 15 which are determined to be deviated in the direction of ink drop ejection.

Since the laser beams L1 and L2 emitted from the laser sources 52*a* and 52*b* do not overlap with the ejection ports 15*a* of two or more nozzles 15 while the ink-jet head 4 moves in the scanning direction at the position opposing the light detection device 6, deviation (if any) can be determined for all the nozzles 15 by moving the ink-jet head 4 from the position adjacent to the light detection device 6 outside of one end thereof to the position adjacent thereto on the other end thereof in terms of the scanning direction only once while all the nozzles 15 eject ink drops. Accordingly, whether deviation is present is determined for all the nozzles 15 in a short time.

The reference amount storage unit 66 stores the reference amounts individually for the scanning direction and the paper feed direction, and the abnormal determination unit 67 determines that abnormal in ink drop ejection exists at a certain nozzle 15 when the amount of deviation in the direction of ink drop ejected from the nozzle 15 in question calculated by the deviation amount calculating unit 65 in terms of at least one of the scanning direction and the paper feed direction exceeds the reference amount in the corresponding direction. Therefore, the existence of abnormality is determined accurately when the amount of deviation in the direction of ink drop ejection at the nozzle exceeds the negligible extent.

The ink-jet head 4 may be a serial head that ejects ink drops on the recording paper P carried in the paper feed direction while reciprocating in the scanning direction, and the reference amount for the paper feed direction and the reference amount for the scanning direction are stored in the reference amount storage unit 66. Therefore, the deviation in the direction of ink drop ejection is detected in the ink-jet printer 1 having the serial head.

Since the ink-jet head 4 may be the serial head, when the direction of ink drop ejection is deviated in the paper feed direction, the streak of area W1 to which no ink drop is ejected extending continuously in the scanning direction is formed on the recording paper P having completed with printing, which results in significant deterioration of the print quality. In contrast, even when the direction of ink drop ejection is deviated in the scanning direction, the steak of area is not formed, and hence adverse effects on the image quality are small. Therefore, by setting the reference amount in terms of the paper feed direction smaller than the reference amount in terms of the scanning direction, the deviation in the paper feed direction is detected even though it is small deviation, so that the deterioration of the image quality is avoided by performing the maintenance operation according to the detected result. On the other hand, as regards the scanning direction, the maintenance operation is performed only when significant deviation which may affect the image quality is detected. Consequently, the efficient maintenance operation is achieved.

The direction of relative movement between the ink-jet head 4 and the light detection device 6, that is, the direction of movement of the ink-jet head 4 may both be the same as the scanning direction when printing. Therefore, a small space will be sufficient for moving the ink-jet head 4 and the light detection device 6 with respect to each other, and hence the ink-jet printer 1 may be downsized.

Subsequently, an embodiment in which various modifications are added to the first embodiment will be described.

In the first embodiment, the ink-jet head 4 and the light detection device 6 are moved in the scanning direction with respect to each other by moving the ink-jet head 4 in the scanning direction by the carriage 2. However, a configuration in which the light detection device 6 is adapted to move in the scanning direction, and the ink-jet head 4 and the light detection device 6 are moved with respect to each other in the scanning direction by moving the light detection device 6 in the scanning direction. In this case, the position of the light detection device 6 (the position of the light detection device 6 with respect to the ink-jet head 4) is detected instead of detecting the position of the ink-jet head 4 by the position detection unit 63 in the first embodiment.

In this case, the light detection device 6 may be arranged so that the ejection ports 15*a* of all the nozzles 15 are positioned between the two laser sources 52*a* and 52*b* and the two light receiving elements 53*a* and 53*b* in terms of the scanning direction when viewed in plan view, and configured so as to be capable of moving in the paper feed direction.

In the first embodiment, the carriage 2 is moved in the scanning direction in the state in which all the nozzles 15 are caused to eject ink drops when specifying the nozzles 15 which are deviated in the direction of ink drop ejection. However, it is also possible to move the carriage 2 in the scanning direction and cause the nozzle 15 to eject the ink drops when at least the ink-jet head 4 is moved to the position to be overlapped with the ejection port 15*a* of the corresponding nozzle 15 and the laser beam L1 or L2.

In the first embodiment, the laser beams L1 and L2 each are not overlapped with two or more ejection ports 15*a* simultaneously when viewed in plan view during the movement of the ink-jet head 4. However, a configuration in which the laser beams L1 and L2 each are overlapped with two or more ejection ports 15*a* simultaneously is also applicable. In this case, the nozzles 15 deviated in the direction of ink drop ejection are specified by repeating the operation to move the ink-jet head 4 to the positions where the laser beams L1 and L2 each are overlapped with the respective ejection ports 15*a* by a plurality of times while switching the nozzle 15 to eject the ink drops in a state of causing only the one of the ejection ports 15*a* which is overlapped with the laser beams L1 and L2 to eject ink drops, so that the nozzle 15 deviated in the direction of ink drop ejection is specified.

In the first embodiment, the nozzles 15 deviated in the direction of ink drop ejection are specified first, and then the amount of deviation in the direction of ink drop ejection is calculated only for the specified nozzles 15. However, it is also possible not to specify the nozzles 15 deviated in the direction of ink drop direction and to calculate the amount of deviation in the direction of ink drop ejection for all the nozzles 15.

In the first embodiment, the reference amounts in terms of the scanning direction and the paper feed direction is stored individually in the reference amount storage unit 66. However, it is also possible to store one reference amount in the reference amount storage unit 66, and determine that abnormal exists by the abnormality determination unit 67 when at least one of the amounts of deviation in the direction of ink drop ejection in terms of the scanning direction and the paper feed direction which are calculated by the deviation amount calculating unit 65 exceeds the specified reference amount.

Second Embodiment

Subsequently, a second embodiment will be described. The second embodiment shows a different example from the first embodiment in which the invention is applied to the ink-jet printer which ejects ink drops from the nozzles. Description of the same parts as in the first embodiment will be omitted as needed below.

Figure 24A:
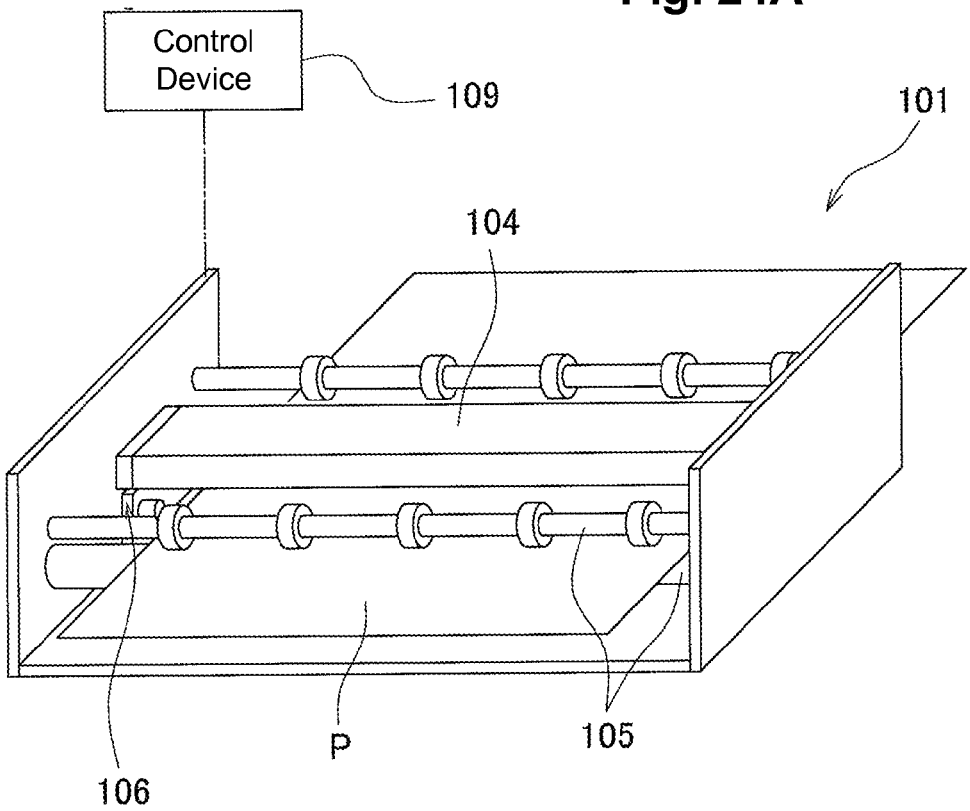
FIG. 24A is a schematic perspective view of the ink-jet printer according to a second embodiment.
Figure 24B:
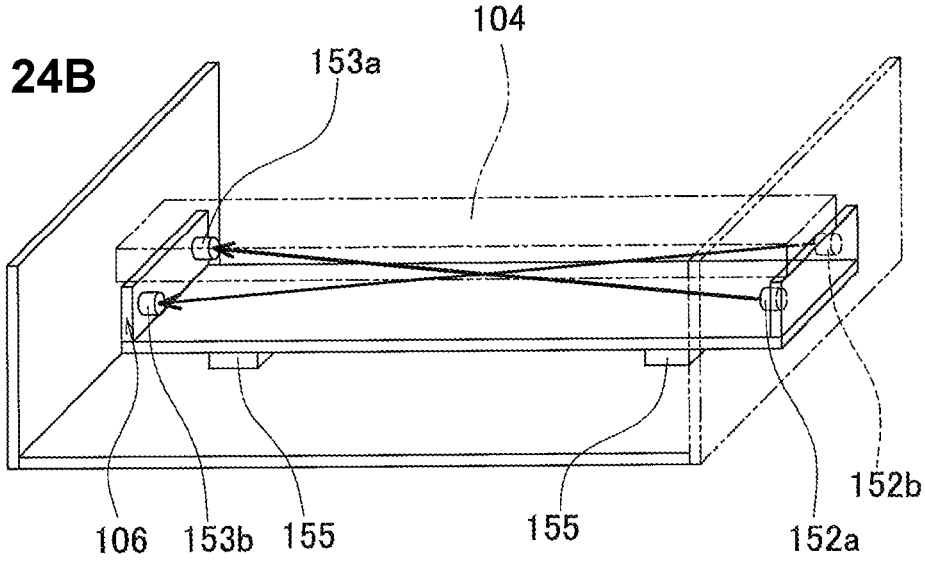
FIG. 24B is a drawing in which a part is removed from FIG. 24A.
Figure 25:
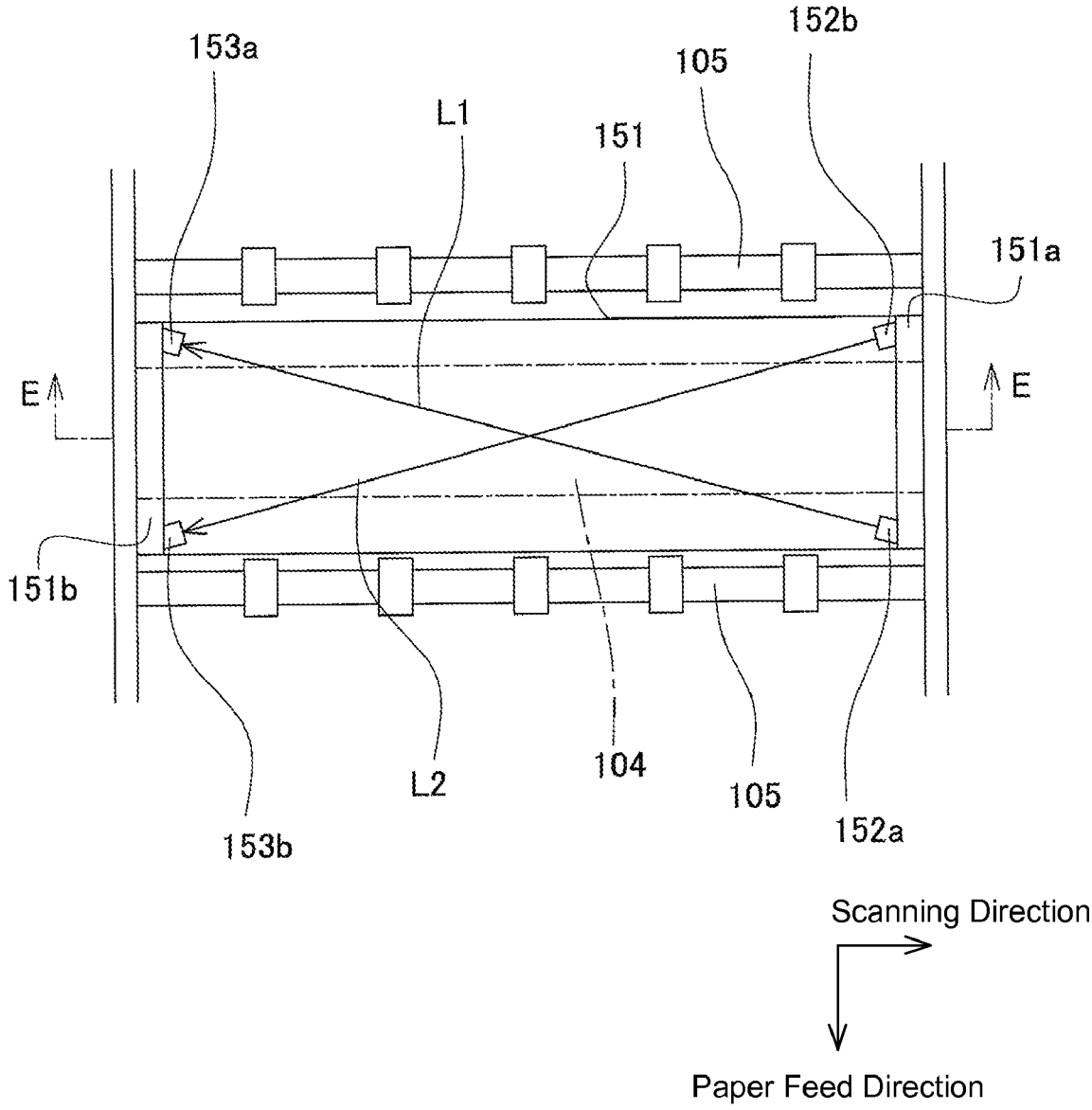
FIG. 25 is a plan view corresponding to FIG. 2 according to the second embodiment.

FIG. 24A is a schematic perspective view of an ink-jet printer 101 according to the second embodiment, and FIG. 24B is a drawing corresponding to FIG. 24A in which the recording paper P, a paper carrier roller 105, and a control device 109 are removed. FIG. 25 is a plan view of FIGS. 24A and 24B. FIG. 26A is a cross-sectional view taken along the line E-E in FIG. 25, and FIG. 26B is a drawing showing a state in which a laser beam is interrupted by an ink drop in FIG. 26A. As shown in FIG. 24 to FIG. 26, the ink-jet printer 101 includes an ink-jet head 104 (liquid drop ejection head), the carrier roller 105 (ejected medium carrier unit), a light detection device 106, and the control device 109. Although not shown in FIG. 24 to FIG. 26, the ink-jet printer 101 includes a wiping unit 107 and a purge unit 108 (see FIG. 28).

The ink-jet head 104 extends in a lateral direction in FIG. 24, and is fixed to the ink-jet printer 101. The ink-jet head 104 is a line-type head that ejects ink drops directly below from the ejection ports 15*a* (see FIG. 26) of the plurality of nozzles 15 (see FIG. 27) formed on an ink ejection surface 104*a* (liquid drop ejection surface, see FIG. 26) as the lower surface thereof in a resting state.

Figure 27:
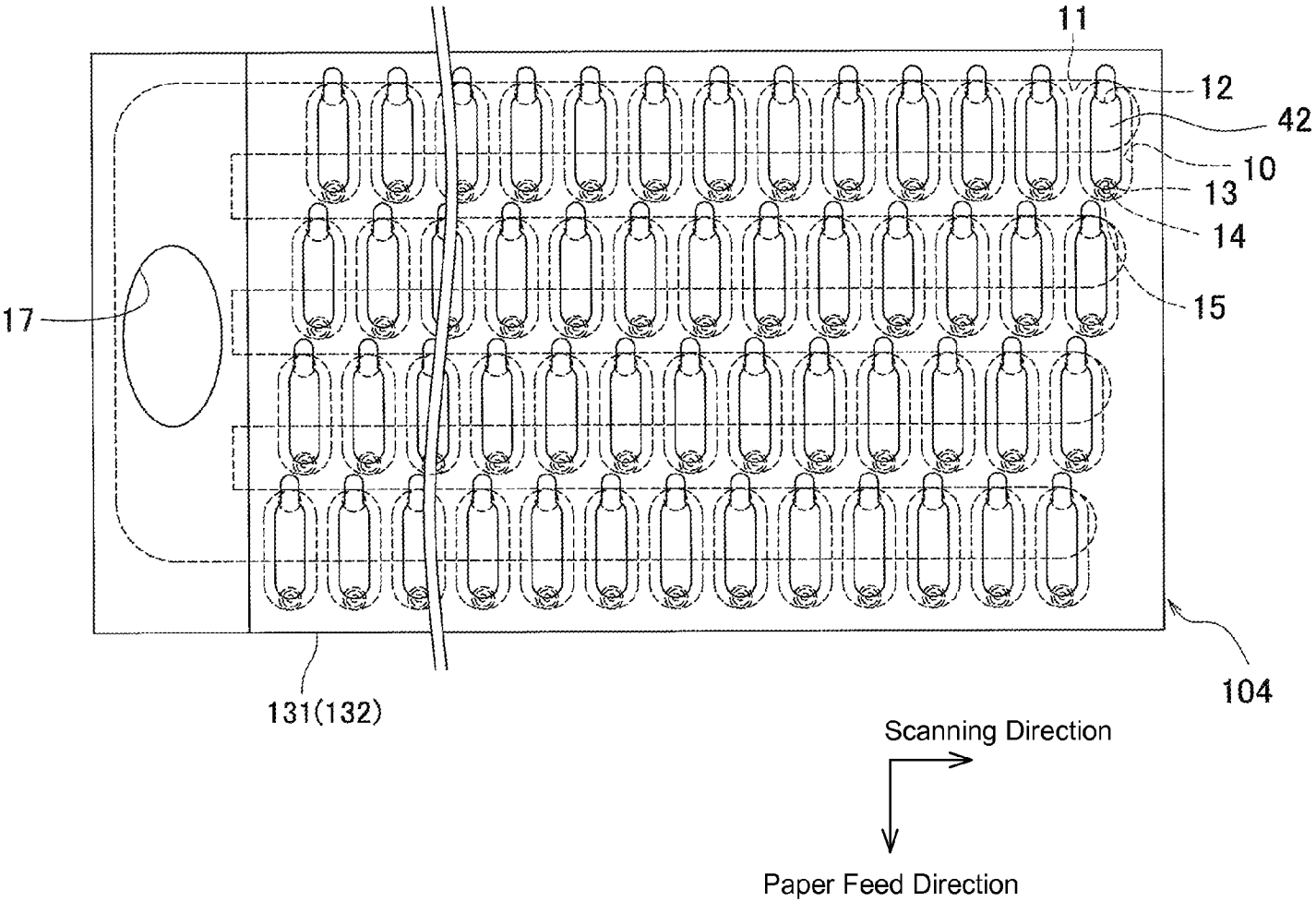
FIG. 27 is a plan view corresponding to FIG. 4 according to the second embodiment.

FIG. 27 is a plan view of the ink-jet head 104. As shown in FIG. 27, the ink-jet head 104 includes a flow channel unit 131 formed with the pressure chambers 10 and the manifold flow channel 11, and a piezoelectric actuator 132 arranged on the upper surface of the flow channel unit 131 like the first embodiment. However, in the flow channel unit 131, the plurality of pressure chambers 10 and the nozzles 15 are arranged in the lateral direction, and four rows of the pressure chambers 10 and the nozzles 15 are arranged in the paper feed direction. Other portions of the flow channel unit 131 and the respective portions of the piezoelectric actuator 132 are arranged in the same positional relationship with respect to the pressure chamber 10 as in the first embodiment.

Referring back to FIG. 24 to FIG. 26, the carrier roller 105 carries the recording paper P in the paper feed direction (toward the near side in FIG. 24). In the ink-jet printer 101, printing on the recording paper P is achieved by causing ink drops to be ejected on the recording paper P carried by the carrier roller 105 from the nozzles 15 by the ink-jet head 104.

The light detection device 106 may include a base member 151, two laser sources 152*a* and 152*b*, light receiving elements 153*a* and 153*b* for receiving the laser beam emitted respectively from these two laser sources 152*a* and 152*b*, and a transfer device 155. The base member 151 may be formed substantially into a rectangular shape elongated in the lateral direction (lateral direction in FIG. 26) when viewed in plan view, and formed with projections 151*a* and 151*b* projecting upward in FIG. 26 at the right end and the left end in the lateral direction.

The two laser sources 152*a* and 152*b* may be fixed to the inner side surface of the projections 151*a* near the lower end and near the upper end in FIG. 25 respectively, and the two light receiving elements 153*a* and 153*b* are fixed to the inner side surface of the projection 151*b* near the upper end and near the lower end in FIG. 25 respectively.

The ejection ports 15*a* of all the nozzles 15 may be positioned between the two laser sources 152*a* and 152*b* and the two light receiving elements 153*a* and 153*b* (between the two dotted lines shown in FIG. 26) in the lateral direction. In other words, the rightmost laser sources 152*a* and 152*b* may be to the right of the rightmost nozzle, and the leftmost light receiving elements 153*a* and 153*b* may be to the left of the leftmost nozzle, when viewed as shown in FIG. 26A.

The laser source 152*a* emits the laser beam L1 toward the light receiving element 153*a* and the laser source 152*b* emits the laser beam L2 toward the light receiving element 153*b* (emits the laser beams L1 and L2 along the one plane). When no ink drop is positioned between the laser source 152*a* and the light receiving element 153*a* as shown in FIG. 26A, the laser beam emitted from the laser source 152*a* reaches the light receiving element 153*a* and when no ink drop is positioned between the laser source 152*b* and the light receiving element 153*b*, the laser beam emitted from the laser source 152*b* reaches the light receiving element 153*b*. On the other hand, when the ink drop I is positioned between the laser source 152*a* and the light receiving elements 153*a* as shown in FIG. 26B, the light emitted from the laser source 152*a* is interrupted by this ink drop, and does not reach the light receiving element 153*a*, and when the ink drop I is positioned between the laser source 152*b* and the light receiving element 153*b*, the light emitted from the laser source 152*b* is interrupted by the ink drop I, and does not reach the light receiving element 153*b*.

The positional relationship between the two laser beams L1 and L2 and the ejection ports 15*a* of the nozzles 15 is the same as that shown in FIG. 10. However, using the FIG. 10 illustration for the second embodiment, the "scanning direction" labeled in FIG. 10 corresponds to the paper feed direction in the second embodiment, and the "paper feed direction" labeled in FIG. 10 corresponds to the lateral direction. In other words, the two laser beams L1 and L2 are emitted to the directions deviated by θ clockwise and counterclockwise with respect to the paper feed direction respectively, and the two laser beams L1 and L2 intersect with respect to each other, and the angle θ is determined so that the laser beams L1 and L2 each are not overlapped with two or more ejection ports 15*a* simultaneously in plan view when the light detection device 106 is moved in the paper feed direction as in the first embodiment.

The transfer device 155 causes the light detection device 106 to move in the paper feed direction (the vertical direction in FIG. 25). Accordingly, the ink-jet head 104 and the light detection device 106 are moved with respect to each other in the paper feed direction. Since the direction of movement of the light detection device 106 and the paper feed direction are parallel to each other, the area extending in the paper feed direction downwardly of the ink-jet head 104 may be used as an area for transferring the light detection device 106 in the ink-jet printer 101, so that the ink-jet printer 101 may be downsized.

Figure 28:
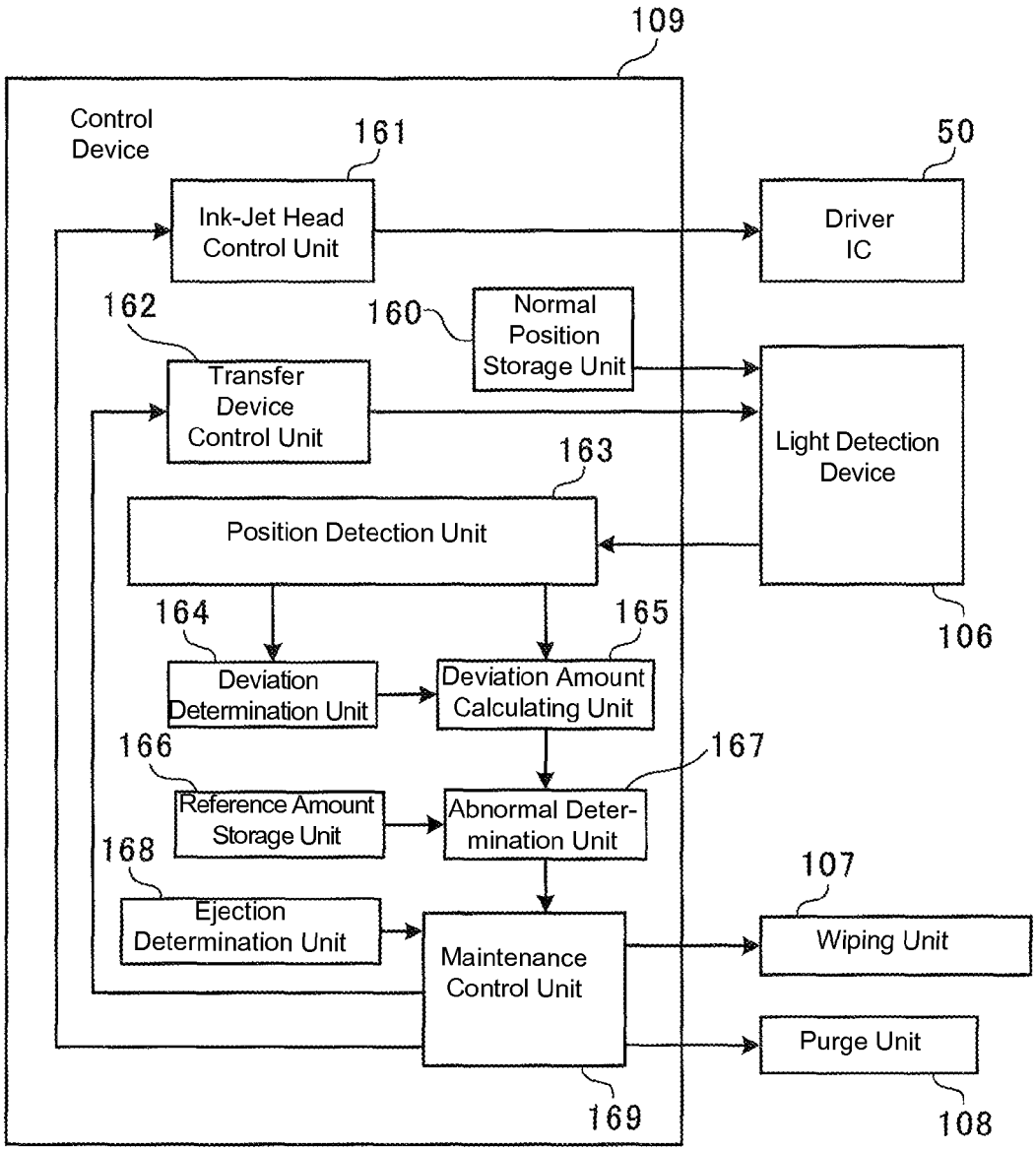
FIG. 28 is a block diagram of a control device in FIG. 24.

Subsequently, the control device 109 for controlling the ink-jet printer 101 will be described. FIG. 28 is a block diagram of the control device 109.

As shown in FIG. 28, the control device 109 may include a normal position storage unit 160, an ink-jet head control unit 161, a transfer device control unit 162, a position detection unit 163, a deviation determination unit 164, a deviation amount calculating unit 165, a reference amount storage unit 166, a abnormal determination unit 167, an ejection determination unit 168, and a maintenance control unit 169.

The normal position storage unit 160 stores the positions of the light detection device 106 when the ejection ports 15*a* of the respective nozzles 15 and the laser beams L1 and L2 are overlapped with each other in plan view (the position of the light detection device 106 with respect to the ink-jet head 104 at which the light receiving elements 153*a* and 153*b* do not receive the laser beams L1 and L2 respectively when the ink drops are normally ejected from a certain nozzle 15). The ink-jet head control unit 161 controls the operation of the ink-jet head 104 by controlling the driver IC 50. The transfer device control unit 162 controls the movement of the light detection device 106 by controlling the operation of the transfer device 155.

The position detection unit 163 detects the position of the light detection device 106 in the paper feed direction (the position of the light detection device 106 with respect to the ink-jet head 104). The deviation determination unit 164 determines whether or not deviation in the direction of ink drop ejection from the nozzles 15 occurs. The deviation amount calculating unit 165 calculates the amount of deviation in the direction of ink jet ejection from the nozzle 15. The reference amount storage unit 166 stores reference amounts which are maximum permissible amounts of deviation in the direction of ink drop ejection in terms of the lateral direction and the paper feed direction individually.

Figure 29A:
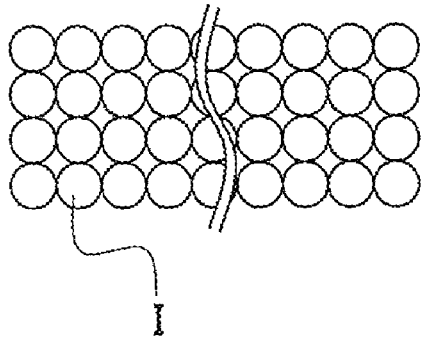
FIG. 29A illustrates ink drop landing positions in a case in which the ink drops are ejected normally.
Figure 29B:
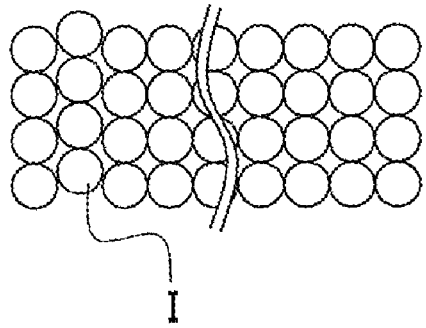
FIG. 29B illustrates ink drop landing positions in a case in which the direction of ink drop ejection is deviated in the paper feed direction.
Figure 29C:
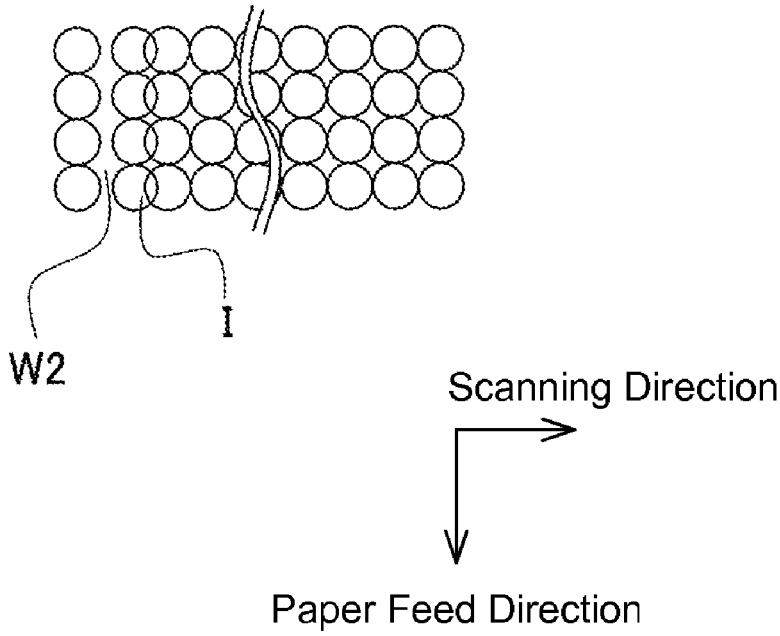
FIG. 29C illustrates ink drop landing positions in a case in which the direction of ink drop ejection is deviated in the scanning direction.

FIG. 29A illustrates landing positions of ink drops I on the recording paper P when the ink drops are normally ejected from the plurality of nozzles 15 which belong to one row from among the plurality of nozzles 15 arranged in four rows in FIG. 27. FIG. 29B illustrates landing positions of the ink drops I on the recording paper P when the direction of ink drop ejection from the nozzle 15 at the second from the left in FIG. 27 is deviated in the paper feed direction. FIG. 29C illustrates landing positions of the ink drops I on the recording paper P when the direction of ink drop ejection from the nozzle 15 at the second from the left in FIG. 27 is deviated in the lateral direction. As shown in FIG. 29B, when the direction of ejection of ink drops is deviated in the paper feed direction, lowering of the print quality may be relatively small as long as the amount of deviation is small. However, when the direction of ejection of ink drops is deviated in the lateral direction as shown in FIG. 29C, the extent of lowering of the print quality is significant since a streak of area W2 to which no ink drop is ejected extends continuously in the paper feed direction even though the amount of deviation is small. Therefore, in order to prevent the print quality from lowering, the reference amount in terms of the lateral direction stored in the reference amount storage unit 66 is smaller than the reference amount in terms of the paper feed direction.

Referring back to FIG. 28, the abnormality determination unit 167 determines that abnormality exists when at least one of the amounts of deviation in the direction of ink drop ejection from the nozzle 15 in the lateral direction and the paper feed direction calculated in the deviation amount calculating unit 165 is larger than the reference amounts in the respective directions stored in the reference amount storage unit 166.

The ejection determination unit 168 determines whether or not there exists nozzles 15 from which ink drops are not ejected. The maintenance control unit 169 controls the wiping unit 107 and the purge unit 108.

The wiping unit 107 serves to remove ink attached to the ink ejection surface 104*a* like the wiping unit 7 (see FIG. 1), and the purge unit 108 serves to perform purge like the purge unit 8 (see FIG. 1). The wiping unit 107, being different from the wiping unit 7, removes ink attached to the ink ejection surface 104*a* by moving by itself in the paper feed direction while bringing the distal end of the wiper, not shown, into abutment with the ink ejection surface 104*a*, and the purge unit 108, being different from the purge unit 8, moves by itself in the paper feed direction to a position opposing the ink ejection surface 104*a*.

Subsequently, the process of correcting the deviation in the direction of ink drop ejection at the nozzle 15 will be described.

In the same manner as the ink-jet printer 1 (see FIG. 1), in the ink-jet printer 101, as shown in FIG. 13, the nozzles 15 whose direction of ink drop ejection is deviated are specified from the plurality of nozzles 15 (S101) and, when the nozzles 15 whose direction of ink drop ejection is deviated exist (Yes in S102), the amount of deviation in terms of the lateral direction and the paper feed direction may be calculated only for the nozzles 15 whose direction of ink drop ejection is deviated (S103). When at least one of the calculated amounts of deviation in terms of both the lateral direction and the paper feed direction exceeds the reference amounts in terms of the respective directions stored in the reference amount storage unit 166 (Yes in S104), the maintenance operation may be performed (S105).

Figure 30:
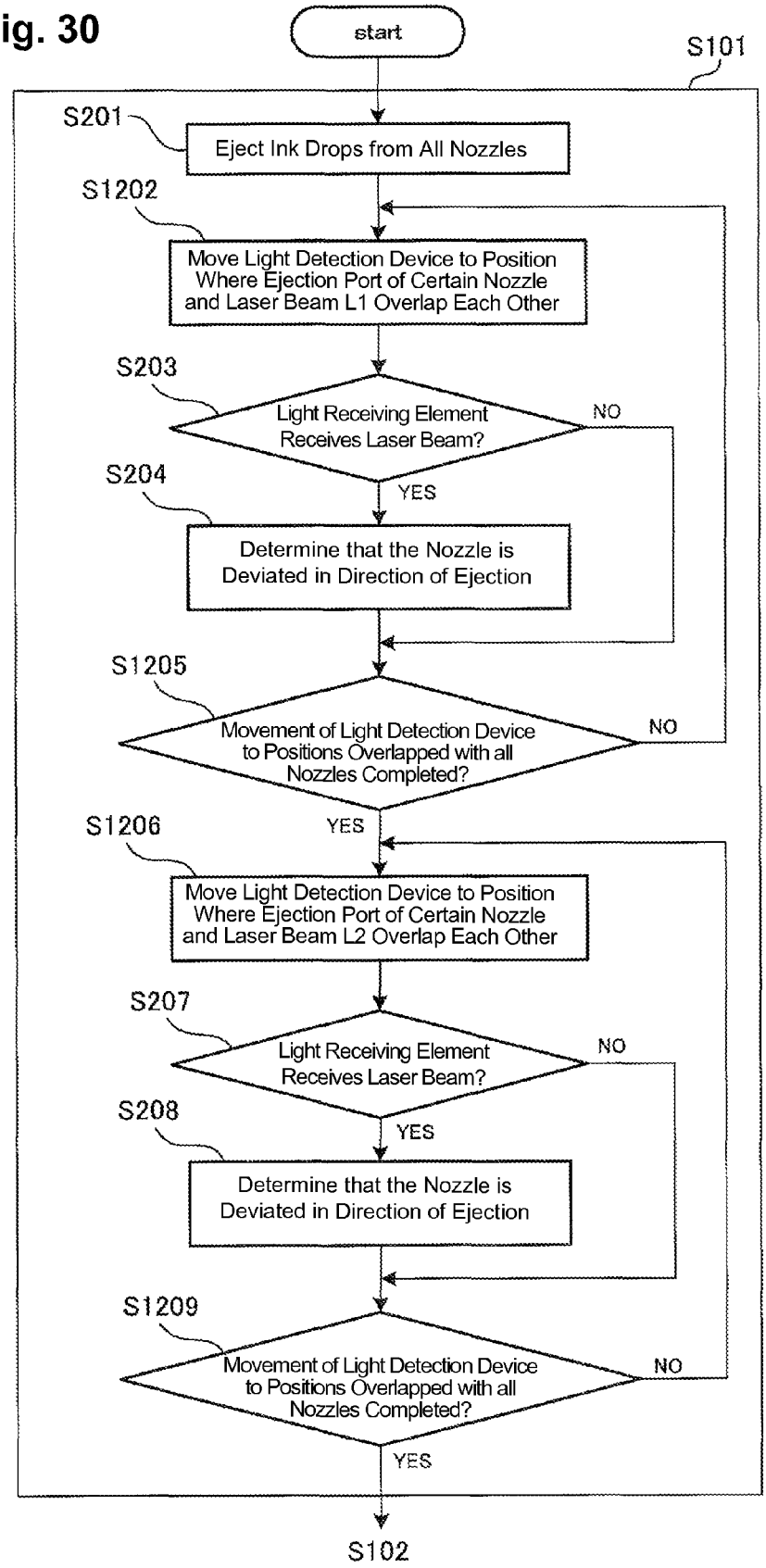
FIG. 30 is a flowchart corresponding to FIG. 14 according to the second embodiment.

Subsequently, a process of specifying the nozzle 15 deviated in the direction of ink drop ejection in S101 according to the second embodiment will be described. FIG. 30 is a flowchart showing this process.

As shown in FIG. 30, a process of specifying the nozzle 15 deviated in the direction of ink drop ejection in the second embodiment is such that, in the process shown in FIG. 14 according to the first embodiment, the light detection device 106 is moved to the position where the ejection ports 15*a* of a certain nozzle 15 and the laser beam L1 are overlapped to each other instead of S202 (S1202), whether or not the light detection device 106 is moved to the position where it is overlapped with all the ejection ports 15*a* is determined instead of S205 (S1205), the light detection device 106 is moved to the position where the ejection ports 15*a* of a certain nozzle 15 and the laser beam L2 are overlapped to each other instead of S206 (S1206), and whether or not the light detection device 106 is moved to the position where it is overlapped with all the ejection ports 15*a* is determined instead of S209 (S1209). Since other steps (S203, S203 to S205, S207, and S208) are the same as those in the first embodiment, the description will be omitted here.

In the second embodiment as well, since the laser beams emitted from the laser sources 152*a* and 152*b* are not overlapped with the ejection ports 15*a* of two or more nozzles 15 simultaneously as in the first embodiment, ink drop direction deviation can be determined in a short time for all the nozzles 15 by moving the light detection device 106 from the position adjacent to the ink-jet head 104 outside of one end thereof to the position adjacent thereto on the other end thereof in terms of the paper feed direction only once while causing all the nozzles 15 to eject ink drops.

In the process of specifying the nozzles deviated in the direction of ink drop ejection in S101 described thus far, the movement of the light detection device 106 may be continuous, or may be such that it stops intermittently at positions where the ejection port 15*a* of a certain nozzle 15 and the laser beam L1 or L2 are overlapped with each other and ejection from the nozzle 15 and the movement of the carriage 2 are not performed simultaneously (the ejection from the nozzle 15 and the movement of the light detection device 106 are performed alternately).

Figure 31:
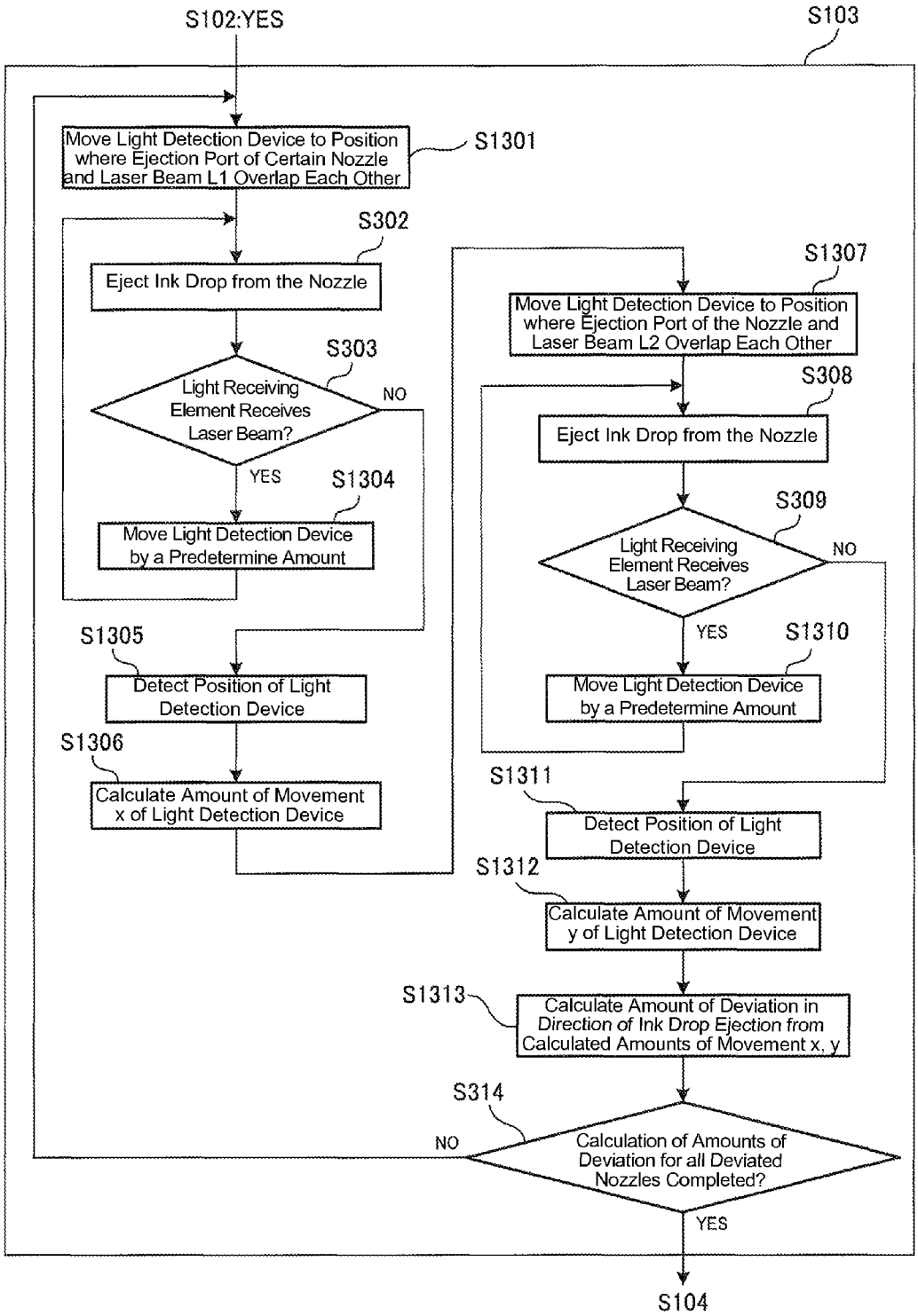
FIG. 31 is a flowchart corresponding to FIG. 15 according to the second embodiment.

A process of calculating the amount of deviation in the direction of ink drop ejection at the nozzle 15 in S102 will be described. FIG. 31 is a flowchart showing this process.

As shown in FIG. 31, a process of calculating the amount of deviation in the direction of ink drop ejection in the nozzle 15 in the second embodiment is such that, in the process shown in FIG. 15 according to the first embodiment, the light detection device 106 is moved to the position where a certain ejection port 15*a* and the laser beam L1 are overlapped with each other in stead of S301 (S1301), the position of the light detection device 106 is detected instead of the S305 and S311 (S1305 and S1311), the light detection device 106 is moved by a predetermined amount instead of S304 and S310 (S1304 and S1310), the amount of movement x of the light detection device 106 is calculated instead of S306 (S1306), the light detection device 106 is moved to the position where the ejection port 15*a* and the laser beam L2 are overlapped with each other instead of S307, the amount of movement y of the light detection device 106 is calculated instead of S312 (S1312), and the amount of deviation in the direction of ink drop ejection from the amounts of movement x and y calculated in S1306 and S1312 is calculated instead of S313. Since other steps (S303, S304, S308, S309, and S314) are the same as those in the first embodiment, description will be omitted here.

A method of calculating the amounts of movement x and y of the light detection device 106 and the amount of deviation in the direction of ejection will be described. FIGS. 32A and 32B and FIGS. 33A and 33B are drawings showing the operation of the ink-jet printer 101. The ink drop I1 in the case in which the ink drop is normally ejected (the position of the ejection port 15*a*) is represented by a chain line, and the ink drop I2 actually ejected is indicated by a solid line in FIGS. 32A and 32B and FIGS. 33A and 33B.

Figure 32B:
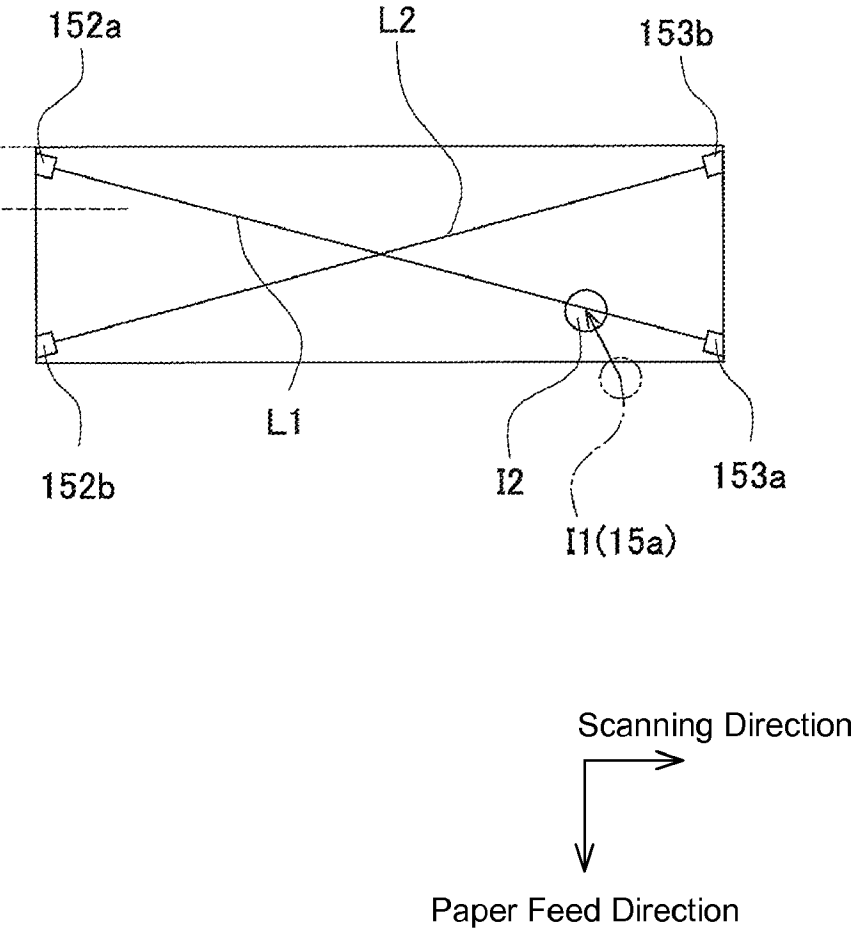
FIGS. 32A and 32B illustrate positions of the light detection device in the earlier part of the process in FIG. 31.
Figure 32A:
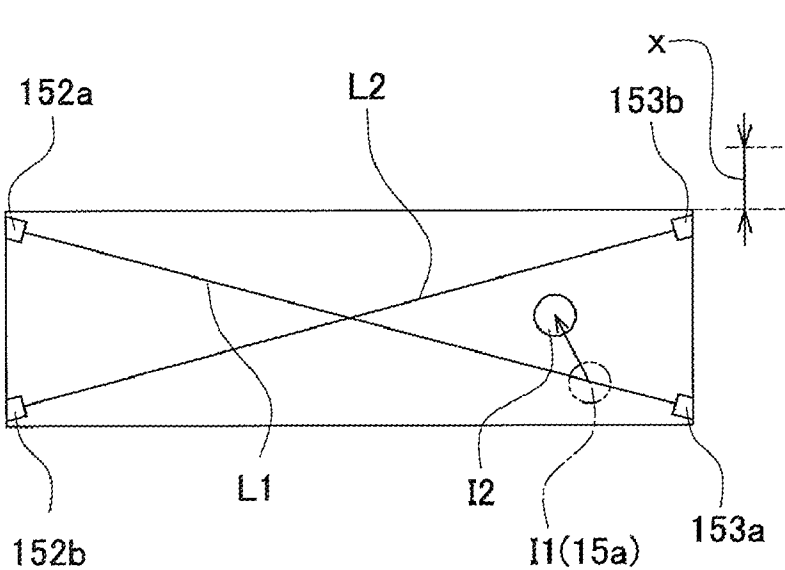

In S1301, the light detection device 106 is moved to a position where the ejection port 15*a* of a certain nozzle 15 and the laser beam L1 are overlapped with each other as shown in FIG. 32A. In S1305 as shown in FIG. 32B, the position of the light detection device 106 is detected by the position detection unit 163 when the light detection device 106 is moved to the position where the ink drop I2 ejected from the nozzle 15 in question is overlapped with the laser beam L1, and hence the light receiving element 153*a* does not receive the laser beam any longer. Then, in S1307, the amount of movement x of the light detection device 106 in terms of the paper feed direction is calculated from the position of the light detection device 106 stored in the normal position storage unit 160 in S1305 and the position of the light detection device 106 detected in S1306.

Figure 33A:
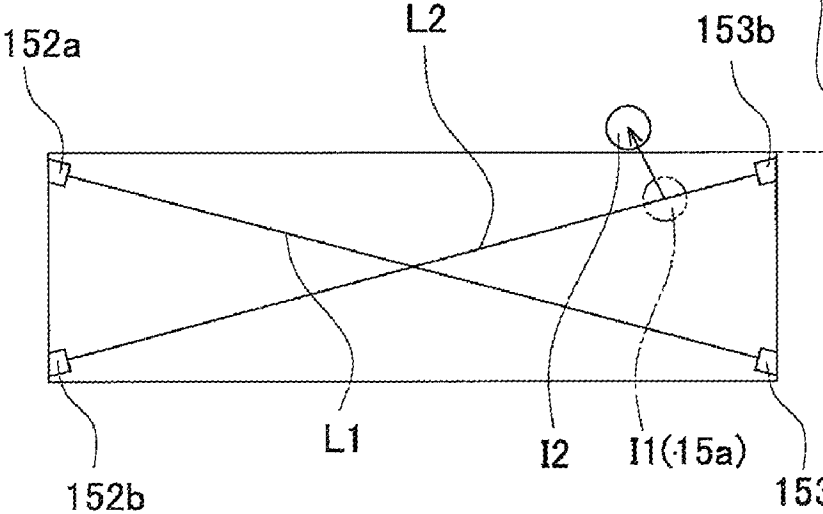
FIGS. 33A and 33B illustrate positions of the light detection device in the latter part of the process in FIG. 31.
Figure 33B:
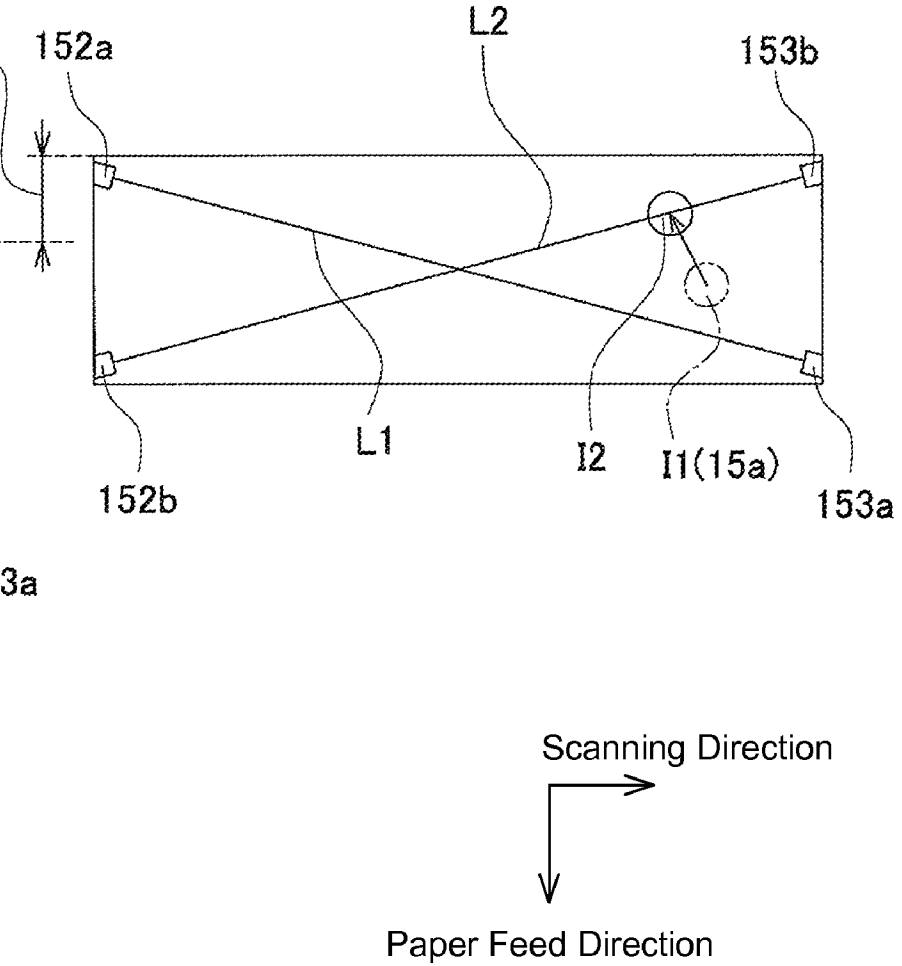

In S1307, the light detection device 106 is moved to a position where the ejection port 15*a* of the nozzle 15 in question and the laser beam L2 are overlapped with each other as shown in FIG. 33A. In S1311, as shown in FIG. 33B, the position of the light detection device 106 is detected by the position detection unit 163 when the light detection device 106 is moved to the position where the ink drop I2 ejected from the nozzle 15 in question is overlapped with the laser beam L2, and hence the light receiving element 153*b* does not receive the laser beam any longer. Then, in S1312, the amount of movement y of the light detection device 106 in terms of the paper feed direction is calculated from the position of the light detection device 106 stored in the normal position storage unit 160 in S1307 and the position of the light detection device 106 detected in S1311.

Here, when rewriting the positional relationship among the laser beam L1 in FIGS. 32A and 32B, the laser beam L2 in FIGS. 33A and 33B, and the ink drops I1 and I2 in FIGS. 32A and 32B and FIGS. 33A and 33B on the basis of the ink drops I1 and I2, the positional relationship as in FIG. 18 in the first embodiment is obtained. However, in the second embodiment, the "scanning direction" labeled in FIG. 18 corresponds to the paper feed direction in the second embodiment, and the "paper feed direction" labeled in FIG. 18 corresponds to the lateral direction in the second embodiment. Therefore, in the same manner as the first embodiment, the amount of deviation in the direction of ink drop ejection in terms of the lateral direction and the paper feed direction is accurately calculated to be $(y-x)/2 \tan \theta$, and $(x+y)/2$ respectively from the amounts of movement x and Y calculated in S1306 and S1312.

In S103 according to the second embodiment, the amount of deviation in the direction of ink drop ejection is calculated only for the nozzles 15 which are determined to be deviated in the direction of ink drop ejection in S101. Therefore, the amount of deviation in the direction of ink drop ejection can be calculated in a short time as in the first embodiment.

Subsequently, the maintenance operation in S105 shown in FIG. 13 according to the second embodiment will be described. When it is determined that abnormality exists by the abnormal determination unit 167, as shown in FIG. 19, the flushing is performed at the nozzle 15 deviated in the direction of ink drop ejection (S401) and, if the deviation in the direction of ink drop ejection cannot be corrected (No in S402), the wiping is performed (S403). However, if the deviation of in the direction of ink drop ejection is not corrected (No in S404), the purge is performed (S405). However, the second embodiment is different from the first embodiment. In particular, when performing the flushing in the second embodiment, ink drops are ejected from the nozzle 15 to an ink absorbing member, not shown, which is moved to a position opposing the ink ejection surface 104*a*. When performing the wiping, ink attached to the ink ejection surface 104*a* is removed by the movement of the wiping unit 107 in the paper feed direction. When performing the purge, a purge cap, not shown, is moved to the position opposing the ink ejection surface 104*a* and comes into abutment with the ink ejection surface 104*a*, and ink from all the nozzles 15 is sucked by lowering the pressure in a space surrounded by the purge cap and the ink ejection surface 104*a* by a pump, not shown.

In the second embodiment as well, the wiping may be performed only when the deviation in the direction of ink drop ejection cannot be corrected after having performed the flushing in the maintenance operation, and the purge may be performed only when the deviation in the direction of ink drop ejection cannot be corrected, so that the amount of ink to be consumed through the maintenance operation is reduced, and the life of the ink-jet head 4 is elongated as in the case of the first embodiment.

A process of restoring the ejection of ink from the nozzle 15 from which the ink drops are not ejected to a normal state will be described. In this process, as in the first embodiment, the nozzle 15 from which the ink drops are not ejected is specified (S501) as shown in FIG. 21. When the nozzle 15 from which the ink drops are not ejected does not exist (No in S502), the operation is terminated. When there exists the nozzle 15 from which the ink drops are not ejected (Yes in S502), the maintenance operation is performed (S503) and the operation is terminated.

Figure 34:
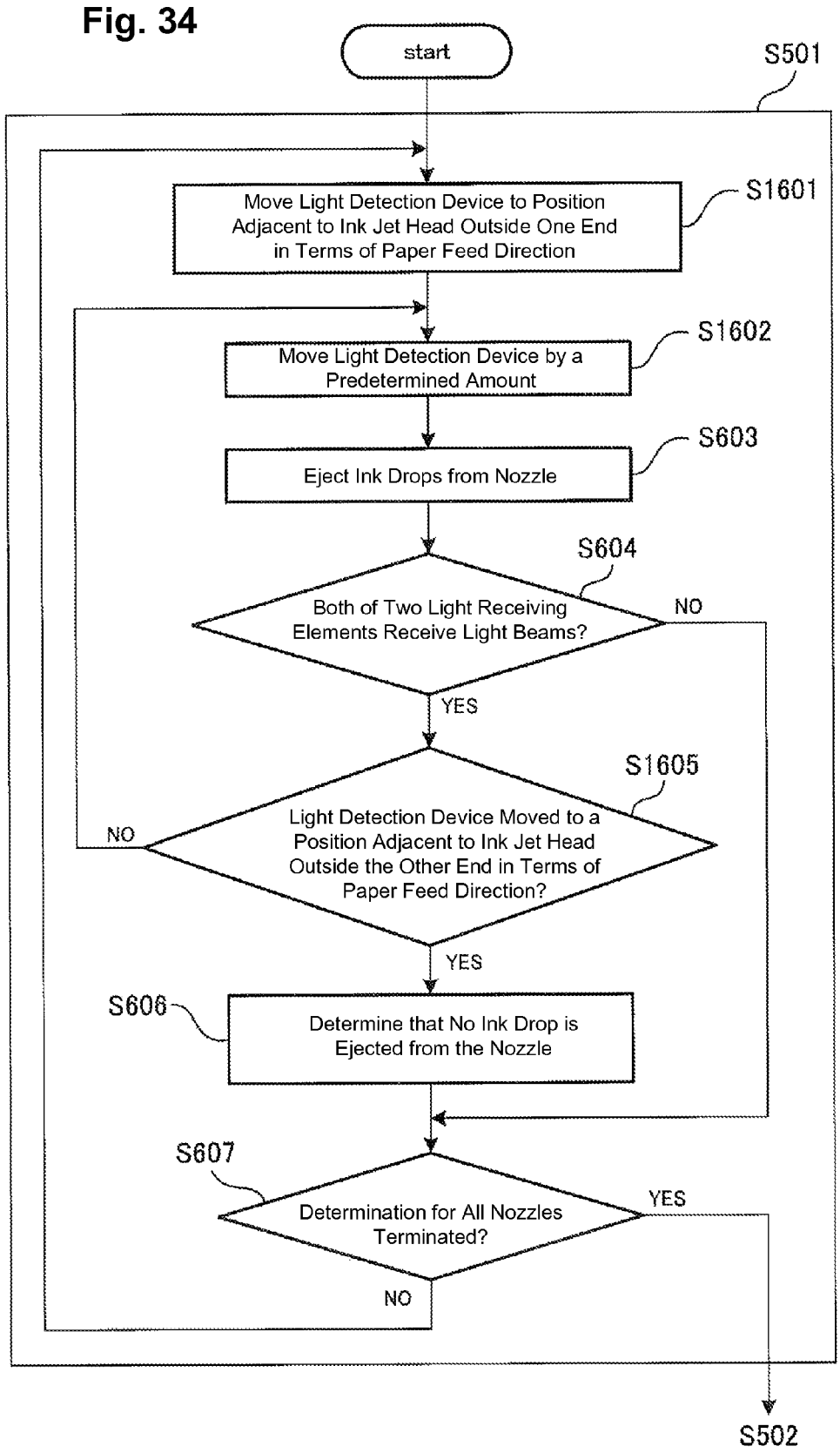
FIG. 34 is a flowchart corresponding to FIG. 22 according to the second embodiment.

Subsequently, a process in S501 shown in FIG. 21 according to the second embodiment will be described. FIG. 34 is a flowchart showing this process. The process of specifying the nozzle 15 from which the ink drops are not ejected is such, as shown in FIG. 34, that the light detection device 106 is moved to a position adjacent to the ink-jet head 104 outside of one end thereof in terms of the paper feed direction instead of S601 (S1601), the light detection device 106 is moved by a predetermined amount in the paper feed direction instead of S602 (S1602), and whether or not the light detection device 106 is moved to the position adjacent to the ink-jet head 104 outside the other end thereof in the paper feed direction is determined instead of S605 (S1605) in the process shown in FIG. 22 in the first embodiment. Other steps (S603, S604, S606, and S607) are the same as those in the first embodiment, the description will be omitted here.

The process in S503 shown in FIG. 22 according to the second embodiment will be described. In the second embodiment as well, the flushing for causing the nozzle 15 from which the ink drops are not ejected to eject ink drops is performed in the same manner as the first embodiment (S701) as shown in FIG. 23. The purge is performed (S703) only when ink drops are not ejected from the nozzle 15 even though the flushing is performed (No in S702). However, the second embodiment is different from the first embodiment. When performing the flushing, ink drops are ejected from the nozzle 15 to the ink absorbing member, not shown, which is moved to the position opposing the ink ejection surface 104*a*. When performing the purge, a purge cap, not shown, is moved to the position opposing the ink ejection surface 104*a* and comes into abutment with the ink ejection surface 104*a*, and ink from all the nozzles 15 is sucked by lowering the pressure in a space surrounded by the purge cap and the ink ejection surface 104*a* by a pump or the like, not shown.

In the second embodiment as well, the flushing is performed first in the maintenance operation and, the purge may be performed only when the ink drops are not ejected from the nozzle 15 even when the flushing is performed, so that the amount of ink consumed in the maintenance operation is reduced.

According to the second embodiment described above, the two laser sources 152*a* and 152*b* emit the laser beams that intersect with respect to each other along the one plane. Therefore, when the direction of ink drops ejected from a certain nozzle 15 is deviated in any directions in the one plane, the position of the light detection device 106 at which at least one of the laser beams emitted from the two laser sources 152*a* and 152*b* is interrupted by a liquid drop ejected from the nozzle 15 in question, and hence the corresponding light receiving element 153*a* or 153*b* do not receive the laser beam is different from the position of the light detection device 106 at which the ink is ejected in the normal direction in a case in which the light detection device 106 is moved in the paper feed direction while causing the nozzle 15 in question to eject ink drops. Therefore, the deviation in the direction of ink drop ejection is detected by moving the light detection device 106 in the paper feed direction while ejecting the ink drops from the nozzles 15 irrespective of the direction of deviation of the ink drop ejected from the nozzle 15 in the one plane.

When the light detection device 106 is moved in the paper feed direction, the laser beams emitted from the two laser sources 152*a* and 152*b* pass through the area opposing the ejection ports 15*a* of the plurality of nozzles 15. Therefore, when the ink drop is ejected from a certain nozzle 15, the two light receiving elements 153*a* and 153*b* do not receive the light beams when the light detection device 106 reaches the nozzle's respective normal positions. In contrast, when the ink drop is not ejected from the nozzle 15 in question, the two light receiving elements 153*a* and 153*b* never fail to receive the laser beams, but they receive one or more of the laser beams during this period. Therefore, the fact that the ink drop is not ejected from the nozzle 15 is detected by moving the light detection device 106 in the paper feed direction while causing the nozzles 15 to eject ink drops.

Also, the amount of deviation in the direction of ink drop ejection at the nozzle 15 is accurately calculated by the deviation amount calculating unit 165 from the amount of deviation in terms of the paper feed direction between the position of the light detection device 106 assumed when the light beams emitted respectively from the two laser sources 152*a* and 152*b* are interrupted by ink drops ejected from a certain nozzle 15 and hence are not received by the light receiving elements 153*a* and 153*b*, and the position of the light detection device 106 assumed when the light receiving elements 153*a* and 153*b* do not receive the laser beams since the liquid drops are ejected normally from the nozzle 15 in question.

Since whether or not the direction of ink drop ejected from the nozzle 15 is deviated is determined easily by the deviation determination unit 164, the amount of deviation in the direction of ink drops ejected from the nozzles 15 is calculated in a short time by determining whether or not there is any nozzles 15 whose direction of ink drop ejection is deviated and then detecting the amount of deviation in the direction of ink drop ejection only for the nozzles 15 determined to be deviated in the direction of ink drop ejection.

Since the laser beams emitted from the laser sources 152*a* and 152*b* do not overlap with the ejection ports 15*a* of two or more nozzles 15 simultaneously, whether or not the direction of ink drop ejection is deviated can be determined for all the nozzles 15 in a short time by moving the light detection device 106 from the position adjacent to the ink-jet head 104 outside of one end thereof to the position adjacent thereto on the other end thereof in terms of the paper feed direction only once while causing all the nozzles 15 to eject ink drops. Accordingly, whether or not the direction of ink drop ejection is deviated is determined for all the nozzles 15 in a short time.

The reference amount storage unit 166 stores the reference amounts individually for the lateral direction and the paper feed direction, and the abnormal determination unit 167 determines that abnormality in ink drop ejection exists at a certain nozzle 15 when the amount of deviation in the direction of ink drop ejected from the nozzle 15 in question calculated by the deviation amount calculating unit 165 in at least one of the lateral direction and the paper feed direction exceeds the reference amount in the corresponding direction. Therefore, the existence of abnormality is determined accurately when the amount of deviation in the ink drop ejection at the nozzle 15 exceeds the negligible extent.

The ink-jet head 104 may be the line-type head that ejects ink drop in a state of resting on the recording paper P carried in the paper feed direction, and the reference amount storage unit 166 stores the reference amount in terms of the paper feed direction and the reference amount in the lateral direction. Therefore, in the ink-jet printer 101 provided with the line-type head, the deviation in the direction of ink drop ejection is detected.

Since the ink-jet head 104 can be the line-type head, when the direction of ink drop ejection is deviated in the lateral direction, the streak of area W2 to which no ink is ejected extends continuously in the paper feed direction is formed on the recording paper P having completely printed, and the print quality is significantly lowered. On the other hand, even when the direction of ink drop ejection is deviated in the paper feed direction, the steak of area is not formed, and hence adverse effects on the image quality are small. Therefore, by setting the reference amount in terms of the lateral direction smaller than the reference amount in terms of the paper feed direction, deterioration of the print quality is prevented.

By setting the direction of movement of the light detection device 106 parallel to the paper feed direction, the ink-jet printer 101 is downsized.

Subsequently, an embodiment obtained by applying various modifications to the second embodiment will be described.

In the second embodiment, the light detection device 106 is moved in the paper feed direction. However, a configuration in which the light detection device 106 is arranged so that the ejection ports 15*a* of all the nozzles 15 are positioned between the two laser sources 152*a* and 152*b* and the two light receiving elements 153*a* and 153*b* in the paper feed direction when viewed in plan view and is adapted to move in the lateral direction is also applicable. In other words, the light detection unit may be configured to move in the lateral direction as well as the paper feed direction.

In the second embodiment as well, when specifying the nozzle 15 deviated in the direction of ink drop ejection, it is also possible to move the light detection device 106 in the paper feed direction and cause the nozzle 15 to eject ink drops when at least the laser beams L1 or L2 is moved to a position overlapped with the ejection port 15*a* of the nozzle 15 as in the first embodiment.

In the same manner as the first embodiment, a configuration in which the laser beams L1 and L2 are overlapped with two or more ejection ports 15*a* simultaneously in plan view during the movement of the light detection device 106 may also be applicable.

It is also possible to calculate the amount of deviation in the direction of ink drop ejection for all the nozzles 15 without specifying the nozzle 15 deviated in the direction of ejection as in the first embodiment.

In the same manner as the first embodiment, it is also possible to store one reference amount in the reference amount storage unit 166, and determine that abnormality exists by the abnormal determination unit 167 when at least one of the amounts of deviation in the direction of ink drop ejection in terms of the lateral direction and the paper feed direction calculated by the deviation amount calculating unit 165 exceeds the reference amount thereof.

According to the first and second embodiments described above, the example applied to the ink-jet printer for ejecting ink drops has been described. However, the features herein may be applied to other types of devices, such as liquid drop ejection apparatus for ejecting light-reflecting liquid drops other than ink, such as reagents, biological solutions, wiring material solutions, electronic material solutions, cooling media, and fuel.

What is claimed is:

1. A liquid drop ejection apparatus comprising:

a liquid drop ejection head having a plurality of liquid drop ejection nozzles on a liquid drop ejection surface;

a light detection unit configured to emit two coplanar beams of light in different directions and detect said beams of light;

a transfer unit configured to cause relative movement between the light detection unit and the liquid drop ejection head in a direction different from directions of the light beams; and a control unit configured to control the transfer unit to cause the light detection unit to move;

a position detection unit configured to detect a position of the light detection unit with respect to the liquid drop ejection head; and a deviation amount calculating unit configured to calculate an amount of deviation in the direction of liquid drops ejected from one or more of said nozzles, wherein the control unit is configured to cause the liquid drop ejection head to cause a certain nozzle to eject liquid drops while it controls the transfer unit to cause the light detection unit and the liquid drop ejection head to move with respect to each other, wherein the position detection unit is configured to detect the position of the light detection unit with respect to the liquid drop ejection head when the light detection unit does not detect one of the light beams, and wherein the deviation amount calculating unit is configured to calculate the amount of deviation in the direction of liquid drop ejection by comparing the position of the light detection unit when it stopped receiving the one of the light beams with a predetermined position at which the one of the light beams was received during normal operation.

2. The liquid drop ejection apparatus according to claim 1, further comprising a deviation determination unit configured to determine whether deviation has occurred in the direction of liquid drops ejected from the plurality of nozzles, wherein the control unit is configured to control the liquid drop ejection head to cause a certain nozzle to eject liquid drops when the position of the light detection unit matches a predetermined position at which one of the light beams is not detected during normal operation, and wherein the deviation determination unit is configured to determine that the direction of liquid drop ejection from a certain nozzle is deviated when the light detection unit detects one of said beams of light at a position where the light detection unit does not detect said one of said beams of light during normal operation, and wherein the deviation amount calculating unit is configured to calculate the amount of deviation in the direction of liquid drop ejection only for the nozzle determined to be deviated in the direction of liquid drop ejection by the deviation determination unit.

3. The liquid drop ejection apparatus according to claim 2, wherein the light detection unit is configured such that each of the coplanar beams of light is not overlapped with the ejection ports of more than one nozzle simultaneously when viewed in a direction orthogonal to the plane of the beams of light when the light detection unit and the liquid drop injection head are moved with respect to each other.

4. The liquid drop ejection apparatus according to claim 1, further comprising: an abnormal determination unit configured to determine whether abnormality in liquid drop ejection exists for the plurality of nozzles; and a reference amount storage unit storing a predetermined reference amount, wherein the abnormal determination unit determines that abnormality in liquid drop ejection exists at a certain nozzle when the amount of deviation in the direction of liquid drop ejection from the nozzle calculated by the deviation amount calculating unit exceeds the reference amount.

5. The liquid drop ejection apparatus according to claim 4, wherein the predetermined reference amount includes reference amounts for two orthogonal directions, and the abnormal determination unit is configured to determine that the abnormality in liquid drop ejection exists at a certain nozzle when the amount of deviation in liquid drop ejected from the nozzle in at least one of the two directions calculated by the deviation amount calculating unit exceeds the reference amount in terms of the corresponding direction.

6. The liquid drop ejection apparatus according to claim 5, further comprising a medium carrier unit configured to carry a medium that is to receive liquid drops ejected by the liquid drop ejection head to a position facing a liquid drop ejection surface, wherein the liquid drop ejection head is configured to eject liquid drops to the medium while moving in a direction parallel to the liquid drop ejection surface, and wherein the reference amount storage unit stores the reference amount in terms of a direction in which the medium is carried by the medium carrier unit and the direction of movement of the liquid drop ejection head.

7. The liquid drop ejection apparatus according to claim 6, wherein the reference amount in the direction the medium is carried by the medium carrier unit is smaller than the reference amount in the direction of movement of the liquid drop ejection head.

8. The liquid drop ejection apparatus according to claim 7, wherein the light detection device includes light emitting and light receiving units arranged so that a line between them extends in a direction parallel to the direction the medium is carried by the medium carrier unit.

9. The liquid drop ejection apparatus according to claim 5, further comprising a medium carrier unit configured to carry a medium to receive liquid drops ejected by the liquid drop ejection head to a position facing a liquid drop ejection surface in a direction parallel to the liquid drop ejection surface, wherein the liquid drop ejection head is configured to eject liquid drops to the medium while in a resting state, and wherein the reference amount storage unit is configured to store the reference amount in terms of a lateral direction of the liquid drop ejection head and the direction in which the medium carrier unit carries the medium.

10. The liquid drop ejection apparatus according to claim 9, wherein the reference amount in the lateral direction of the liquid drop ejection head is smaller than the reference amount in the direction in which the medium carrier unit carries the medium.

11. The liquid drop ejection apparatus according to claim 10, wherein the light detection device includes light emitting and light receiving units arranged so that a line between them extends in a direction orthogonal to the direction the medium is carried by the medium carrier unit.

12. The liquid drop ejection apparatus according to claim 7, wherein the light detection device is configured to move in a direction that is parallel to the direction the medium is carried by the medium carrier.

13. The liquid drop ejection apparatus according to claim 10, wherein the light detection device is configured to move in a direction that is parallel to the direction the medium is carried by the medium carrier.

14. The liquid drop ejection apparatus of claim 1, wherein said light detection unit includes light-emitting and light-receiving units located on opposite sides of an area through which liquid drops from said nozzles pass when ejected from said nozzles.

15. The liquid drop ejection apparatus according to claim 2, further comprising: an abnormal determination unit configured to determine whether abnormality in liquid drop ejection exists for the plurality of nozzles; and a reference amount storage unit storing a predetermined reference amount, wherein the abnormal determination unit determines that abnormality in liquid drop ejection exists at a certain nozzle when the amount of deviation in the direction of liquid drop ejection from the nozzle calculated by the deviation amount calculating unit exceeds the reference amount.

16. The liquid drop ejection apparatus according to claim 15, wherein the predetermined reference amount includes reference amounts for two orthogonal directions, and the abnormal determination unit is configured to determine that the abnormality in liquid drop ejection exists at a certain nozzle when the amount of deviation in liquid drop ejected from the nozzle in at least one of the two directions calculated by the deviation amount calculating unit exceeds the reference amount in terms of the corresponding direction.

17. The liquid drop ejection apparatus according to claim 16, further comprising a medium carrier unit configured to carry a medium that is to receive liquid drops ejected by the liquid drop ejection head to a position facing a liquid drop ejection surface, wherein the liquid drop ejection head is configured to eject liquid drops to the medium while moving in a direction parallel to the liquid drop ejection surface, and wherein the reference amount storage unit stores the reference amount in terms of a direction in which the medium is carried by the medium carrier unit and the direction of movement of the liquid drop ejection head.

18. The liquid drop ejection apparatus according to claim 17, wherein the reference amount in the direction the medium is carried by the medium carrier unit is smaller than the reference amount in the direction of movement of the liquid drop ejection head.

19. The liquid drop ejection apparatus according to claim 18, wherein the light detection device includes light emitting and light receiving units arranged so that a line between them extends in a direction parallel to the direction the medium is carried by the medium carrier unit.

20. The liquid drop ejection apparatus according to claim 16, further comprising a medium carrier unit configured to carry a medium to receive liquid drops ejected by the liquid drop ejection head to a position facing a liquid drop ejection surface in a direction parallel to the liquid drop ejection surface, wherein the liquid drop ejection head is configured to eject liquid drops to the medium while in a resting state, and wherein the reference amount storage unit stores the reference amount in terms of a lateral direction of the liquid drop ejection head and the direction in which the medium carrier unit carries the medium.

21. The liquid drop ejection apparatus according to claim 20, wherein the reference amount in the lateral direction of the liquid drop ejection head is smaller than the reference amount in the direction in which the medium carrier unit carries the medium.

22. The liquid drop ejection apparatus according to claim 21, wherein the light detection device includes light emitting and light receiving units arranged so that a line between them extends in a direction orthogonal to the direction the medium is carried by the medium carrier unit.

23. The liquid drop ejection apparatus according to claim 18, wherein the light detection device is configured to move in a direction that is parallel to the direction the medium is carried by the medium carrier.

24. The liquid drop ejection apparatus according to claim 21, wherein the light detection device is configured to move in a direction that is parallel to the direction the medium is carried by the medium carrier.

* * * * *